US010894418B2

(12) United States Patent
Ishizawa et al.

(10) Patent No.: US 10,894,418 B2
(45) Date of Patent: Jan. 19, 2021

(54) LIQUID SUPPLY UNIT

(71) Applicant: Seiko Epson Corporation, Tokyo (JP)

(72) Inventors: Taku Ishizawa, Nagano-Ken (JP); Satoshi Shinada, Nagano-Ken (JP); Yoshiaki Shimizu, Nagano-Ken (JP); Noriyuki Fukasawa, Nagano-Ken (JP)

(73) Assignee: SEIKO EPSON CORPORATION, Tokyo (JP)

( * ) Notice: Subject to any disclaimer, the term of this patent is extended or adjusted under 35 U.S.C. 154(b) by 320 days.

(21) Appl. No.: 16/066,048

(22) PCT Filed: Nov. 18, 2016

(86) PCT No.: PCT/JP2016/084212
§ 371 (c)(1),
(2) Date: Jun. 25, 2018

(87) PCT Pub. No.: WO2017/115581
PCT Pub. Date: Jul. 6, 2017

(65) Prior Publication Data

US 2020/0269586 A1 Aug. 27, 2020

(30) Foreign Application Priority Data

Dec. 28, 2015 (JP) ..... 2015-256026

(51) Int. Cl.
*B41J 2/175* (2006.01)

(52) U.S. Cl.
CPC ..... *B41J 2/1752* (2013.01); *B41J 2/17513* (2013.01); *B41J 2/1753* (2013.01); *B41J 2/17553* (2013.01); *B41J 2002/17516* (2013.01)

(58) Field of Classification Search
CPC ..... B41J 2/1752; B41J 2/17513; B41J 2002/17516; B41J 2/1753; B41J 2002/17573
See application file for complete search history.

(56) References Cited

U.S. PATENT DOCUMENTS 6,554,412 B1 4/2003 Seino et al.
6,722,762 B2 4/2004 Miyazawa et al.
(Continued)

FOREIGN PATENT DOCUMENTS

JP S63-106090 U 7/1988
JP H06-029077 U 4/1994
(Continued)

*Primary Examiner* — Sharon Polk
(74) *Attorney, Agent, or Firm* — Oliff PLC

(57) ABSTRACT

A liquid supply unit includes an outer shell; a contact portion that is disposed in the outer shell and that is configured to electronically connect to the apparatus-side terminal by making contact with the apparatus-side terminal; a liquid supply port that is disposed on the outer shell and used for inserting the liquid introducing portion; and a receiving portion that extends in a protruding direction in which the guide member protrudes outward in a mounting state in which the liquid supply unit is mounted onto the liquid ejection apparatus, and that is configured to receive the guide member. At least a part of the receiving portion is located between the liquid supply port and the contact portion in a predetermined direction orthogonal to a direction in which the receiving portion extends.

9 Claims, 36 Drawing Sheets

(56) References Cited

U.S. PATENT DOCUMENTS

| | | | | |
|---|---|---|---|---|
| 6,863,376 | B2 | 3/2005 | Seino et al. | |
| 6,905,199 | B2 | 6/2005 | Miyazawa et al. | |
| 6,926,396 | B2 | 8/2005 | Ota et al. | |
| 6,955,422 | B2 | 10/2005 | Miyazawa et al. | |
| 7,018,027 | B2 | 3/2006 | Harada et al. | |
| 7,018,030 | B2 | 3/2006 | Seino et al. | |
| 7,178,902 | B2 | 2/2007 | Seino et al. | |
| 7,237,882 | B2 | 7/2007 | Miyazawa et al. | |
| 7,293,864 | B2 | 11/2007 | Kimura et al. | |
| 7,293,866 | B2 | 11/2007 | Miyazawa et al. | |
| 7,325,915 | B2 | 2/2008 | Miyazawa et al. | |
| 7,367,652 | B2 | 5/2008 | Miyazawa et al. | |
| 7,438,401 | B2 | 10/2008 | Seino et al. | |
| 7,566,112 | B2 | 7/2009 | Seino et al. | |
| 7,614,732 | B2 | 11/2009 | Miyazawa et al. | |
| 7,748,835 | B2 | 7/2010 | Miyazawa et al. | |
| 7,784,930 | B2 | 8/2010 | Miyazawa et al. | |
| 7,806,523 | B2 | 10/2010 | Seino et al. | |
| 7,815,298 | B2 | 10/2010 | Miyazawa et al. | |
| 7,934,794 | B2 | 5/2011 | Miyazawa et al. | |
| 7,934,822 | B2 | 5/2011 | Miyazawa et al. | |
| 7,954,935 | B2 | 6/2011 | Kimura et al. | |
| 8,136,930 | B2 * | 3/2012 | Anma ..... | B41J 2/17546 347/86 |
| 8,439,482 | B1 | 5/2013 | Kodama et al. | |
| 8,708,469 | B2 | 4/2014 | Kodama et al. | |
| 8,721,045 | B2 | 5/2014 | Kodama et al. | |
| 8,752,944 | B2 | 6/2014 | Nozawa et al. | |
| 8,807,721 | B2 | 8/2014 | Nozawa et al. | |
| 8,915,582 | B2 | 12/2014 | Kodama et al. | |
| 8,974,044 | B2 | 3/2015 | Kodama et al. | |
| 8,985,743 | B2 | 3/2015 | Sasaki | |
| 9,039,153 | B2 | 5/2015 | Matsuzaki et al. | |
| 9,039,154 | B2 | 5/2015 | Kodama et al. | |
| 9,205,661 | B2 | 12/2015 | Kawate | |
| 9,248,656 | B2 | 2/2016 | Nozawa et al. | |
| 2002/0109760 | A1 | 8/2002 | Miyazawa et al. | |
| 2004/0239736 | A1 | 12/2004 | Miyazawa et al. | |
| 2005/0036015 | A1 | 2/2005 | Seino et al. | |
| 2005/0052511 | A1 | 3/2005 | Seino et al. | |
| 2013/0188209 | A1 | 7/2013 | Horikawa et al. | |
| 2015/0077483 | A1 * | 3/2015 | Nagashima ..... | B41J 2/1752 347/86 |
| 2015/0077486 | A1 | 3/2015 | Kodama et al. | |

FOREIGN PATENT DOCUMENTS

| | | | |
|---|---|---|---|
| JP | 2003-063038 | A | 3/2003 |
| JP | 2006-021348 | A | 1/2006 |
| JP | 2006-116786 | A | 5/2006 |
| JP | 2010-023458 | A | 2/2010 |
| JP | 2013-141808 | A | 7/2013 |

* cited by examiner

SCHEMATIC CROSS-SECTIONAL VIEW ALONG LINE F2-F2

CROSS-SECTIONAL VIEW ALONG LINE F21-F21

LIQUID SUPPLY UNIT

CROSS-REFERENCE TO RELATED APPLICATIONS

This application is a U.S. National Phase Application under 35 U.S.C. § 371 of International Application No. PCT/JP2016/084212, filed on Nov. 18, 2016, which claims the benefit of priority to JP Application No. 2015-256026, filed on Dec. 28, 2015, the entireties of which are incorporated herein by reference.

TECHNICAL FIELD

The present invention relates to a technology for a liquid supply unit.

BACKGROUND ART

There is known an ink cartridge that can be mounted onto a holder in a printer (for example, Patent Literature 1).

PRIOR ART DOCUMENTS

Patent Literature

[Patent Literature 1] JP 2013-248779 A
[Patent Literature 2] JP 2013-141808 A
[Patent Literature 3] JP 2003-63038 A
[Patent Literature 4] JP 2003-145798 A
[Patent Literature 5] JP 2013-146995 A

SUMMARY

Technical Problem

A conventional ink cartridge includes an ink supply port that can supply ink to a printer, and a lever that is provided on a side surface of the ink cartridge and that can engage with a concave portion of a holder.

With regard to this conventional ink cartridge, there have been demands to increase the reliability of mounting the ink cartridge onto the printer. Such a demand is not limited to an ink cartridge that can be mounted onto a printer and also applies to a liquid supply unit for other types of liquid ejection apparatus. Existing technology is also required to be smaller, achieve lower cost, use less resources, be easier to manufacture, and be easier to use.

Solution to Problem

The present invention has been made in order to at least partly solve the above-described problems and may be implemented as the following aspects or application examples.

(1) According to one aspect of the present invention, there is provided a liquid supply unit that can be mounted onto a liquid ejection apparatus including an apparatus-side terminal, a liquid introducing portion that protrudes outward from a mounting wall portion of the liquid ejection apparatus, and a guide member that protrudes outward from the mounting wall portion on the same side as a protruding direction of the liquid introducing portion. This liquid supply unit includes an outer shell; a contact portion that is disposed in the outer shell and can electronically connect to the apparatus-side terminal by making contact with the apparatus-side terminal; a liquid supply port that is disposed on the outer shell and used for inserting the liquid introducing portion; and a receiving portion that extends in a direction in which the guide member protrudes outward in a mounting state in which the liquid supply unit is mounted onto the liquid ejection apparatus, and that can receive the guide member, in which at least a part of the receiving portion is located between the liquid supply port and the contact portion in a predetermined direction orthogonal to a direction in which the receiving portion extends.

According to this aspect, because the liquid ejection apparatus includes the receiving portion that can receive the guide member between the liquid supply port and the contact portion, the liquid supply unit can easily be moved to the mounting position on the liquid ejection apparatus. In addition, because the receiving portion is located between the liquid supply port and the contact portion in a predetermined direction, the liquid supply port can easily be moved toward the liquid introducing portion and the contact portion can easily be moved toward the apparatus-side terminal. In this way, according to this aspect, the liquid supply unit can be mounted more reliably.

(2) In the above-described aspect, the receiving portion may include a unit-side restriction portion that engages with the guide member, to thereby restrict movement of the liquid supply unit toward a direction opposite to a mounting direction of mounting the liquid supply unit onto the liquid ejection apparatus.

According to this aspect, in the mounting state of the liquid supply unit, the liquid supply unit can be restricted from moving in a direction (demounting direction) opposite to the mounting direction. With this configuration, the possibility of the liquid supply unit coming away from the liquid ejection apparatus in the mounting state of the liquid supply unit can be reduced. In addition, in the predetermined direction, the liquid supply unit can be restricted from moving in the demounting direction at a position between the liquid supply port and the contact portion, and hence the possibility of the liquid supply port coming away from the liquid introducing portion and the possibility of the contact portion separating from the apparatus-side terminal can be reduced.

(3) In the above-described aspect, the liquid supply unit may further include an arrangement wall portion that is disposed in the outer shell and in which the contact portion is disposed, in which the liquid ejection apparatus may include a plurality of the apparatus-side terminals; the plurality of apparatus-side terminals may be configured to make contact with the corresponding contact portions while pushing the corresponding contact portions; the liquid supply unit may include a plurality of the contact portions; a first contact portion among the plurality of the contact portions may be arranged on the first wall surface of the arrangement wall portion; and a second contact portion among the plurality of the contact portions may be arranged on a second wall surface on a side opposite to the first wall surface.

According to this aspect, in the arrangement wall portion, the first contact portion and the second contact portion are arranged by being distributed between the first wall surface and the second wall surface, which are opposing surfaces. Therefore, compared to a configuration in which the first contact portion and the second contact portion are disposed on the same surface, the arrangement wall portion can be prevented from increasing in size. In addition, because the arrangement wall portion is pushed from either side by the plurality of apparatus-side terminals in the mounting state, the possibility of the arrangement wall portion becoming displaced can be reduced.

(4) In the above-described aspect, the liquid supply unit may further include a storage device disposed on the arrangement wall portion, in which the first wall surface may form a front surface of the arrangement wall portion that makes contact with the outside; the second wall surface may form a rear surface of the arrangement wall portion that makes contact with space inside the outer shell; and the second contact portion may be used to supply power to the storage device.

According to this aspect, the second contact portion used to supply power faces the space inside the outer shell. With this configuration, short-circuiting in a circuit provided with the second contact portion resulting from a liquid or impurities such as dust adhering thereto can be reduced.

(5) In the above-described aspect, the liquid supply unit may further include a biasing member that generates a force for moving the outer shell in a direction opposite to a mounting direction of mounting the liquid supply unit onto the liquid ejection apparatus in the mounting state.

According to this aspect, the force generated by the biasing member can be used to easily demount the liquid supply unit from the liquid ejection apparatus.

(6) In the above-described aspect, the liquid supply unit may further include a valve mechanism that is disposed inside the liquid supply port and used for opening/closing an internal flow path formed inside the liquid supply port, the valve mechanism including a valve seat formed with a valve hole; a valve element for opening/closing the valve hole; and the biasing member for biasing the valve element toward the valve seat.

According to this aspect, the biasing member in the valve mechanism can be made to have a function of generating a force for moving the outer shell in the demounting direction.

(7) In the above-described aspect, a length of the receiving portion may be at least half of a total length of the liquid supply unit in the mounting direction of mounting the liquid supply unit onto the liquid ejection apparatus.

According to this aspect, the liquid supply unit can be guided by the guide member in a period that is at least half the length of a period from the start to the end of the mounting operation of mounting the liquid supply unit onto the liquid ejection apparatus at the start of inserting the guide member into the receiving portion.

(8) In the above-described aspect, the outer shell may include a first wall portion on which the liquid supply port is disposed; a second wall portion that opposes the first wall portion; a third wall portion that intersects with the first wall portion and the second wall portion; and a fourth wall portion that intersects with the first wall portion and the second wall portion and opposes the third wall portion and the predetermined direction.

According to this aspect, the liquid supply unit including the first to fourth wall portions can be provided.

(9) In the above-described aspect, the receiving portion may form a through hole that extends from the first wall portion across to the second wall portion.

According to this aspect, because the receiving portion penetrates the outer shell from the first wall portion across to the second wall portion, the liquid supply unit can be even more easily moved to the mounting position on the liquid ejection apparatus.

For example, in one aspect of the present invention, the present invention may also be implemented as an apparatus including one or more of a plurality of elements such as the outer shell, the contact portion, the liquid supply unit and the receiving portion. In other words, this apparatus may or may not include the outer shell. In addition, this apparatus may or may not include the contact portion. In addition, this apparatus may or may not include the liquid supply port. Further, this apparatus may or may not include the receiving portion. These various aspects can solve at least one of a variety of problems such as making the apparatus smaller, reducing cost, saving resources, simplifying manufacturing and improving ease of use. The technical features of each of the aspects of the liquid supply unit described above may be partially or entirely applied to this apparatus.

The present invention can be implemented in the form of various aspects other than the liquid supply unit and may be implemented as a method of manufacturing a liquid supply unit, a liquid ejection system including a liquid supply unit and a liquid ejection apparatus, or the like.

DESCRIPTION OF EMBODIMENTS

A. First Embodiment

A-1: Configuration of Liquid Ejection System

Figure 1:
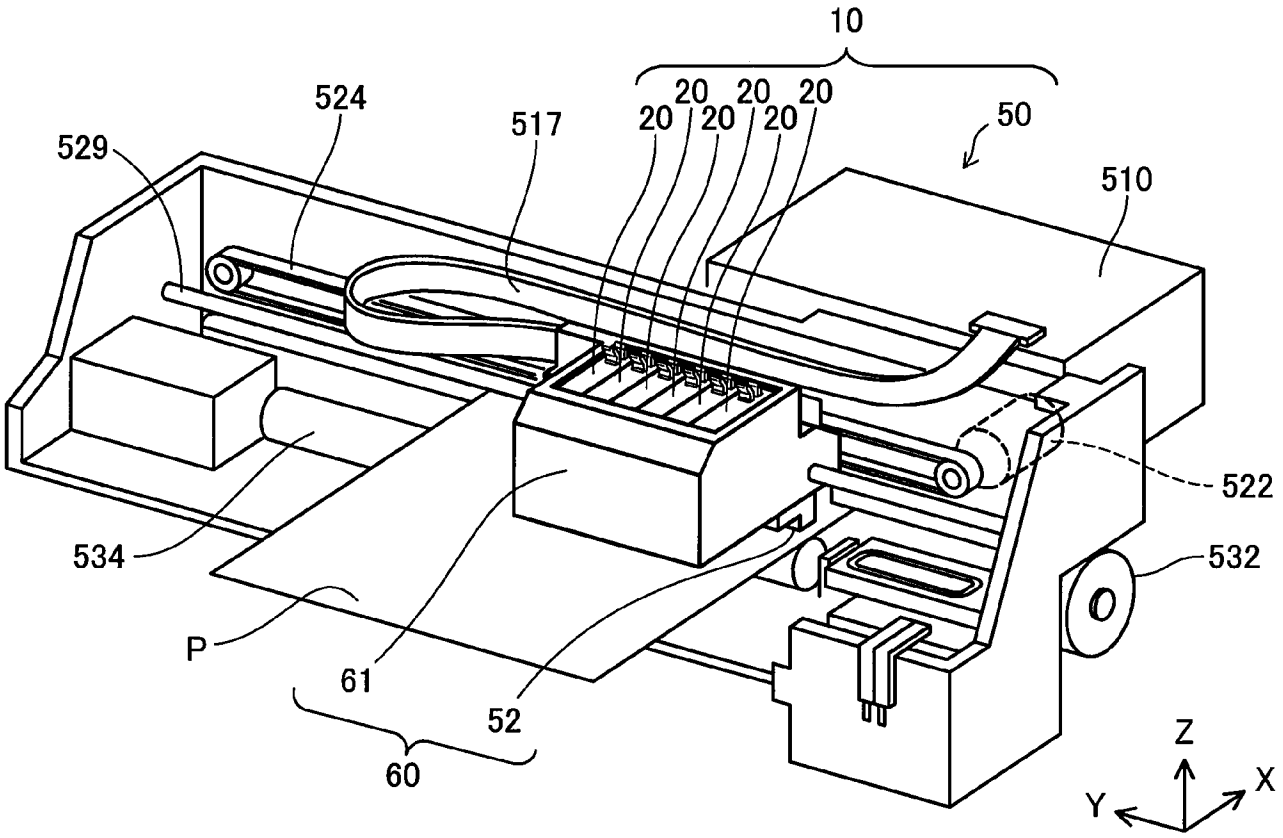
FIG. 1 is a perspective view for illustrating a configuration of a liquid ejection system as a first embodiment of the present invention.

FIG. 1 is a perspective view for illustrating the configuration of a liquid ejection system 10 according to a first embodiment of the present invention. FIG. 1 shows XYZ-axes that are all orthogonal to each other. The XYZ-axes are also shown as needed in other diagrams to follow. The XYZ-axes in FIG. 1 correspond to the XYZ-axes in other diagrams. The liquid ejection system 10 includes a cartridge 20 as a liquid supply unit and a printer 50 as a liquid ejection apparatus. The printer 50 includes a carriage unit 60. The carriage unit 60 includes a holder unit 61 onto which the cartridge 20 can be mounted and a head unit 52 that can eject ink to the outside. A mounting direction in which the cartridge 20 is mounted onto the printer 50 is a negative Z-axis direction. A demounting direction in which the cartridge 20 is demounted from the printer 50 is a positive Z-axis direction.

The cartridge 20 stores ink therein. The ink stored in the cartridge 20 is supplied to the head unit 52 by flowing through a liquid injecting portion provided in the holder unit 61 to be described later. In this embodiment, a plurality of the cartridges 20 is removably mounted onto the holder unit 61 of the printer 50. In this embodiment, a total of six different types of cartridges 20 that each correspond to six different colors (black, yellow, magenta, light magenta, cyan and light cyan) are mounted onto the holder unit 61. The number of cartridges 20 to be mounted onto the holder unit 61 is not limited to six.

The printer 50 distributes the ink to the head unit 52 via the liquid introducing portion to be described later by in-taking the ink stored in the cartridge 20 mounted onto the holder unit 61. The head unit 52 has a discharge mechanism such as a piezoelectric element to discharge (supply) the ink to a printing medium P such as paper or a label. With this configuration, data such as characters, shapes and images are printed onto the printing medium P.

A control unit 510 provided in the printer 50 controls each unit of the printer 50. The carriage unit 60 in the printer 50 is configured to move the head unit 52 relative to the printing medium P. The control unit 510 and the carriage unit 60 are electronically connected to one another via a flexible cable 517. The discharge mechanism of the head unit 52 performs a discharge operation on the basis of a control signal transmitted from the control unit 510.

In this embodiment, the carriage unit 60 includes the holder unit 61 in addition to the head unit 52. In this way, the type of printer 50, in which the cartridge 20 is mounted onto the holder unit 61 on the carriage unit 60 that moves the head unit 52, is a type that is also referred to as an "on-carriage printer". In other embodiments, the printer 50 may include a stationary holder unit 61 at a place different to the carriage unit 60 and supply the ink from the cartridge 20 mounted onto the holder unit 61 to the head unit 52 via a tube. This type of printer is also referred to as an "off-carriage printer."

The printer 50 further includes a main scanning feed mechanism and a sub-scanning feed mechanism that move the carriage unit 60 and the printing medium P relative to each other to print on the printing medium P. The main scanning feed mechanism of the printer 50 includes a carriage motor 522, a drive belt 524 and a transfer rod 529. The transfer rod 529 has a thin rod-shaped external shape and is arranged parallel to a main scanning direction. The transfer rod 529 moveably supports the carriage unit 60 along the main scanning direction. Energy of the carriage motor 522 is transmitted to the carriage unit 60 via the drive belt 524, to thereby move the carriage unit 60 supported by the transfer rod 529 back and forth in the main scanning direction. The sub-scanning feed mechanism of the printer 50 includes a transfer motor 532 and a platen 534. Energy of the transfer motor 532 is transmitted to the platen 534, to thereby transfer the printing medium P in a sub-scanning direction orthogonal to the main scanning direction.

In this embodiment, in a usage state (also referred to as "usage orientation") of the liquid ejection system 10, an axis along the sub-scanning direction (front-back direction) in which the printing medium P is transferred is an X-axis, an axis along the main scanning direction (left-right direction) in which the carriage unit 60 is moved back and forth is a Y-axis, and an axis along a gravity direction (up-down direction) is a Z-axis. The usage state of the liquid ejection system 10 is a state in which the liquid ejection system 10 is installed on a horizontal plane. In this embodiment, the horizontal plane is a plane (XY-plane) parallel to both the X-axis and the Y-axis.

In this embodiment, the sub-scanning direction (front direction) is a negative X-axis direction, a direction opposite to that direction (back direction) is a positive X-axis direction, a direction (up direction) down to up in the gravity direction is a positive Z-axis direction, and a direction opposite to that direction (down direction) is a negative Z-axis direction. In this embodiment, a direction from the right-side surface to the left-side surface of the liquid ejection system 10 is a positive Y-axis direction (left direction), and a direction opposite to that direction is a negative Y-axis direction (right direction). In this embodiment, the arrangement direction of the plurality of cartridges 20 mounted onto the holder unit 61 is a direction (left-right direction, also simply referred to as "Y-axis direction") along the Y-axis. The direction (front-back direction) along the X-axis is also referred to as "X-axis direction," and a direction (up-down direction) along the Z-axis is also referred to as "Z-axis direction."

A-2. Configuration of Carriage Unit 60

Figure 2:
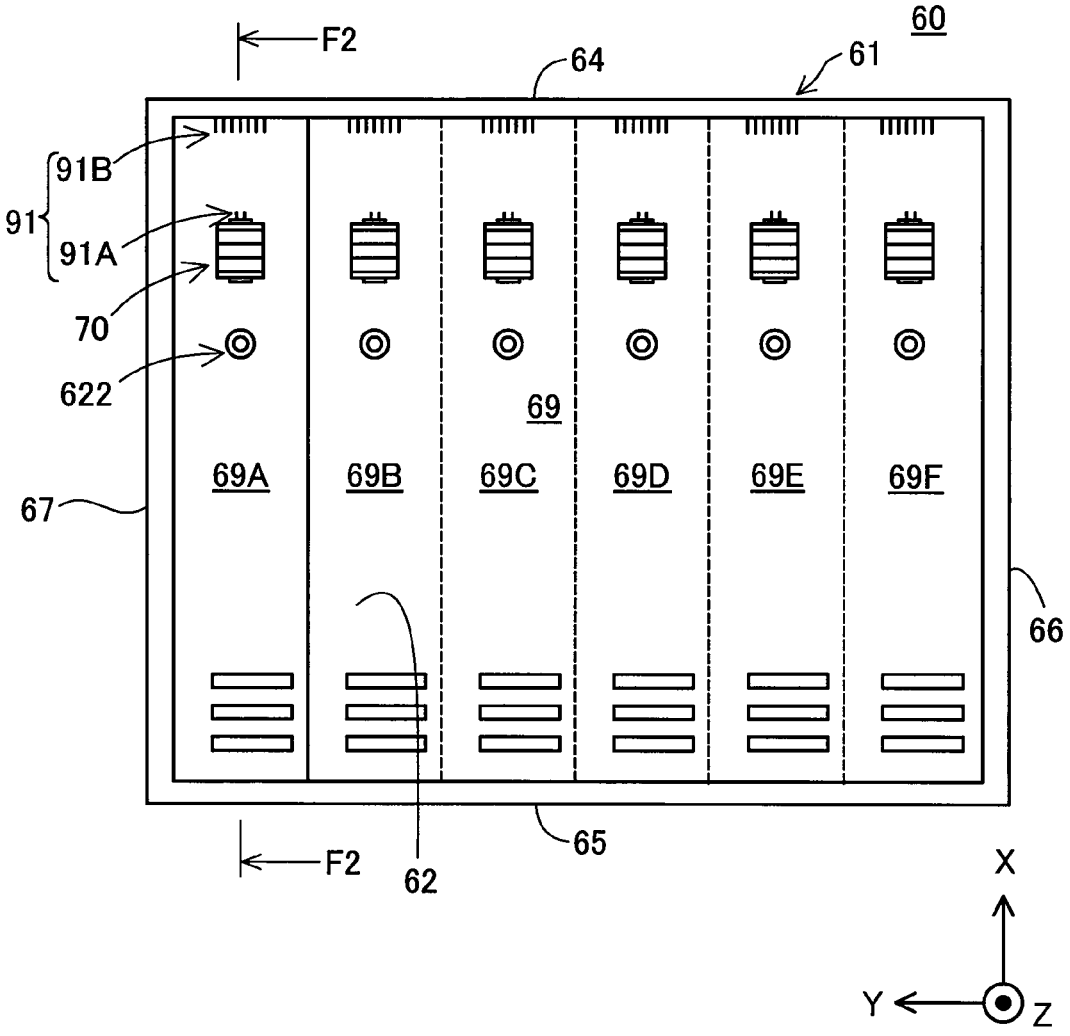
FIG. 2 is a schematic top view for illustrating a carriage unit.
Figure 3:
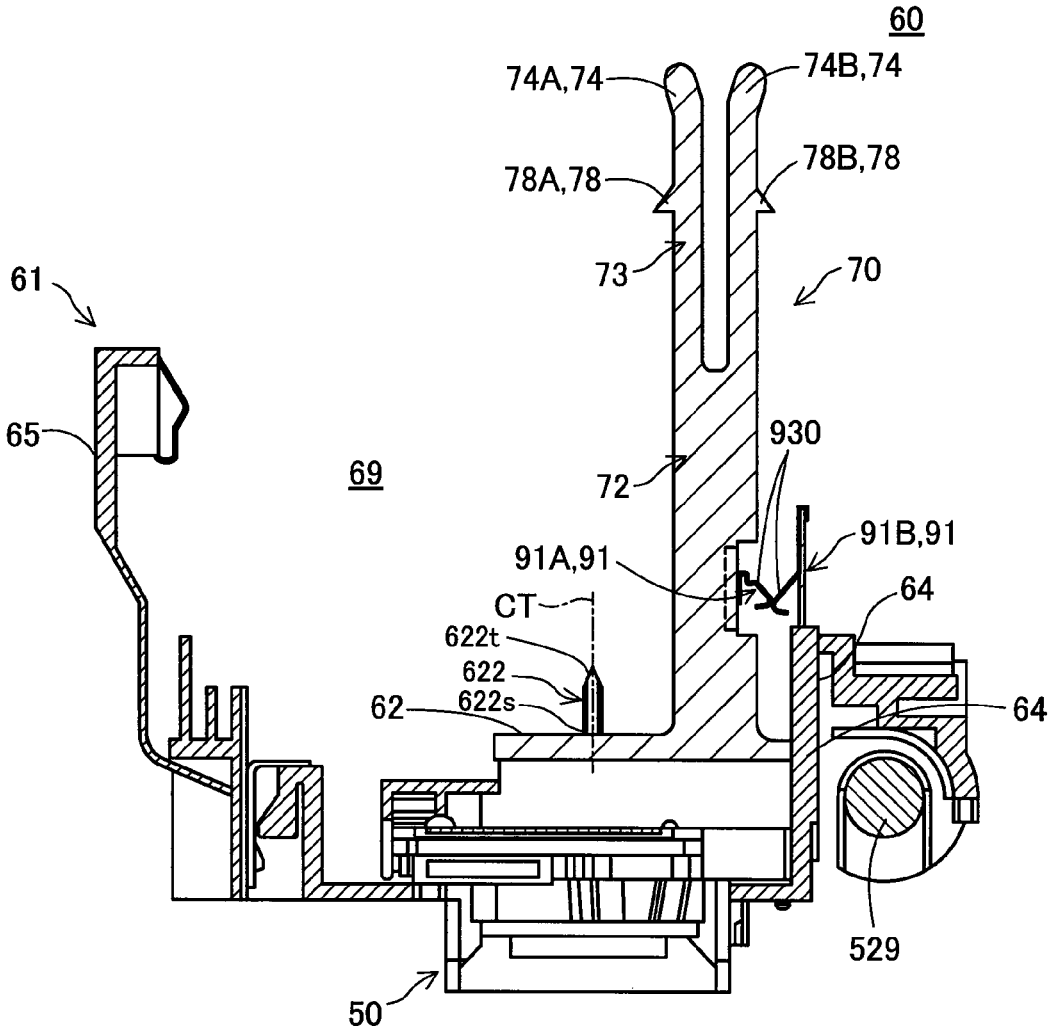
FIG. 3 is a schematic cross-sectional view along the line F2-F2 in FIG. 2.
Figure 3:
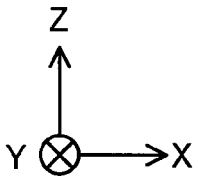

FIG. 2 is a schematic top view for illustrating the carriage unit 60. FIG. 3 is a schematic cross-sectional view along the line F2-F2 in FIG. 2. The holder unit 61 (FIGS. 2 and 3)

includes five wall portions 62, 64, 65, 66 and 67. The wall portion 62 as a mounting wall portion is also referred to as "apparatus front wall portion 62," the wall portion 64 is also referred to as "first side wall portion 64," the wall portion 65 is also referred to as "second side wall portion 65," the wall portion 66 is also referred to as "third side wall portion 66," and the wall portion 67 is also referred to as "fourth side wall portion 67." These five wall portions 62, 64, 65, 66 and 67 are, for example, molded of a synthetic resin.

The apparatus front wall portion 62 forms a bottom wall of the holder unit 61. The apparatus front wall portion 62 is located on a mounting direction side.

The four wall portions 64, 65, 66 and 67 extend from a peripheral edge position of the apparatus front wall portion 62 in the positive Z-axis direction (demounting direction). The five wall portions 62, 64, 65, 66 and 67 form a concave portion. This concave portion forms a cartridge storage chamber 69 (also referred to as "cartridge mounting portion 69") that houses the cartridges 20. The cartridge storage chamber 69 includes a plurality of slots (mounting spaces) 69A to 69F that can each receive one of the cartridges 20. The plurality of slots 69A to 69F may be defined by, for example, providing plate-shaped partition walls on the apparatus front wall portion 62.

The first side wall portion 64 and the second side wall portion 65 oppose each other in the X-axis direction. The third side wall portion 66 and the fourth side wall portion 67 oppose each other in the Y-axis direction. In the holder unit 61 according to this embodiment, the Z-axis direction is a height direction, the X-axis direction is a length direction, and the Y-axis direction is a width direction.

The holder unit 61 includes a liquid injecting needle 622 as a liquid injecting portion, a guide member 70 and an electrode unit 91 for each slot 69A to 69F.

The liquid injecting needle 622 (FIG. 3) is disposed on the apparatus front wall portion 62. The liquid injecting needle 622 protrudes from the apparatus front wall portion 62 in the positive Z-axis direction. A flow path through which the ink can flow is formed inside the liquid injecting needle 622. The liquid injecting needle 622 is connected to the cartridge 20 (more specifically, a liquid supply port to be described later) to distribute the ink from the cartridge 20. The liquid injecting needle 622 includes a base portion 622*s* located on the apparatus front wall portion 62 side and a tip portion 622*t* located on a side opposite to the base portion 622*s*. The liquid injecting needle 622 according to this embodiment has a lateral cross section that is substantially circular and a central axis CT that extends in the mounting direction (negative Z-axis direction) of the cartridge 20. A direction extending from the base portion 622*s* to the tip portion 622*t* is a positive Z-axis direction, and a direction extending from the tip portion 622*t* to the base portion 622*s* is a negative Z-axis direction. The liquid injecting needle 622 communicates with the head unit 52.

In the process of mounting, the guide member 70 guides the cartridge 20 to a mounting position of the holder unit 61. The guide member 70 (FIG. 3) protrudes outward from the apparatus front wall portion 62 on the same side (positive Z-axis direction side) as the protruding direction of the liquid injecting needle 622. In this embodiment, the direction in which the guide member 70 protrudes outward is the same direction as the protruding direction (positive Z-axis direction) of the liquid injecting needle 622. In this embodiment, both the liquid injecting needle 622 and the guide member 70 extend from the apparatus front wall portion 62 in a gravity upward direction. The guide member 70 may be, for example, molded integrally with the apparatus front wall portion 62 of a synthetic resin, or may be molded as a member separate to the apparatus front wall portion 62. In addition, the protruding directions of the liquid injecting needle 622 and the guide member 70 do not need to be the same, and the protruding direction of the guide member 70 may be inclined with respect to the protruding direction of the liquid injecting needle 622.

The guide member 70 includes a body portion 72, an elastically deforming portion 73 and an apparatus-side restriction portion 78. The body portion 72 is a columnar member that extends from the apparatus front wall portion 62. The elastically deforming portion 73 is a columnar member connected to a demounting direction side end (positive Z-axis direction side end) of the body portion 72. The elastically deforming portion 73 is used for mounting/demounting the cartridge 20 onto/from the holder unit 61. Two apparatus-side restriction portions 78A and 78B are provided on a side surface of the elastically deforming portion 73. The two apparatus-side restriction portions 78A and 78B are protrusions that protrude outward from the side surface (side surface that faces the X-axis direction) of the elastically deforming portion 73. The two apparatus-side restriction portions 78A and 78B engage with the cartridge 20 in the mounting state of the cartridge 20. As a result of this engagement, the cartridge 20 is restricted from moving in the demounting direction. End portions 74A and 74B located on side opposite to a side of the elastically deforming portion 73 on which the main body 72 is located function as operation units used to release engagement between the apparatus-side restriction portions 78A and 78B the cartridge 20. The user applies a force in a direction approaching the two end portions 74A and 74B that separate from each other in the X-axis direction, to thereby elastically deform the elastically deforming portion 73. This elastic deformation causes the apparatus-side restriction portions 78A and 78B to displace in a direction (release direction) in which engagement between the two apparatus-side restriction portions 78A and 78B and the cartridge 20 releases. The reference symbol "78" is used when the two apparatus-side restriction portions 78A and 78B are used indistinguishably. One of the two apparatus-side restriction portions 78A and 78B may be omitted. The reference symbol "74" is used when the two end portions 74A and 74B are used indistinguishably.

The length (dimensions in Z-axis direction) in which the guide member 70 protrudes outward from the apparatus front wall portion 62 is preferably larger than dimensions of the liquid injecting needle 622 in the Z-axis direction, more preferably larger than dimensions of the first to fourth side wall portions 64 to 67 in the Z-axis direction. As a result, because the user can more easily visually recognize the guide member 70, the user can easily mount the cartridge 20 onto the holder unit 61 with the guide member 70 as a target.

The guide member 70 preferably includes a portion that protrudes outward toward the demounting direction side (+Z-axis direction side) of the cartridge storage chamber 69. With this configuration, when one of the plurality of cartridges 20 arranged adjacent to one another is demounted and a new cartridge 20 is mounted onto the holder unit 61, the user can easily visually recognize the guide member 70 corresponding to the cartridge 20 to be mounted. As a result, because the guide member 70 can be used as a target when mounting the cartridge 20, the user can even more easily mount the cartridge 20 onto the holder unit 61.

In the mounting state of the cartridge 20, the electrode unit 91 is electronically connected to a circuit board of the cartridge 20. The electrode unit 91 includes an inner electrode unit 91A and an outer electrode unit 91B. The inner electrode unit 91A is disposed in the body portion 72. The outer electrode unit 91B is disposed on the first side wall portion 64. Each of the inner electrode unit 91A and the outer electrode unit 91B include a plurality of apparatus-side terminals 930. In the mounting state of the cartridge 20, the plurality of apparatus-side terminals 930 makes contact with the cartridges 20 (more specifically, contact portions to be described later), to thereby electronically connect with contact portions of the cartridges 20. The plurality of apparatus-side terminals 930 is also electronically connected to the control unit 510 (FIG. 1). A detailed configuration of the electrode unit 91 is described later.

The liquid injecting needle 622, the guide member 70 and the electrode unit 91 have the following positional relationship. The liquid injecting needle 622 and the electrode unit 91 (more specifically, the apparatus-side terminal 930) are arranged so as to sandwich the guide member 70 in a predetermined direction (X-axis direction). Further, the liquid injecting needle 622, the guide member 70 and the electrode unit 91 are arranged at a position closer to the first side wall portion 64 than the second side wall portion 65 in a predetermined direction (X-axis direction). The predetermined direction is a direction orthogonal to a direction in which the receiving portion 292 extends and is a direction in which the first side wall portion 64 and the second side wall portion 65 oppose each other. The liquid injecting needle 622, the guide member 70 and the electrode unit 91 are arranged so as to be biased toward on one wall portion side among the first side wall portion 64 and the second side wall portion 65 (in this embodiment, the first side wall portion 64).

Figure 4:
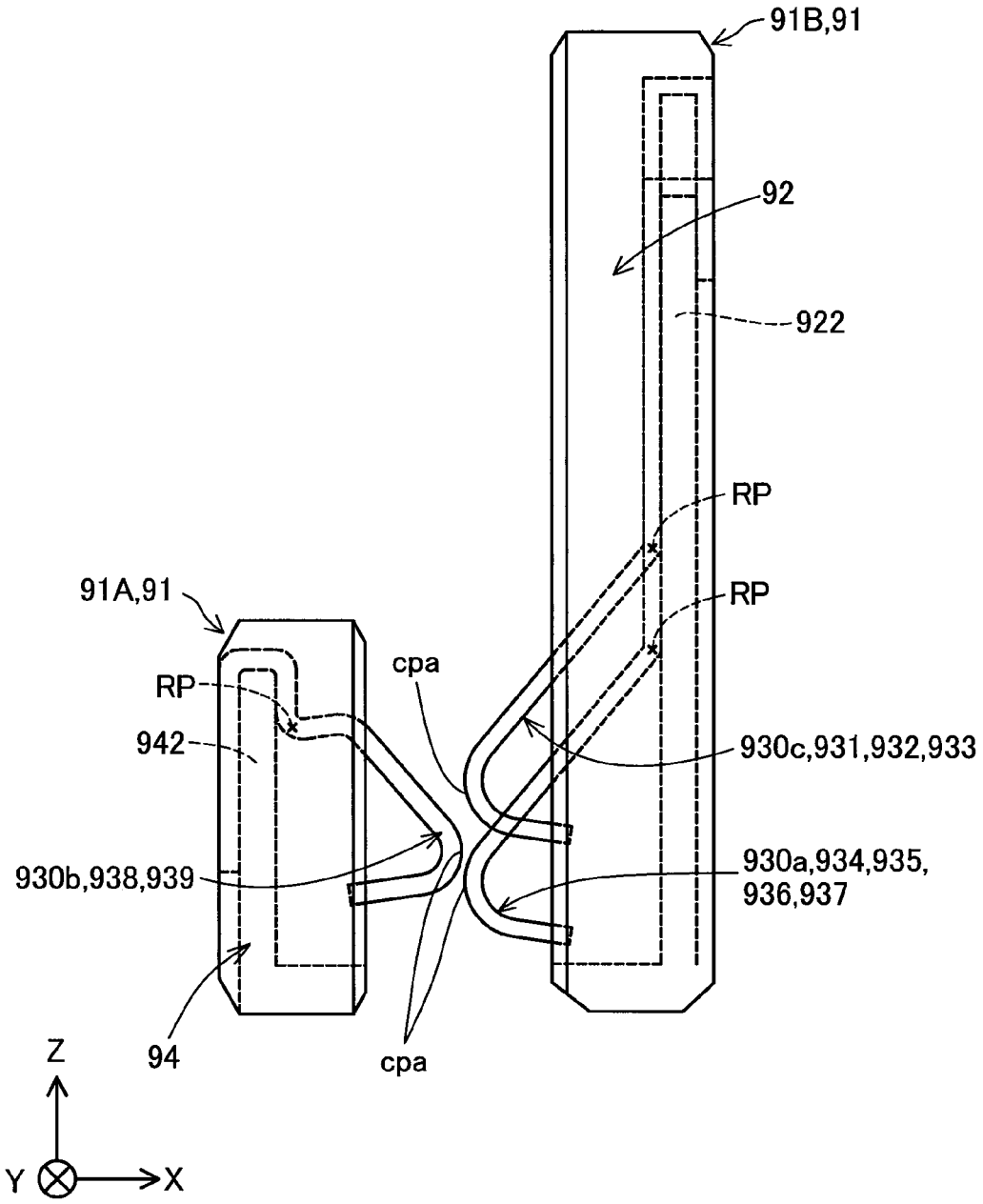
FIG. 4 is a diagram for explaining an electrode unit.
Figure 5:
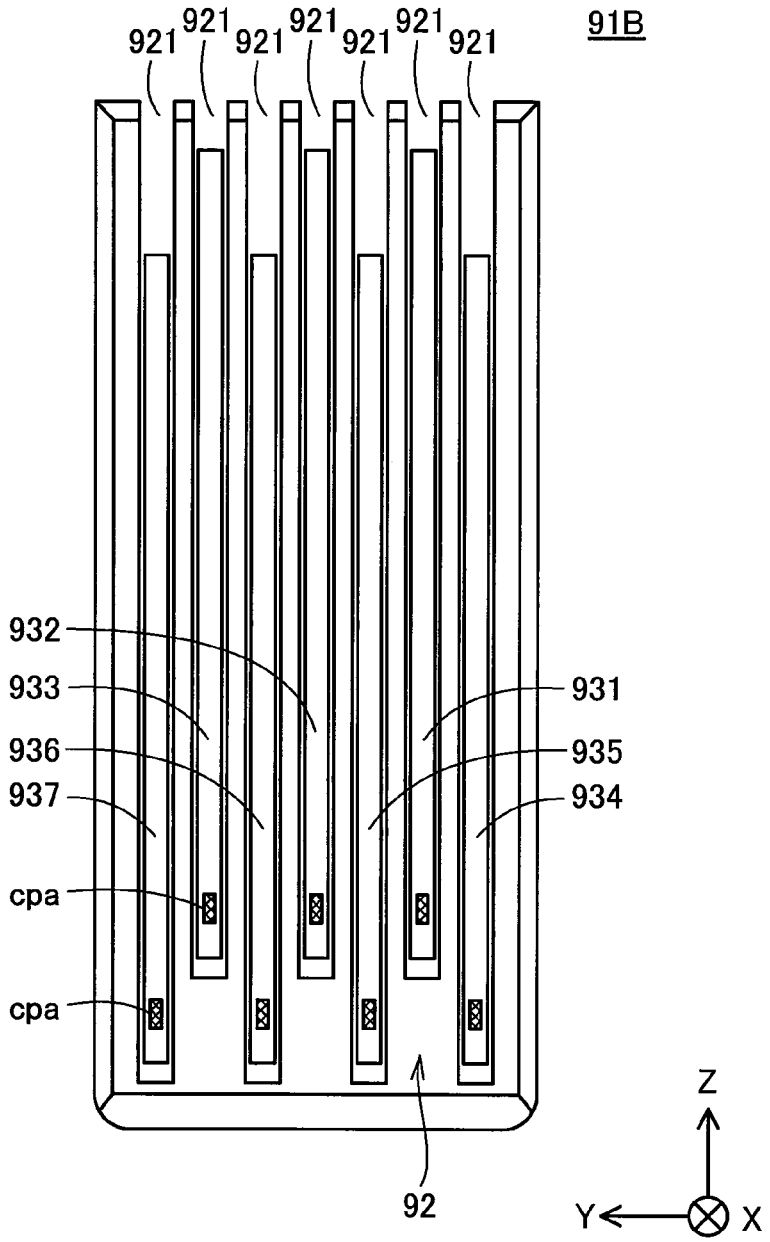
FIG. 5 is a diagram for explaining an outer electrode unit.
Figure 6:
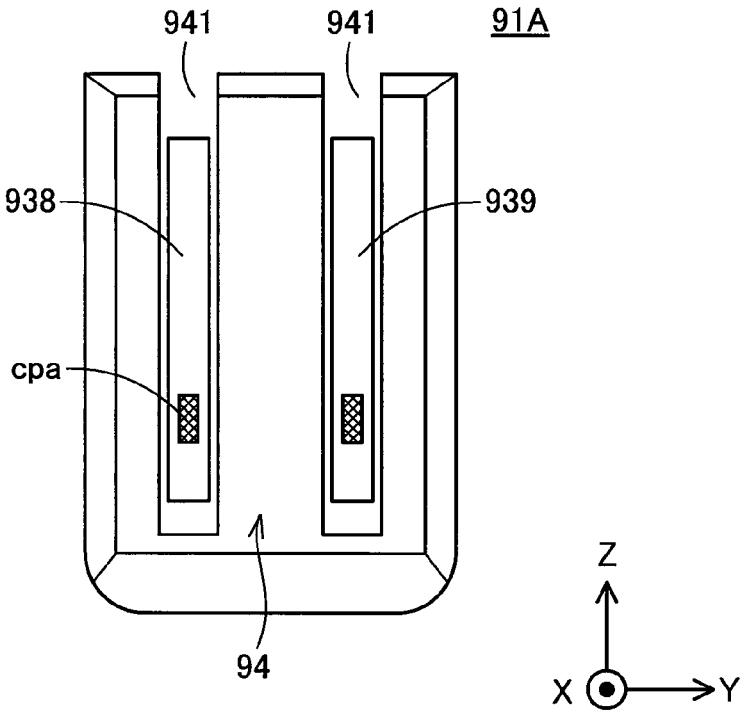
FIG. 6 is a diagram for explaining an inner electrode unit.

FIG. 4 is a diagram for explaining the electrode unit 91. FIG. 5 is a diagram for explaining the outer electrode unit 91B. FIG. 6 is a diagram for explaining the inner electrode unit 91A.

The inner electrode unit 91A (FIG. 4) includes an inner electrode holder 94, and two apparatus-side terminals 938 and 939. The outer electrode unit 91B (FIG. 4) includes an outer electrode holder 92, and seven apparatus-side terminals 931 to 937. The reference symbol "930" is used when these nine apparatus-side terminals 931 to 939 are used indistinguishably.

The inner electrode holder 94 is attached to the main body 72 (FIG. 3). The inner electrode holder 94 (FIG. 6) includes two slits 941 that extend in the Z-axis direction. A support stand 942 (FIG. 4) is provided in each slit 941. A corresponding apparatus-side terminal 938, 939 is fitted into the support stand 942, to thereby hold the apparatus-side terminal 938, 939 with the inner electrode holder 94.

As illustrated in FIG. 4, a part of the apparatus-side terminal 938, 939 protrudes outward from a surface of the inner electrode holder 94. As illustrated in FIG. 6, the portion (protruding portion) of the apparatus-side terminal 938, 939 that protrudes outward from the surface of the inner electrode holder 94 forms a contact portion cpa that makes contact with a cartridge-side terminal of the cartridge 20. The two contact portions cpa formed by the apparatus-side terminals 938 and 939 are arranged side by side in the Y-axis direction. The apparatus-side terminals 938 and 939 are conductive members (for example, metal members). The protruding portions of the two apparatus-side terminals 938 and 939 are configured to elastically deform in at least the X-axis direction with a bent portion RP (FIG. 4) as a fulcrum. The bent portion RP is a portion at which the apparatus-side terminal 938, 939 separates from the support stand 942.

The outer electrode holder 92 is attached to the first side wall portion 64 (FIG. 3). The outer electrode holder 92 (FIG. 5) includes seven slits 921 that extend in the Z-axis direction. Each slit 921 is provided with one support stand 922 (FIG. 4). A corresponding apparatus-side terminal 931 to 937 is fitted into the support stand 922, to thereby hold the apparatus-side terminal 931 to 937 with the outer electrode holder 92.

As illustrated in FIG. 4, one part of the apparatus-side terminal 931 to 937 protrudes outward from a surface of the outer electrode holder 92. More specifically, the part of the apparatus-side terminal 931 to 937 protrudes outward toward a side on which the protruding portion of the apparatus-side terminal 938, 939 is located. As illustrated in FIG. 5, the portion (protruding portion) of the apparatus-side terminal 931 to 937 that protrudes outward from the surface of the outer electrode holder 92 forms the contact portion cpa that makes contact with the cartridge-side terminal of the cartridge 20. The contact portions cpa of the three apparatus-side terminals 931 to 933 are arranged side by side in the Y-axis direction. The contact portions cpa of the four apparatus-side terminals 934 to 937 are arranged side by side in the Y-axis direction. The contact portions cpa of the three apparatus-side terminals 931 to 933 and the contact portions cpa of the four apparatus-side terminals 934 to 937 are arranged different positions in the Z-axis direction. In the Z-axis direction, the contact portions cpa of the two apparatus-side terminals 938 and 939 are arranged between (FIG. 4) the contact portions cpa of the three apparatus-side terminals 931 to 933 and the contact portions cpa of the four apparatus-side terminals 934 to 937 (FIG. 5). Herein, the four apparatus-side terminals 934 to 937 are also be collectively referred to as "first apparatus-side terminal group 930*a*," the two apparatus-side terminals 938 and 939 are also be collectively referred to as "second apparatus-side terminal group 930*b*," and the three apparatus-side terminals 931 to 933 are also be collectively referred to as "third apparatus-side terminal group 930*c*" (FIG. 4).

A-3. Configuration of Cartridge 20

Figure 7:
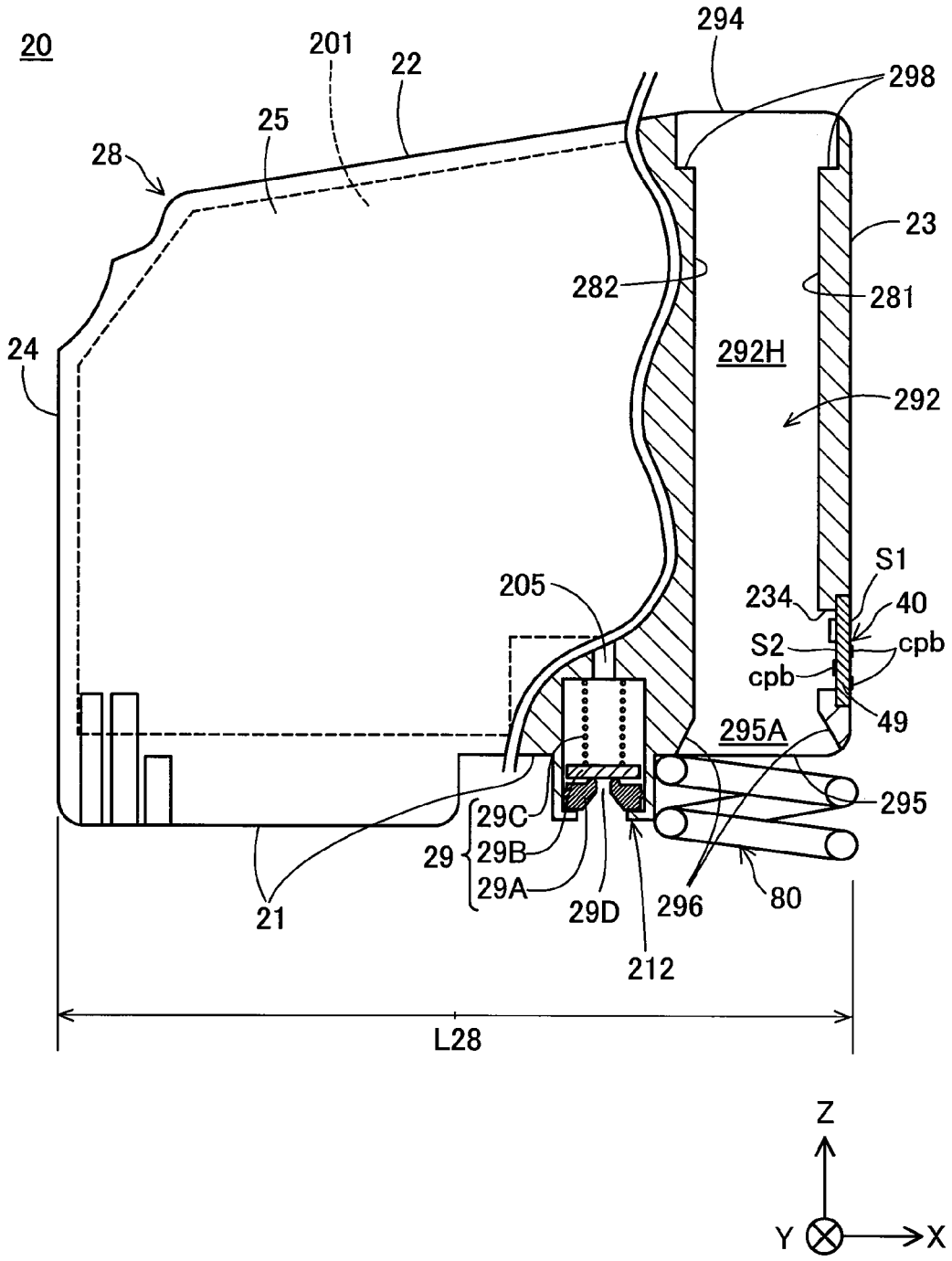
FIG. 7 is a partially broken sectional view for illustrating the cartridge.
Figure 8:
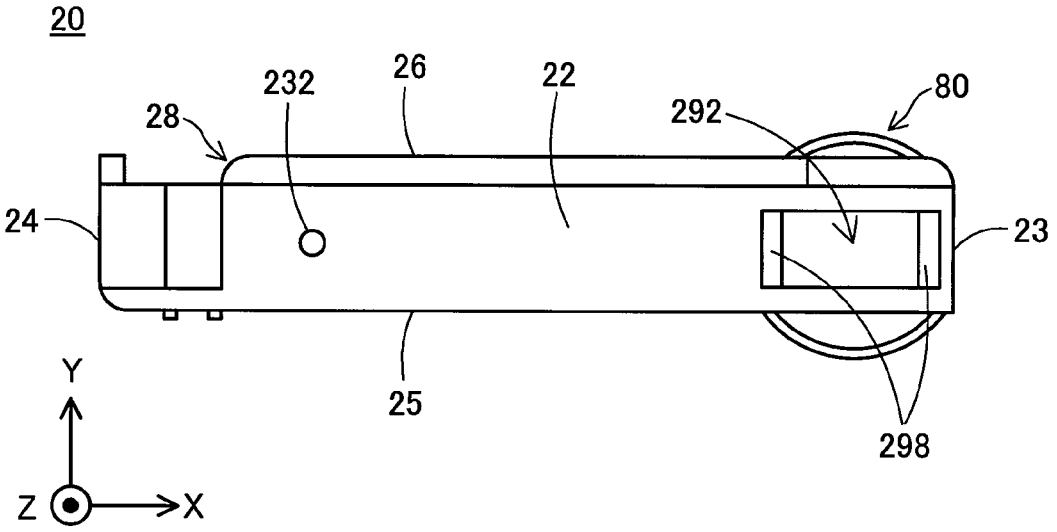
FIG. 8 is a top view for illustrating the cartridge.
Figure 9:
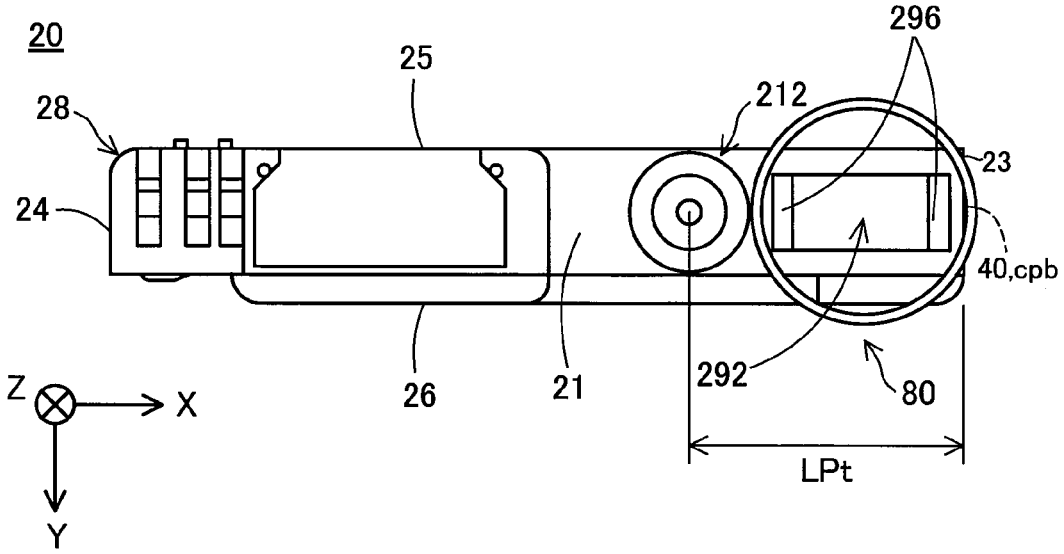
FIG. 9 is a bottom view for illustrating the cartridge.
Figure 10:
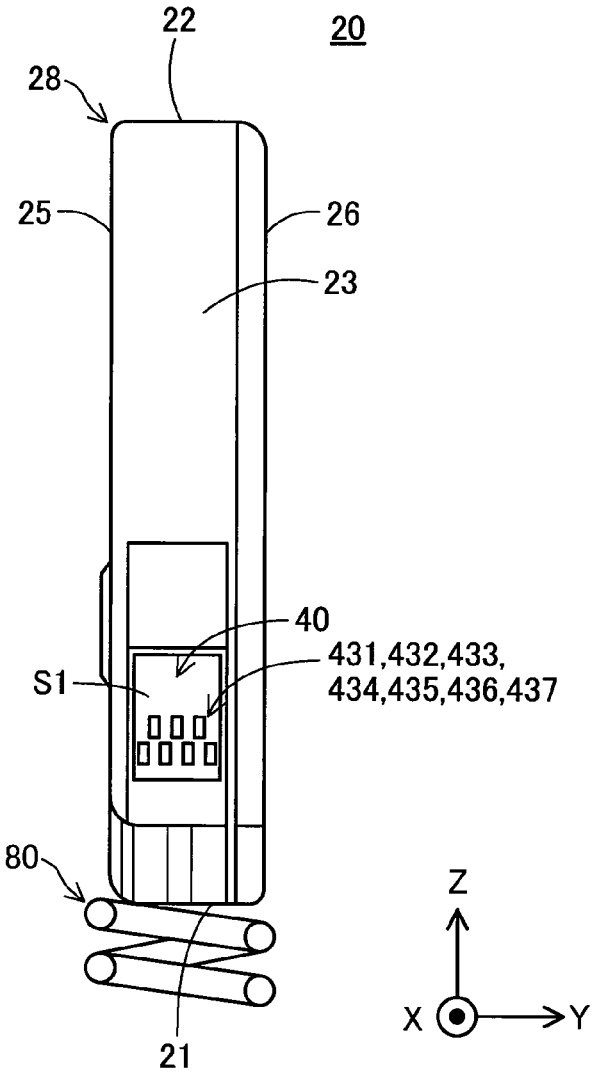
FIG. 10 is a rear view for illustrating the cartridge.

FIG. 7 is a partially broken sectional view for illustrating the cartridge 20. FIG. 8 is a top view for illustrating the cartridge 20. FIG. 9 is a bottom view for illustrating the cartridge 20. FIGS. 7 to 10 show XYZ-axes in the mounting state of the cartridge 20. The XYZ-axes in the mounting state are also shown in figures to follow as necessary.

The cartridge 20 (FIG. 7) includes an outer shell 28, a liquid storage portion 201, a liquid supply port 212, the circuit board 40, the receiving portion 292 and a biasing member 80.

The outer shell 28 forms an outer surface of the cartridge 20. The outer shell 28 is the body of the cartridge 20 and divides the space therein that includes the liquid storage portion 201 into sections. The outer shell 28 is made of a synthetic resin such as polypropylene (PP). The outer shell 28 has a substantially quadrangular cylindrical shape or a substantially cuboid shape. The outer shell 28 may be partly made of a resin film.

The outer shell 28 includes a first wall portion 21, a second wall portion 22, a third wall portion 23, a fourth wall portion 24, a fifth wall portion 25 and a sixth wall portion 26. The outer shape of the first to sixth wall portions 21 to 26 in plan are all substantially rectangular. The phrase "substantially rectangular" does not only mean that the outer shape is completely rectangular, and also includes a case in which the shape is partly uneven and a case in which a rectangular corner portion of the shape has a rounded shape or a chamfered shape. The third to sixth wall portions 23 to 26 are substantially flat. The phrase "substantially flat" includes both a case in which the entire surface is completely flat and a case in which the surface is partly uneven. In other words, this includes a case in which, even if the surface is partly uneven, the surface can be recognized as a surface or a wall that forms the outer shell 28 of the cartridge 20. A step is formed partway down the first wall portion 21. An outer surface of the first wall portion 21 may be a substantially flat surface similar to that of the other wall portions 22 to 26. An outer surface of the second wall portion 22 has an inclined side that is connected to the fourth wall portion 24.

The first wall portion 21 forms a bottom surface in the mounting state of the cartridge 20. The first wall portion 21 faces the apparatus front wall portion 62 (FIG. 3) in the mounting state of the cartridge 20. In other words, the first wall portion 21 is oriented toward the apparatus front wall portion 62 in the mounting state of the cartridge 20. The first wall portion 21 can also be regarded as a portion located on the mounting direction side (negative Z-axis direction side) of the outer shell 28.

The second wall portion 22 forms an upper surface in the mounting state. The second wall portion 22 opposes the first wall portion 21. The second wall portion 22 is located on the side of the demounting direction (positive Z-axis direction side) opposite to the mounting direction. The second wall portion 22 is a portion that faces a direction including a demounting direction (positive Z-axis direction) component. Herein, "a case in which two elements oppose each other" includes both a case in which another element is located between the two elements and a case in which no other element is located between the two elements. An air induction port 232 (FIG. 8) is formed in the second wall portion 22. The air induction port 232 introduces air to the liquid storage portion 201 in accordance with consumption of the ink in the liquid storage portion 201. In addition, the second wall portion 22 or another component of the cartridge 20 may be provided with a liquid inlet for injecting the ink into the liquid storage portion 201.

The third wall portion 23 forms a back surface in the mounting state of the cartridge 20. The third wall portion 23 intersects with the first wall portion 21 and the second wall portion 22. An outer surface of the third wall portion 23 is a surface (YZ-plane) parallel to both the Y-axis direction and the Z-axis direction and perpendicular to the X-axis direction. Herein, when two elements (for example, wall portions or surfaces) "intersect with each other," this refers to any one of the following states. That is, a state in which the two elements actually intersect with each other, a state in which one element is extended and intersects with the other element, and a state in which both elements are extended and intersect with each other.

The fourth wall portion 24 forms a front surface in the mounting state of the cartridge 20. The fourth wall portion 24 intersects with the first wall portion 21 and the second wall portion 22. The fourth wall portion 24 opposes the third wall portion 23. An outer surface of the fourth wall portion 24 is a surface (YZ plane) parallel to both the Y-axis direction and the Z-axis direction and perpendicular to the X-axis direction. A direction orthogonal to a direction (Z-axis direction) in which the receiving portion 292 (to be described later) extends and in which the third wall portion 23 and the fourth wall portion 24 oppose each other corresponds to the "predetermined direction" cited in the section "SOLUTION TO PROBLEM."

The fifth wall portion 25 (FIG. 8) forms a right-side surface in the mounting state. The sixth wall portion 26 forms a left side surface in the mounting state. The fifth wall portion 25 and the sixth wall portion 26 oppose each other. The fifth wall portion 25 and the sixth wall portion 26 each intersect with the first to fourth wall portions 21 to 24. Outer surfaces of the fifth wall portion 25 and the sixth wall portion 26 are surfaces (XZ-plane) parallel to both the X-axis direction and the Z-axis direction and perpendicular to the Y-axis direction.

In the outer shell 28, the dimensions of a direction (Y-axis direction) in which the fifth wall portion 25 and the sixth wall portion 26 oppose each other are smaller than the dimensions of a direction (Z-axis direction) in which the first wall portion 21 and the second wall portion 22 oppose each other and the dimensions of a direction (X-axis direction) in which the third wall portion 23 and the fourth wall portion 24 oppose each other. In other words, the distance between the third wall portion 23 and the fourth wall portion 24 is longer than the distance between the fifth wall portion 25 and the sixth wall portion.

The liquid storage portion 201 (FIG. 7) stores ink to be supplied to the head unit 52. The liquid storage portion 201 is formed inside the outer shell 28.

The liquid supply port 212 can supply the ink stored in the liquid storage portion 201 to the printer 50. The liquid supply port 212 communicates with the liquid storage portion 201 via a communication hole 205 formed in the first wall portion 21. The liquid supply port 212 is disposed on the first wall portion 21. The liquid supply port 212 is a tubular member that protrudes outward from the first wall portion 21 in the mounting direction. A tip of the liquid supply port 212 is open. The liquid supply port 212 distributes the ink stored in the liquid storage portion 201 to the outside (for example, the liquid injecting needle 622) via the tip opening. In the mounting state of the cartridge 20, the liquid supply port 212 is connected to the liquid injecting needle 622 by inserting the liquid injecting needle 622 into the tubular liquid supply port 212. With this connection, it is possible to distribute the ink to the liquid injecting needle 622 from the liquid supply port 212.

A valve mechanism 29 for opening and closing an internal flow path formed inside the liquid supply port 212 is disposed inside the liquid supply port 212 (FIG. 7). The valve mechanism 29 includes a valve seat 29A, a valve element 29B and a biasing member 29C in order from the tip of the liquid supply port 212. The valve seat 29A is a substantially annular member and includes a valve hole 29D. The valve seat 29A is configured of an elastic body such as rubber or an elastomer. The valve seat 29A is press-fitted inside a liquid supply port 212. The valve element 29B is a substantially columnar member. The valve element 29B opens and closes the valve hole 29D by coming into contact with the valve seat 29A and separating from the valve seat 29A. In a state before the cartridge 20 is mounted onto the holder unit 61 (pre-mounting state), the valve element 29B comes into contact with the valve seat 29A, to thereby cover the valve hole 29D. The biasing member 29C is a compression coil spring. The biasing member 29C biases the valve element 29B toward the valve seat 29A. In the mounting state of the cartridge 20, the liquid injecting needle 622 (FIG. 3) presses the valve member 29B toward a direction away from the valve seat 29A, to thereby separate the valve element 29B from the valve seat 29A. With this configuration, the valve mechanism 29 opens.

The circuit board 40 (FIG. 7) includes a plate-shaped arrangement wall portion 49. A plurality of terminals is arranged on a first wall surface S1 and a second wall surface S2 of the arrangement wall portion 49. The circuit board 40 is fitted into an opening 234 formed in the third wall portion 23. The arrangement wall portion 49 can also be regarded as partly forming the third wall portion 23. The first wall surface S1 forms a front surface that faces the outside (is exposed to the outside). The second wall surface S2 forms a rear surface that faces the space inside the outer shell 28. In this embodiment, the second wall surface S2 faces the receiving portion 292. The circuit board 40 is arranged at a position of the third wall portion 23 located closer to the first wall portion 21 than the second wall portion 22. Each of the plurality of terminals includes a contact portion cpb that makes contact with the apparatus-side terminal 930 (FIG. 3). A detailed configuration of the circuit board 40 is described later.

In the mounting state of the cartridge 20, the receiving portion 292 (FIG. 7) extends in the protruding direction (positive Z-axis direction) in which the guide member 70 (FIG. 3) protrudes outward. The receiving portion 292 can receive the guide member 70 (the guide member 70 can be inserted there through). The receiving portion 292 is a concave portion that extends from the first wall portion 21 in the protruding direction of the guide member 70 in the mounting state of the cartridge 20. In this embodiment, the receiving portion 292 forms a through hole 292E1 that extends from the first wall portion 21 across to the second wall portion 22. Herein, the receiving portion 292 may extend so as to receive the guide member 70 that extends in the Z-axis direction. In other words, a side surface of the receiving portion 292 that forms the through hole 292H may be parallel to the Z-axis direction, or may be inclined toward the Z-axis direction. In this embodiment, the shape of a cross section parallel to an XY-plane of the through hole 292H is substantially rectangular, but may a shape other than rectangular such as circular.

At least one part of the receiving portion 292 (FIG. 9) is located between the liquid supply port 212 and the circuit board 40 (more specifically, the contact portion cpb) in a predetermined direction (X-axis direction). In this embodiment, the receiving portion 292 is located between the liquid supply port 212 and the circuit board 40 in the predetermined direction. In other words, as illustrated in FIG. 9, when the cartridge 20 is viewed in plan from the first wall portion 21, a range from the center of the liquid supply port 212 to the circuit board 40 (more specifically, the contact portion cpb on the front surface S1 of the circuit board 40) in the predetermined direction (X-axis direction) is defined as a range LPt. At this time, at least one part of the receiving portion 292 (for example, a unit-side restriction portion 298) is located within the range LPt.

One end of the receiving portion 292 is a first open end 295 formed in the first wall portion 21. Another end of the receiving portion 292 is a second open end 294 formed in the second wall portion 22. The receiving portion 292 includes an induction port 295A on the one end thereof. The induction port 295A has a shape in which an opening area orthogonal to a direction (Z-axis direction) in which the receiving portion 292 extends gradually becomes larger as the induction port 295A becomes further away from the first open end 295. In other words, a side surface 296 that defines the induction port 295A is inclined so as to be located further inside the receiving portion 292 as the side surface 296 becomes further away from the first open end 295. This induction port 295A makes it possible to easily insert the guide member 70 into the receiving portion 292 in the process of mounting the cartridge 20.

The receiving portion 292 further includes the unit-side restriction portions 298 as restriction portions. The unit-side restriction portions 298 engage with the apparatus-side restriction portions 78 of the guide member 70 in the mounting state of the cartridge 20, to thereby restrict movement of the cartridge 20 in a direction (demounting direction) opposite to the mounting direction (negative Z-axis direction) of mounting the cartridge 20 onto the printer 50. The unit-side restriction portions 298 are step surfaces formed on both X-axis direction side surfaces 281 and 282, which are side surfaces that define the through hole 292H. The unit-side restriction portion 298 is a horizontal flat surface. The unit-side restriction portion 298 is also a surface that faces the demounting direction (positive Z-axis direction). The term "faces" refers to the orientation of a normal vector. In other words, a normal vector of the unit-side restriction portion 298 is oriented in the demounting direction (positive Z-axis direction). The unit-side restriction portions 298 are located on the demounting direction side of the circuit board 40.

The shape and position of the unit-side restriction portions 298 are not limited to this embodiment, provided that the shape and position allows for engagement with the apparatus-side restriction portions 78 to restrict the movement of the cartridge 20 in the demounting direction. For example, the unit-side restriction portions 298 may be slightly inclined with respect to a horizontal direction. Further, for example, the unit-side restriction portions 298 are step surfaces formed on the side surfaces 281 and 282 on both sides in the X-axis direction, but the unit-side restriction portions 298 may be groove portions (slits) formed in the side surfaces 281 and 282 on both sides in the X-axis direction. In addition, the unit-side restriction portions 298 may be formed on only one surface among the side surfaces 281 and 282 on both sides in the X-axis direction. The unit-side restriction portions 298 may also be formed on side surfaces that define the through hole 292H in the Y-axis direction, or may be formed on only one side surface of the surfaces in the Y-axis direction. The unit-side restriction portions 298 may also be formed such as to surround all side surfaces of the through hole 292H.

The biasing member 80 is a compressed coil spring. The biasing member 80 is arranged in the periphery of the first open end 295 in the first wall portion 21. The biasing member 80 is attached to the first wall portion 21 by, for example, being insert molded into the outer shell 28. In the mounting state of the cartridge 20, the biasing member 80 generates a force (biasing force) for moving the outer shell 28 in a direction (demounting direction) opposite to the mounting direction of mounting the cartridge 20 onto the printer 50. This force of the biasing member 80 is preferably powerful enough to cause the outer shell 28 to float when engagement between the unit-side restriction portion 298 and the apparatus-side restriction portion 78 is released. The phrase "powerful enough to cause the outer shell 28 to float" refers to power at which the outer shell 28 of the cartridge 20 in the mounting state moves toward a demounting direction side of a position of engagement between the unit-side restriction portion 298 and the apparatus-side restriction portion 78. With this configuration, the unit-side restriction portion 298 and the apparatus-side restriction portion 78 can be prevented from reengaging with each other after the user has once released engagement between the unit-side restriction portion 298 and the apparatus-side restriction portion 78. As a result, the user can easily demount the cartridge 20 from the printer 50.

Here, in the mounting state of the cartridge 20, the biasing member 29C generates a force (biasing force) for moving the outer shell 28 in the direction (demounting direction) opposite to the mounting direction of mounting the cartridge 20 onto the printer 50. Therefore, the biasing member 29C, which is a component of the valve mechanism 29, has a similar function to that of the biasing member 80. Therefore, the biasing member 80 may be omitted. The force (biasing force) applied to the outer shell 28 by the biasing member 29C is preferably powerful enough to cause the outer shell 28 to float when engagement between the unit-side restriction portion 298 and the apparatus-side restriction portion 78 is released.

The biasing member 80 has been described as a compression coil spring, but may have another configuration provided that such a configuration can generate a force for moving the outer shell 28 in the demounting direction in the mounting state of the cartridge 20. For example, the biasing member 80 may be an elliptical coil spring or a conical coil spring, or a leaf spring. For example, if a conical coil spring is used for the biasing member 80, the required space for providing the biasing member 80 can be reduced. Further, for example, if an elliptical coil spring is used for the biasing member 80, the size of the cartridge 20 in the width direction (Y-axis direction) can be reduced.

As illustrated in FIG. 7, the liquid supply port 212, the receiving portion 292 and the circuit board 40 have the following positional relationship. The liquid supply port 212 and the circuit board 40 (more specifically, the contact portion cpb) are arranged so as to sandwich the receiving portion 292 in a predetermined direction (X-axis direction). The liquid supply port 212, the receiving portion 292 and the circuit board 40 are located at a position closer to the third wall portion 23 than the fourth wall portion 24 in the predetermined direction (X-axis direction). The predetermined direction is a direction orthogonal to a direction in which the receiving portion 292 extends and a direction in which the third wall portion 23 and the fourth wall portion 24 oppose each other. The liquid supply port 212, the receiving portion 292 and the circuit board 40 are arranged biased toward one wall portion among the third wall portion 23 and the fourth wall portion 24 (in this embodiment, the third wall portion 23). In other words, in the X-axis direction, the liquid supply port 212 (more specifically, a central axis of the liquid supply port 212), the receiving portion 292 and the circuit board 40 are located between a center point L28 between the third wall portion 23 and the fourth wall portion 24 and the third wall portion 23.

Figure 11:
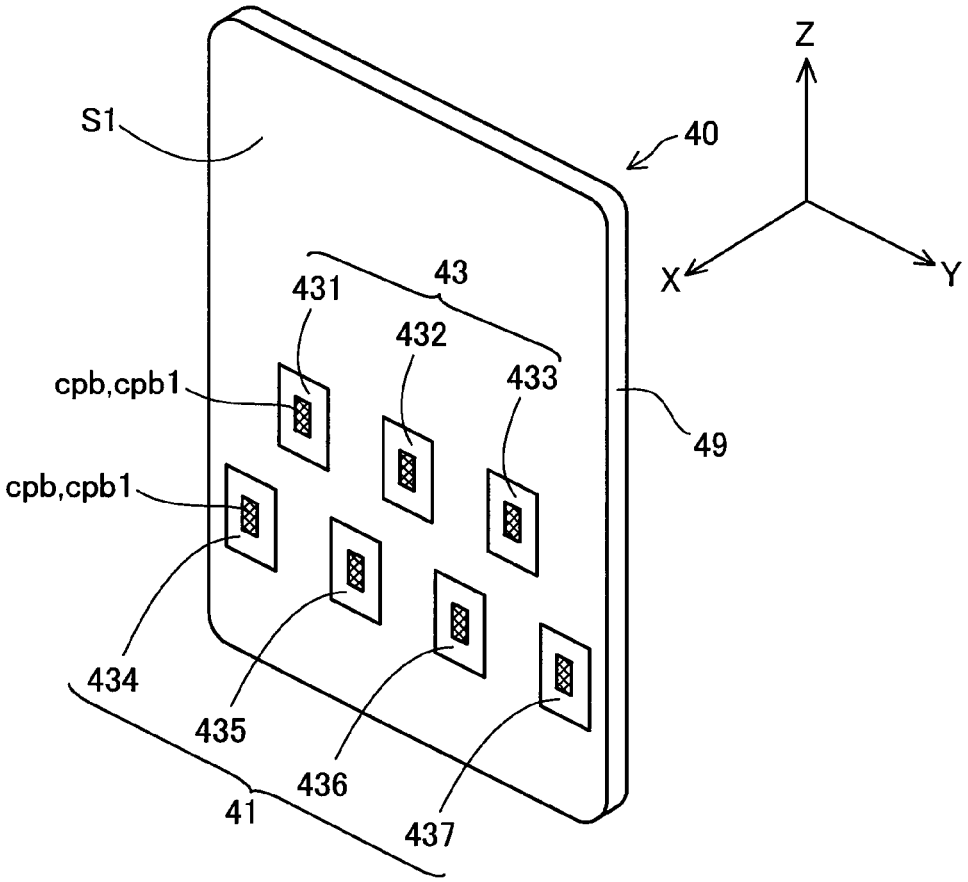
FIG. 11 is a perspective view for illustrating a detailed configuration of a first wall surface of a circuit board.
Figure 12:
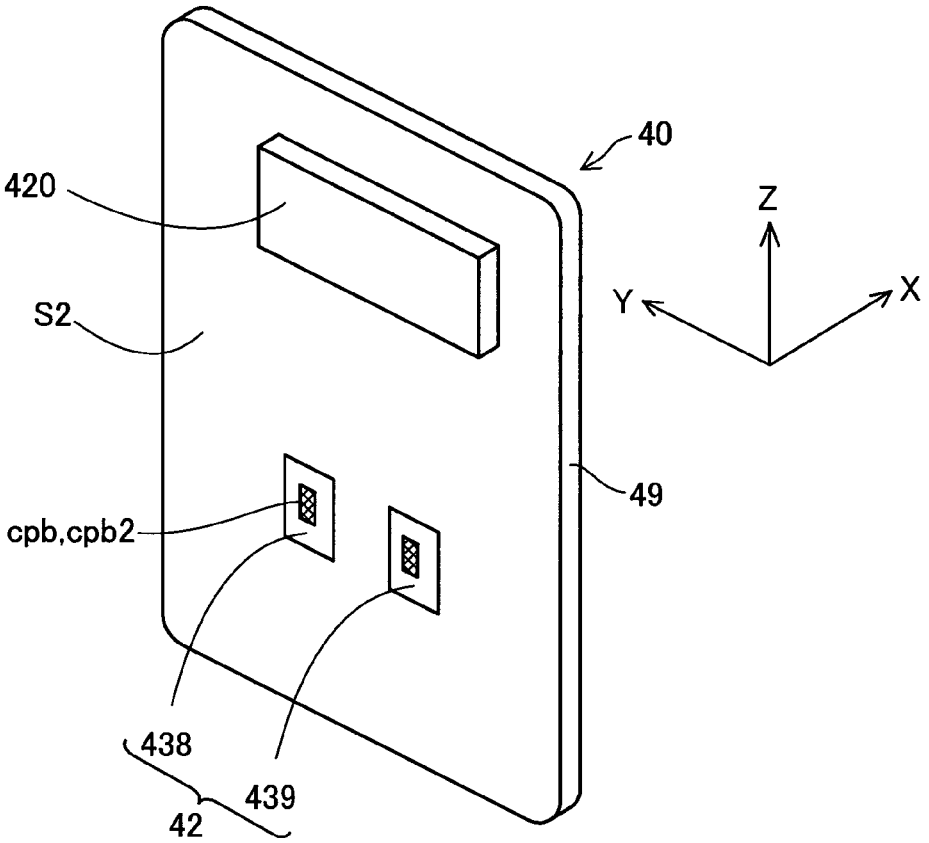
FIG. 12 is a perspective view for illustrating a detailed configuration of a second bottom surface of the circuit board.

FIG. 11 is a perspective view for illustrating a detailed configuration of the first wall surface S1 of the circuit board 40. FIG. 12 is a perspective view for illustrating a detailed configuration of the second wall surface S2 of the circuit board 40. In FIGS. 11 and 12, the X-axis, Y-axis and Z-axis are shown to clearly indicate the orientation of the circuit board 40 in a usage state.

As illustrated in FIG. 11, seven terminals (a first terminal 431, a second terminal 432, a third terminal 433, a fourth terminal 434, a fifth terminal 435, a sixth terminal 436 and a seventh terminal 437) are provided on the first wall surface S1 of the circuit board 40. The three terminals 431 to 433 are arranged side by side parallel to the Y-axis direction to form a third terminal row 43. The other four terminals 434 to 437 are arranged side by side parallel to the Y-axis direction with predetermined intervals there-between to form a first terminal row 41. In this embodiment, the third terminal row 43 is located higher (positive Z-axis direction) than the first terminal row 41.

As illustrated in FIG. 12, two terminals (an eighth terminal 438 and a ninth terminal 439) and a storage device 420 are provided on the second wall surface S2 of the circuit board 40. The two terminals 438 and 439 are arranged side by side parallel to the Y-axis direction to form a second terminal row 42. On the second wall surface S2, the storage device 420 is arranged toward a higher side and the second terminal row 42 is arranged toward a lower side. The storage device 420 stores information on the ink stored in the cartridge 20, such as type of ink and amount of remaining ink.

Each terminal 431 to 439 has a rectangular plan view shape and is formed of a conductive material. In this embodiment, a copper (Cu) material plated with gold (Au) is used as the conductive material. In this embodiment, the front surface of each terminal 431 to 439 is a substantially flat surface. In the mounting state, each terminal 431 to 439 makes contact with the apparatus-side terminals 930 (FIG. 3) provided in the holder unit 61. A connection state between the terminals 431 to 439 and the holder unit 61 is described later.

The first terminal 431 and the third terminal 433 are terminals for detecting both short circuiting and demounting of the cartridge 20. The first terminal 431 and the third terminal 433 are electronically connected to each other inside the circuit board 40. This electronic connection is realized by, for example, a conductive path formed of a conductive pattern (not shown) formed on the surface of and inside the circuit board 40, and a bonding wire that connects the conductive pattern to a terminal (not shown) of the storage device 420.

The second terminal 432, the fifth terminal 435, the sixth terminal 436, the seventh terminal 437, the eighth terminal 438 and the ninth terminal 439 are all electronically connected to the storage device 420 and are used to control operation of the storage device 420, read out data from the storage device 420, write data to the storage device 420, and other operations. More specifically, the second terminal 432 is used to supply the storage device 420 with a reset signal. The fifth terminal 435 is used to input/output data to/from the storage device 420. The sixth terminal 436 is used to supply the storage device 420 with a clock signal. The seventh terminal 437 is used to send/receive a high voltage signal, for example, a signal for detecting presence of the cartridge 20. The eighth terminal 438 is a terminal for supplying the storage device 420 with a DC power supply. The ninth terminal 439 is a terminal for ground connection (a terminal that receives supply of a 0 V ground voltage). The fourth terminal 434 is a terminal used to send/receive a high voltage signal, similar to the seventh terminal 437. The voltage of signals input to the fourth terminal 434 and the seventh terminal 437 is approximately 40 V. The voltage of signals input to the other terminals excluding these two terminals 434 and 437 and the ninth terminal 439 is approximately 3.3 V.

The contact portion cpb that can electronically connect with the corresponding apparatus-side terminals 931 to 939 (FIGS. 5 and 6) by making contact with those apparatus-side terminals 931 to 939 is formed at the approximate center of each terminal 431 to 439. Among the plurality of contact portions cpb, the contact portion cpb provided on the first wall surface S1 is also referred to as "first contact portion cpb1." In addition, among the plurality of contact portions cpb, the contact portion cpb provided on the second wall surface S2 is also referred to as "second contact portion cpb2."

As described above, in the circuit board 40 according to this embodiment, because the terminals groups are arranged in a dispersed manner on the first wall surface S1 and the second wall surface S2, the size of each terminal can be increased, as compared to a configuration in which all the terminals are only arranged on one surface.

A-4. Aspect of Mounting Cartridge 20 onto Holder Unit 61

Figure 13:
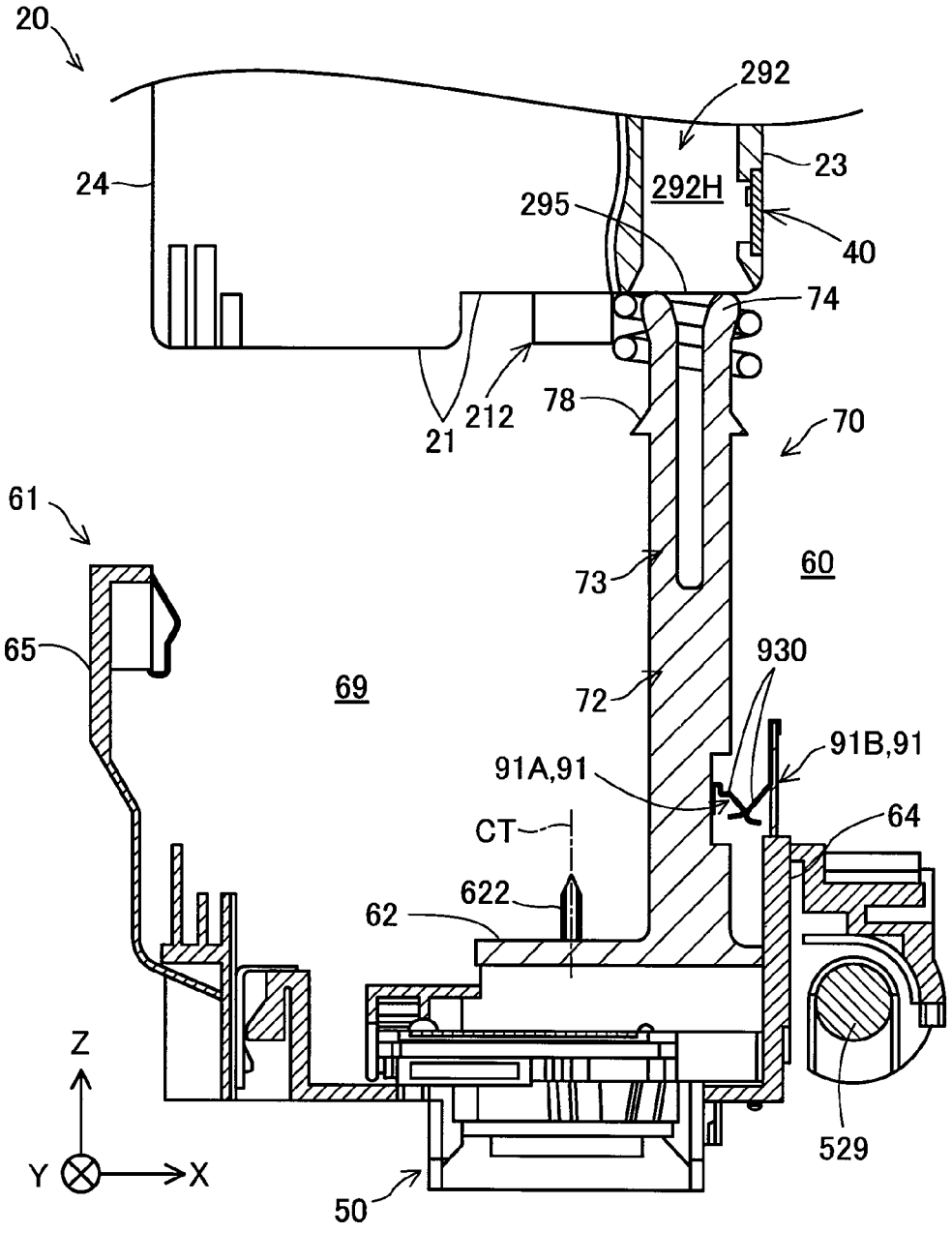
FIG. 13 is a first view for illustrating a process of mounting the cartridge onto a holder unit.
Figure 14:
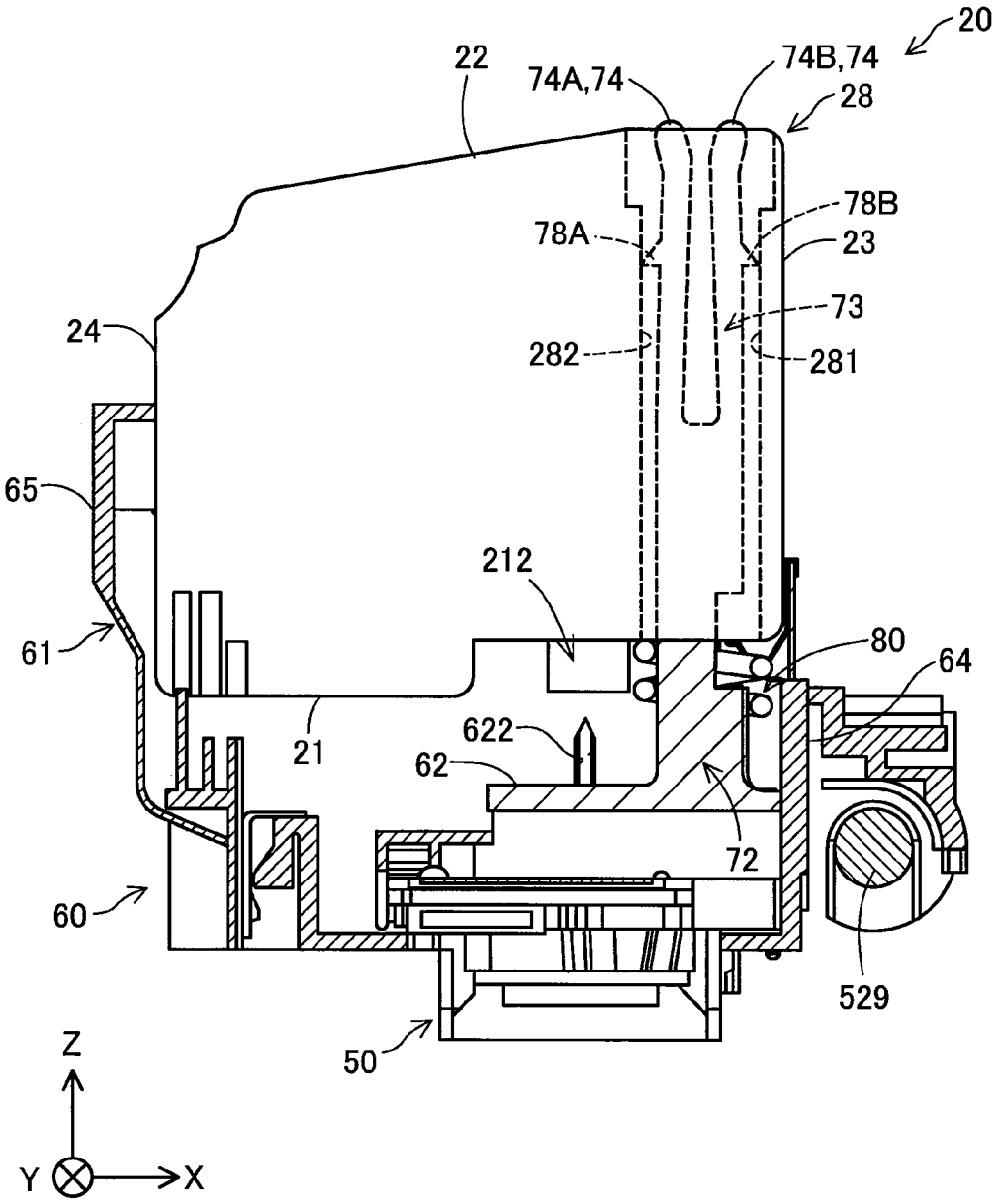
FIG. 14 is a second view for illustrating a process of mounting the cartridge onto a holder unit.
Figure 15:
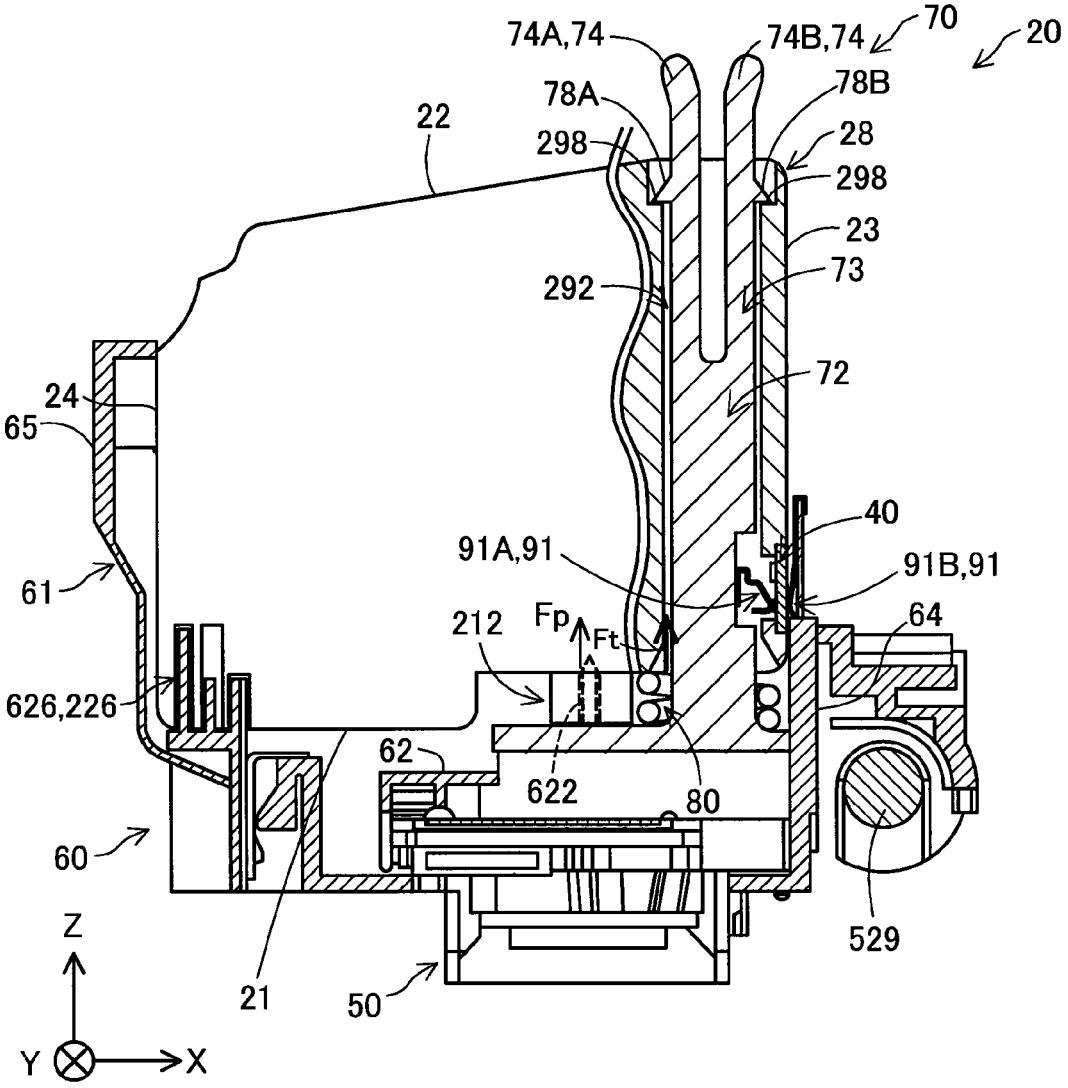
FIG. 15 is a diagram for illustrating a state in which the cartridge is mounted onto the holder unit.

FIG. 13 is a first diagram for illustrating a process of mounting the cartridge 20 onto the holder unit 61. FIG. 14 is a second diagram for illustrating a process of mounting the cartridge 20 onto the holder unit 61. FIG. 15 is a diagram for illustrating a state in which the cartridge 20 is mounted onto the holder unit 61. FIG. 13 illustrates a state directly before the guide member 70 is inserted into the first open end 295.

As illustrated in FIG. 13, when the cartridge 20 is to be mounted onto the holder unit 61, the user places the cartridge 20 on top of the mounting direction, using the guide member 70 as a target. More specifically, the user places the cartridge 20 such that an end portion 74 of the guide member 70 is located directly below the first open end 295 of the receiving portion 292. Through the user moving the cartridge 20 further in the mounting direction (negative Z-axis direction), the guide member 70 is further inserted into the receiving portion 292. As a result, the cartridge 20 is guided to the mounting position.

In FIG. 14, the cartridge 20 proceeds in the mounting direction (negative Z-axis direction) further than the state illustrated in FIG. 13. The state illustrated in FIG. 14 is a state before the liquid injecting needle 622 is inserted into the liquid supply port 212 and before the first to ninth terminals 431 to 439 of the circuit board 40 make contact with the apparatus-side terminals 931 to 939.

The guide member 70 and the receiving portion 292 are preferably configured such that the movement of the cartridge 20 within a flat plane orthogonal to the mounting direction of the cartridge 20 is restricted by the guide member 70 from the time illustrated in FIG. 14 to the time at which the mounting position is reached. In other words, in a state before the liquid injecting needle 622 is inserted into the liquid supply port 212 and before the first to ninth terminals 431 to 439 of the circuit board 40 and the apparatus-side terminals 931 to 939 make contact with one another, the movement of the cartridge 20 within a flat plane orthogonal to the mounting direction of the cartridge 20 is preferably restricted. Due to this restriction, the cartridge 20 can be accurately moved to the mounting position. As a result, the liquid supply port 212 and the liquid injecting needle 622, and the first to ninth terminals 431 to 439 and the apparatus-side terminals 931 to 939 can precisely make contact with each other, respectively. For example, the shape of a lateral cross section of the guide member 70 is preferably slightly smaller than the outer shape of a lateral cross section of the receiving portion 292. For example, in the process of mounting, at least either one of the X-axis direction sides and the Y-axis direction sides of the guide member 70 preferably comes into contact with a wall surface of the receiving portion 292. In this embodiment, as illustrated in FIG. 14, the apparatus-side restriction portion 78A comes into contact with the side surface 281, 282 of the receiving portion 292 while the elastically deforming portion 73 of the guide member 70 elastically deforms such that the two end portions 74A and 74B approach each other. In addition, both sides of the body portion 72 in the Y-axis direction face both wall surfaces of the receiving portion 292 in the Y-axis direction with a slight gap in-between.

As illustrated in FIG. 15, when the apparatus-side restriction portion 78 reaches the unit-side restriction portion 298, the two end portions 74A and 74B displace so as to separate from each other and the apparatus-side restriction portion 78 and the unit-side restriction portion 298 engage with each other. In addition, in the mounting state illustrated in FIG. 15, the liquid injecting needle 622 becomes completely inserted into the liquid supply port 212 and ink can be distributed from the liquid supply port 212 to the liquid injecting needle 622. In addition, in the mounting state illustrated in FIG. 15, the apparatus-side terminals 931 to 939 and corresponding first to ninth terminals 431 to 439 make contact with each other, to thereby allow electronic signals to be sent/received between the circuit board 40 and the control unit 510. In addition, in the mounting state of the cartridge 20, a part of the elastically deforming portion 73 that includes the two end portions 74A and 74B protrudes outward toward the demounting direction (positive Z-axis direction) of the outer shell 28.

In the mounting state of the cartridge 20, the liquid injecting needle 622 compresses the biasing member 29C (FIG. 7), to thereby subject the outer shell 28 to a force Fp toward the demounting direction (positive Z-axis direction) with the biasing member 29C. In addition, in the mounting state of the cartridge 20, the biasing member 80 compresses, to thereby subject the outer shell 28 to a force Ft toward the demounting direction (positive Z-axis direction) with the biasing member 80. While these forces Fp and Ft attempt to move the cartridge 20 in the demounting direction, the movement of the cartridge 20 in the demounting direction is restricted because the unit-side restriction portion 298 and the apparatus-side restriction portion 78 engage with each other.

When the cartridge 20 is to be demounted from the holder unit 61, the user operates the elastically deforming portion 73 to displace the apparatus-side restriction portion 78 and thereby release engagement between the apparatus-side restriction portion 78 and the unit-side restriction portion 298. More specifically, the user sandwiches and holds the elastically deforming portion 73 such that the two end portions 74A and 74B approach each other. With this configuration, the two apparatus-side restriction portion 78 displace so as to approach each other and engagement between the apparatus-side restriction portion 78 and the unit-side restriction portion 298 releases. When the engagement between the apparatus-side restriction portion 78 and the unit-side restriction portion 298 has released, the forces Fp and Ft cause the outer shell 28 to displace toward the demounting direction, to thereby generate a state in which the apparatus-side restriction portion 78 is positioned lower than the unit-side restriction portion 298. In this state, the user moves the cartridge 20 in the demounting direction, to thereby demount the cartridge 20 from the holder unit 61.

Figure 16:
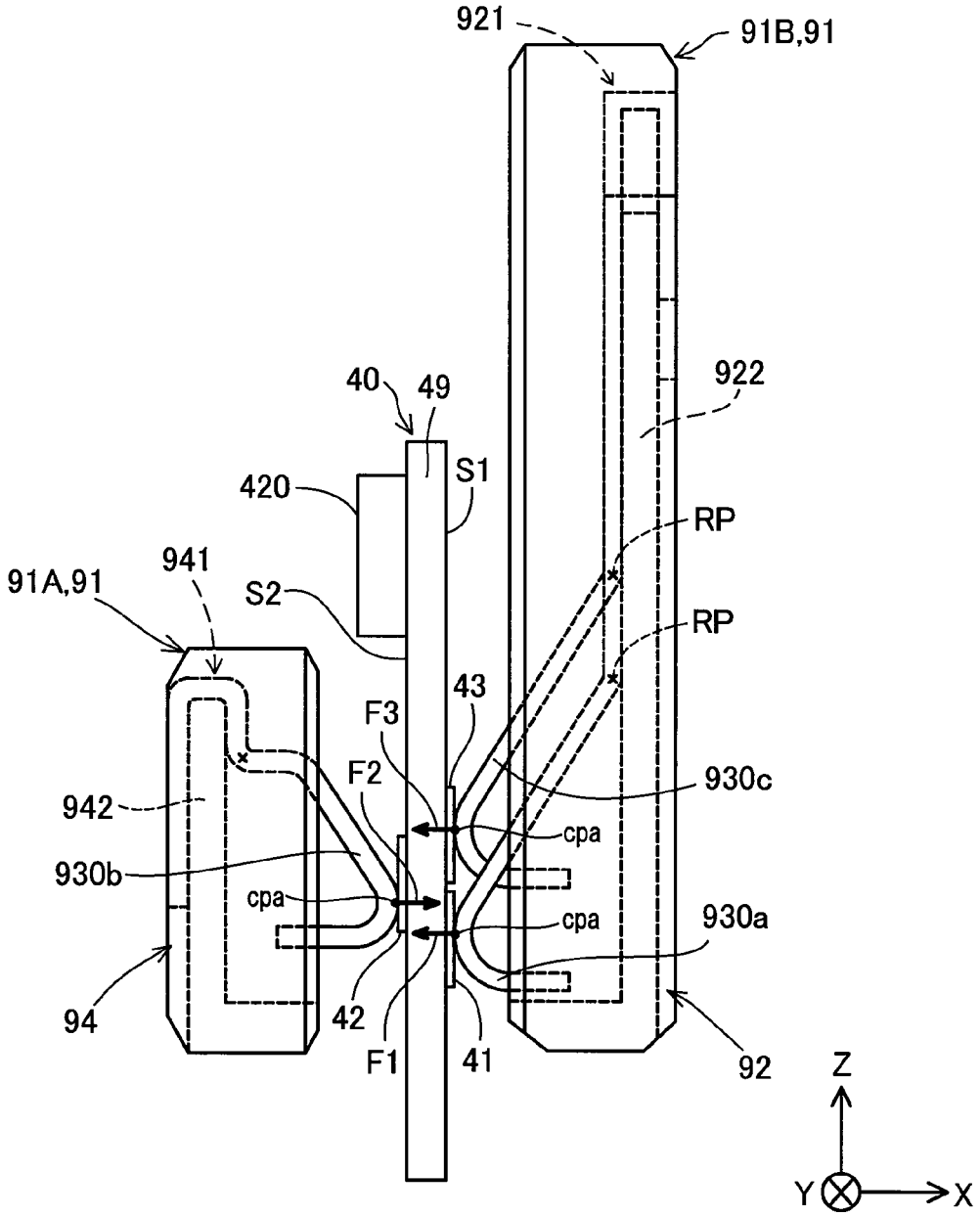
FIG. 16 is an explanatory view for illustrating a detailed configuration of the circuit board and the electrode unit.

FIG. 16 is an explanatory view for illustrating a detailed configuration of the circuit board 40 and the electrode unit 91 in the mounting state. When the cartridge 20 is to be mounted onto the holder unit 61, the circuit board 40 is inserted between the inner electrode unit 91A and the outer electrode unit 91B. As described above, because the first to third apparatus-side terminal groups 930*a* to 930*c* have elasticity, each group deflects in a direction facing the support stands 922 and 942 when the circuit board 40 is inserted. In the mounting state illustrated in FIG. 16, the contact portion cpa of the first apparatus-side terminal group 930*a* makes contact with the first terminal row 41. At this time, the protruding portions of the first apparatus-side terminal group 930*a* attempt to move backward in the negative X-axis direction, and hence a negative X-axis direction force F1 is applied to the first terminal row 41. The same applies to the third apparatus-side terminal group 930*c* and, in the mounting state, the contact portion cpa makes contact with the third terminal row 43 and a negative X-axis direction force F3 is applied to the third terminal row 43 by the third apparatus-side terminal group 930*c*. The same applies to the second apparatus-side terminal group 930*b* and, in the mounting state, the contact portion cpa makes contact with the second terminal row 42 and a positive X-axis direction force F2 is applied to the second terminal row 42 by the second apparatus-side terminal group 930*b*. In this way, because a force in a direction perpendicular to the terminals is applied to the first to third terminal groups 41 to 43, the stability of electrical connection between the terminal groups 41 to 43 and the apparatus-side terminal groups 930*a* to 930*c* increases.

Figure 17:
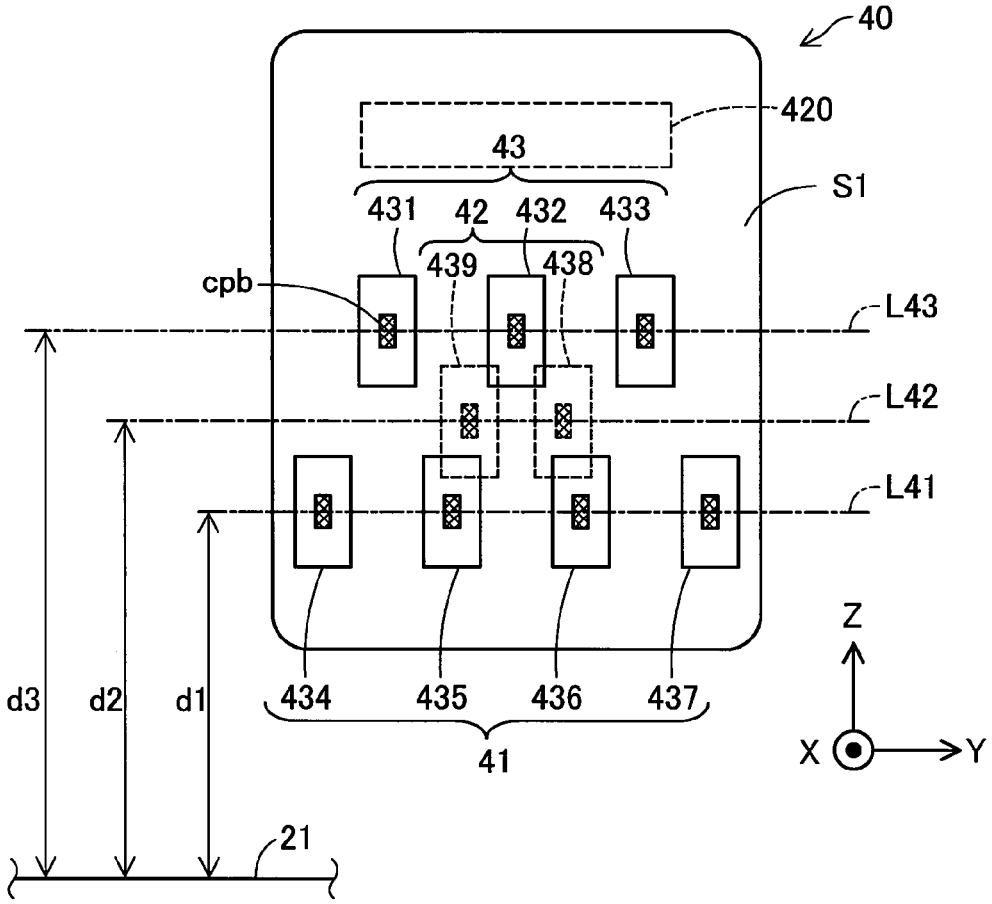
FIG. 17 is an explanatory view for schematically illustrating a state of contact between the circuit board and the electrode unit.

FIG. 17 is an explanatory view for schematically illustrating a state of contact between the circuit board 40 and the electrode unit 91. FIG. 17 illustrates the circuit board 40 such that the first wall surface S1 of the circuit board 40 is a front surface. In FIG. 17, configuration on the second wall surface S2 side is indicated by the broken line.

As illustrated in FIG. 17, the contact portion cpb in each terminal that makes contact with each contact portion cpa is located at the approximate center of each terminal. Therefore, the four contact portions cpb of the first terminal row 41 are located on an imaginary line L41. Similarly, the two contact portions cpb of the second terminal row 42 are located on an imaginary line L42. Similarly, the three contact portions cpb of the third terminal rows 43 are located on an imaginary line L43. These three imaginary lines L41 to L43 are parallel (parallel to the Y-axis direction) and do not overlap each other.

As illustrated in FIG. 17, with regard to the distance between the first wall portion 21 and each of the imaginary lines L41 to L43, a distance d1 between the first wall portion 21 and the imaginary line L41 is the smallest distance, a distance d2 between the first wall portion 21 and the imaginary line L42 is the second smallest, and a distance d3 between the first wall portion 21 and the imaginary line L43 is the largest. This is because, with regard to the distance between each terminal row 41 to 43 and the first wall portion 21, the distance between the first terminal row 41 and the first wall portion 21 is the smallest, the distance between the second terminal row 42 and the first wall portion 21 is the second smallest, and the distance between the third terminal row 43 and the first wall portion 21 is the largest. Due to these relationships between distance, the terminals 431 to 439 on the circuit board 40 can be arranged in the order of first terminal row 41, second terminal row 42 and third terminal row 43 in a direction (demounting direction) from the first wall portion 21 to the second wall portion 22. Therefore, the negative X-axis direction forces F1 and F3 applied from the outer electrode unit 91B and the positive X-axis direction force F2 applied from the inner electrode unit 91A can be applied to the circuit board 40 in a well-balanced manner. In addition, these forces F1 to F3 can suppress the generation of displacement and warping of the circuit board 40.

In conventional technology (the above described Patent Literature 1), a lever provided on a side surface that forms the outer shell of the cartridge is used as the restriction portion of the cartridge. In this case, the cartridge and the holder unit may increase in size by the size of the lever. In addition, in the conventional technology, because the lever is provided on the side surface, the lever may break if the cartridge is accidentally dropped. In the conventional technology, there is a risk that the printer performs a printing operation while the cartridge is not completely mounted onto the holder unit. One example of incomplete mounting is a state in which, because the lever structure is provided on the side surface, another side surface of the cartridge which is not provided with a lever structure is inclined in the mounting state. Another example of a state of incomplete mounting is a state in which the holder unit and the lever structure are not engaged due to deformation of the lever structure or foreign matter adhering to the lever. With the conventional technology, because the restriction portion of the lever is arranged on one side surface of the cartridge, in the mounting state, the regulating portion is arranged at a position separated from the liquid supply port where positional accuracy with respect to the holder unit is required. As a result, the liquid supply port and the liquid introducing portion may become misaligned.

In the technology of Patent Literature 2, when the cartridge mounted onto the carriage unit is to be replaced, the cover of the printer is opened as shown in FIG. 3 of Patent Literature 2. In this state, as illustrated in FIG. 5 of Patent Literature 2, the user visually confirms the printer from a position close to directly above the printer in order to replace the cartridge. At this time, the user is required to put themselves in a forward-leaning position until their head reaches the cover, and is sometimes required to assume an impossible position. In addition, so that the user can avoid this impossible position, the user may visually confirm the carriage unit from diagonally ahead of the printer to replace the cartridge. In this case, the new cartridge must be mounted into a small mounting space surrounded by the cartridge to be replaced and an adjacent cartridge, and hence there is a problem in that the place (for example, liquid introducing portion or apparatus-side terminal) at which the new cartridge is to be mounted onto in the carriage unit is difficult to see. As described above, with the conventional technology, it is difficult to guide the cartridge to the predetermined mounting position while accurately positioning the cartridge while viewing the apparatus-side terminal or the liquid introducing portion. In other words, the user may not be able to easily replace the cartridge.

In the above-described Patent Literature 3, when replacing an ink cartridge while viewing an ink cartridge storage unit and the ink cartridge from the diagonal direction shown in FIGS. 3, 4 and 5 in Patent Literature 3, the following problems may occur. For example, the user must replace the ink cartridge in a small mounting space surrounded by the ink cartridge to be replaced and an adjacent ink cartridge. At this time, the user must mount the new ink cartridge while viewing a target located in the ink cartridge storage unit, which is the mounting space. The target located in the ink cartridge storage unit is, for example, a protrusion 18 (the liquid introducing portion in this embodiment), or the plate-shaped member illustrated obliquely left above the protrusion 18 in FIG. 5 of Patent Literature 3. Such a target can be hard to visually recognize if in-use ink cartridges are located on either side of the ink cartridge to be replaced in the ink cartridge storage unit. In other words, the user may not be able to easily replace the ink cartridge.

The technology of Patent Literature 4 can also bring about the same problems as those in Patent Literature 3. For example, a positioning convex piece arranged on the carriage has a length that is less than half the dimensions of the ink cartridge in the mounting direction as illustrated in FIG.

6 of Patent Literature 4. Because the positioning convex piece has this length, the positioning convex piece becomes housed inside the carriage and hence may be difficult to visually recognize if in-use ink cartridges are arranged on either side of the ink cartridge to be replaced. In addition, a slit portion of the ink cartridge into which the positioning convex piece is to be inserted is located on a side opposite to a storage means and sandwiches an ink supply needle. Therefore, in the mounting state of the ink cartridge, the storage means may become misplaced.

In addition, as in Patent Literature 5, a printer may have a function other than its intended function (printing function), such as a scanning function. If the printer has another function such as a scanning function, there may be provided a mechanism unit (a scanner unit in Patent Literature 5) for executing that other function on top of a mechanism unit for executing the printing function in order to increase ease of use for the user. In this case, the user must replace the ink cartridge with the carriage onto which the ink cartridge is mounted after rotating and opening the scanner unit as illustrated in FIGS. 1 and 2 of Patent Literature 5. At this time, because the upper part (demounting direction of ink cartridge) of the carriage obliquely covers the scanner unit, the ink cartridge sometimes cannot be easily replaced. In particular, when in-use ink cartridges are arranged on either side of the ink cartridge to be replaced, it may be difficult to replace the ink cartridge because the space available to mount/demount the ink cartridge is limited.

The present embodiment can at least partly solve the problems caused by the conventional technology described above. In other words, according to the first embodiment, the cartridge 20 includes the receiving portion 292 which can receive the guide member 70 in between the liquid supply port 212 and the contact portion cpb (FIG. 7). With this configuration, in the process of mounting the cartridge 20, the cartridge 20 can easily be moved to the mounting position of the cartridge 20 in the printer 50 because the receiving portion 292 receives the guide member 70. In addition, according to the first embodiment, the receiving portion 292 is located between the liquid supply port 212 and the contact portion cpb in a predetermined direction (X-axis direction). With this configuration, the liquid supply port 212 can easily be moved toward the liquid injecting needle 622 and the contact portion cpb can easily be moved toward the apparatus-side terminal 930. Here, in the mounting state of the cartridge 20, the liquid supply port 212 and the contact portion cpb need to be accurately positioned in order to connect (make contact) with corresponding portions of the holder unit 61 (liquid injecting needle 622, apparatus-side terminal 930). According to the first embodiment, because the receiving portion 292 is located between the liquid supply port 212 and the contact portion cpb in the predetermined direction (X-axis direction), the liquid supply port 212 and the contact portion cpb can be accurately moved to the mounting position in the process of mounting the cartridge 20. In addition, because the liquid supply port 212 can easily be moved toward the liquid injecting needle 622, the possibility of the liquid supply port 212 colliding with the liquid injecting needle 622 and damaging the liquid injecting needle 622 in the process of mounting can be reduced. As described above, according to the first embodiment, the cartridge 20 can be mounted more reliably.

According to the first embodiment, the receiving portion 292 penetrates the outer shell 28 from the first wall portion 21 to the second wall portion 22, and hence the cartridge 20 can be even more easily moved to the mounting position of the printer 50.

The printer 50 according to the first embodiment performs the printing operation by moving the carriage unit 60 in the main scanning direction. As a result, the carriage unit 60 accelerates and decelerates during printing. Due to this, the cartridge 20 mounted onto the carriage unit 60 is used under an environment subject to acceleration/deceleration speed during printing. However, according to the first embodiment, the unit-side restriction portion 298 of the receiving portion 292 is located between the liquid supply port 212 and the contact portion cpb in the predetermined direction (X-axis direction) (FIG. 7). With this configuration, misplacement between the liquid supply port 212 and the liquid injecting needle 622 and misplacement between the contact portion cpb and the apparatus-side terminal 930 can be suppressed. In addition, even in an off carriage-type printer, the holder unit 61 may vibrate during the printing operation of the printer. However, even in a liquid ejection system including an off carriage-type printer such as in that according to the first embodiment, misplacement between the liquid supply port 212 and the liquid injecting needle 622 and misplacement between the contact portion cpb and the apparatus-side terminal 930 can be suppressed.

According to the first embodiment, the receiving portion 292 includes the unit-side restriction portion 298 for restricting the cartridge 20 from moving in the demounting direction in the mounting state of the cartridge 20 (FIG. 15). With this configuration, in the mounting state of the cartridge 20, even when the forces Fp and Ft are applied to the cartridge 20, the possibility of the cartridge 20 becoming displaced from the printer 50 (more specifically, the holder unit 61) can be reduced. In addition, in the predetermined direction (Z-axis direction), misplacement between the liquid supply port 212 and the contact portion cpb can be suppressed because the movement of the cartridge 20 in the demounting direction is restricted between the liquid supply port 212 and the contact portion cpb. As a result, the possibility of the liquid supply port 212 and the liquid injecting needle 622 becoming disengaged, and the possibility of the contact portion cpb separating from the apparatus-side terminal 930 can be reduced.

According to the first embodiment, the printer 50 includes the plurality of apparatus-side terminals 931 to 939 that is configured to make contact with corresponding contact portions cpb while pushing those contact portions cpb (FIG. 16). In addition, the cartridge 20 is arranged in the outer shell 28 and includes the arrangement wall portion 49 as a substrate body on which the plurality of contact portions cpb is disposed. A first contact portion cpb1 of the plurality of contact portions cpb is arranged on the first wall surface S1, and a second contact portion cpb2 of the plurality of contact portions cpb is arranged on the second wall surface S2 (FIGS. 11 and 12). In this way, in the arrangement wall portion 49, the first contact portion cpb1 and the second contact portion cpb2 are arranged by being divided between the first wall surface S1 and the second wall surface S2 that are opposite to each other. Therefore, the arrangement wall portion 49 can be prevented from increasing in size compared to a configuration in which the first contact portion cpb1 and the second contact portion cpb2 are arranged on the same surface. Further, in the mounting state, the arrangement wall portion 49 is pushed by the plurality of apparatus-side terminals 931 to 939 from the wall surfaces S1 and S2, and hence the possibility of the arrangement wall portion 49 becoming displaced can be reduced.

In the circuit board 40 of the cartridge 20 according to the first embodiment, the first terminal row 41 and the third terminal row 43, and the second terminal row 42 are arranged by being divided between the first wall surface S1 and the second wall surface S2 that oppose each other. Therefore, the size (area) of each terminal in these three terminal rows 41 to 43 can be further increased compared to a configuration in which the three terminal rows 41 to 43 are arranged on either one of the first wall surface S1 and the second wall surface S2. Therefore, even when the cartridge 20 becomes displaced with respect to the printer 50 (holder unit 61), reduction in the electrical connection stability between the cartridge 20 and the printer 50 (holder unit 61) can be suppressed. In addition, short-circuiting between the first terminal row 41 and the second terminal row 42 due to ink that has been ejected from the head unit 52 adhering to both the first terminal row 41 and the second terminal row 42, and short-circuiting between the third terminal row 43 and the second terminal row 42 due to said ink adhering to both the third terminal row 43 and the second terminal row 42 can be prevented because the first terminal row 41 and the third terminal row 43, and the second terminal row 42 are arranged on the arrangement wall portion 49 by being divided between the first wall surface S1 and the second wall surface S2 that are oppose each other. Therefore, reduction in the electrical connection stability between the cartridge 20 and the printer 50 can be suppressed.

The apparatus-side terminals 938 and 939 provided in the inner electrode unit 91A are located inside the cartridge storage chamber 69 in the mounting state. In other words, in the mounting state, the apparatus-side terminals 938 and 939 are located between the liquid storage portion 201 and the circuit board 40. Because of this, ink and impurities such as dust can be prevented from adhering to both the apparatus-side terminals 938 and 939 and the second terminal row 42 that makes contact with the apparatus-side terminals 938 and 939.

In the circuit board 40, the number (seven) of terminals disposed on the first wall surface S1 is larger than the number (two) of terminals disposed on the second wall surface S2. Therefore, the total force (force F1+force F3) applied to the first wall surface S1 (first terminal row 41 and third terminal row 43) from the first apparatus-side terminal group 930*a* and the third apparatus-side terminal group 930*c* is larger than the total force (force F2) applied to the second wall surface S2 (second terminal row 42) from the second apparatus-side terminal group 930*b*. Therefore, the direction of the total force (force F1+force F2+force F3) applied to the circuit board 40 can be made a direction (negative X-axis direction) that faces the second apparatus-side terminal group 930*b* from the first apparatus-side terminal group 930*a* and the third apparatus-side terminal group 930*c*, and the circuit board 40 can be prevented from coming away from the third wall portion 23 of the cartridge 20.

The second terminal row 42 (contact portions cpb formed by the second terminal row 42) arranged on the second wall surface S2 of the circuit board 40 is used to supply power to the storage device 420. When short-circuiting occurs between these two terminals due to ink or impurities adhering thereto, an overcurrent may flow through a power supply circuit (not shown) and damage the power supply circuit. However, with the cartridge 20 according to the first embodiment, the second terminal row 42 is arranged so as to face the space inside the outer shell 28. With this configuration, short-circuiting in a circuit provided with the second contact portion cpb2 due to ink, dust or an impurity such as a conductor (for example, a metal clip) adhering thereto can be reduced.

In addition, the distances between each of the terminal rows 41 to 43 and the first wall portion 21 are set as follows. That is, the distance d1 between the first terminal row 41 and the first wall portion 21 is the smallest, the distance d2 between the second terminal row 42 and the first wall portion 21 is the second smallest, and the distance d3 between the third terminal row 43 and the first wall portion 21 is the largest (FIG. 17). With this configuration, the force F1 from the first apparatus-side terminal group 930*a* and the force F3 from the third apparatus-side terminal group 930*c*, and the force F2 from the second apparatus-side terminal group 930*b* can be applied to the circuit board 40 in a well-balanced manner in a vertical direction (direction along Z-axis) to suppress displacement of the circuit board 40 due to these forces F1 to F3.

Because the first terminal row 41 and the third terminal row 43, and the second terminal row 42 are disposed by being divided between the opposing first wall surface S1 and second wall surface S2, respectively, each terminal 431 to 439 can be made smaller, and the distance between each terminal can be made larger while maintaining the areas of the first wall surface S1 and the second wall surface S2 of the circuit board 40. With such a configuration, short-circuiting between the terminals can be prevented and the reliability of electrical connection can be improved. In addition, the areas of the first wall surface S1 and second wall surface S2 can be reduced while reducing the size of each terminal 431 to 439 and maintaining the distances between the terminals. With such a configuration, the circuit board 40 can be reduced in size, which can contribute to reducing the size of the cartridge 20.

According to the first embodiment, the cartridge 20 includes the biasing members 29C and 80 that generate force for moving the outer shell 28 in the demounting direction (FIG. 7). With this configuration, the force generated by the biasing member 29C, 80 can be used to easily demount the cartridge 20 from the holder unit 61. In addition, the biasing member 29C, which is a component of the valve mechanism 29, can be made to have a function of generating the force for moving the outer shell 28 in the demounting direction.

B. Second Embodiment

B-1. Configuration of Carriage Unit 60*a*

Figure 18:
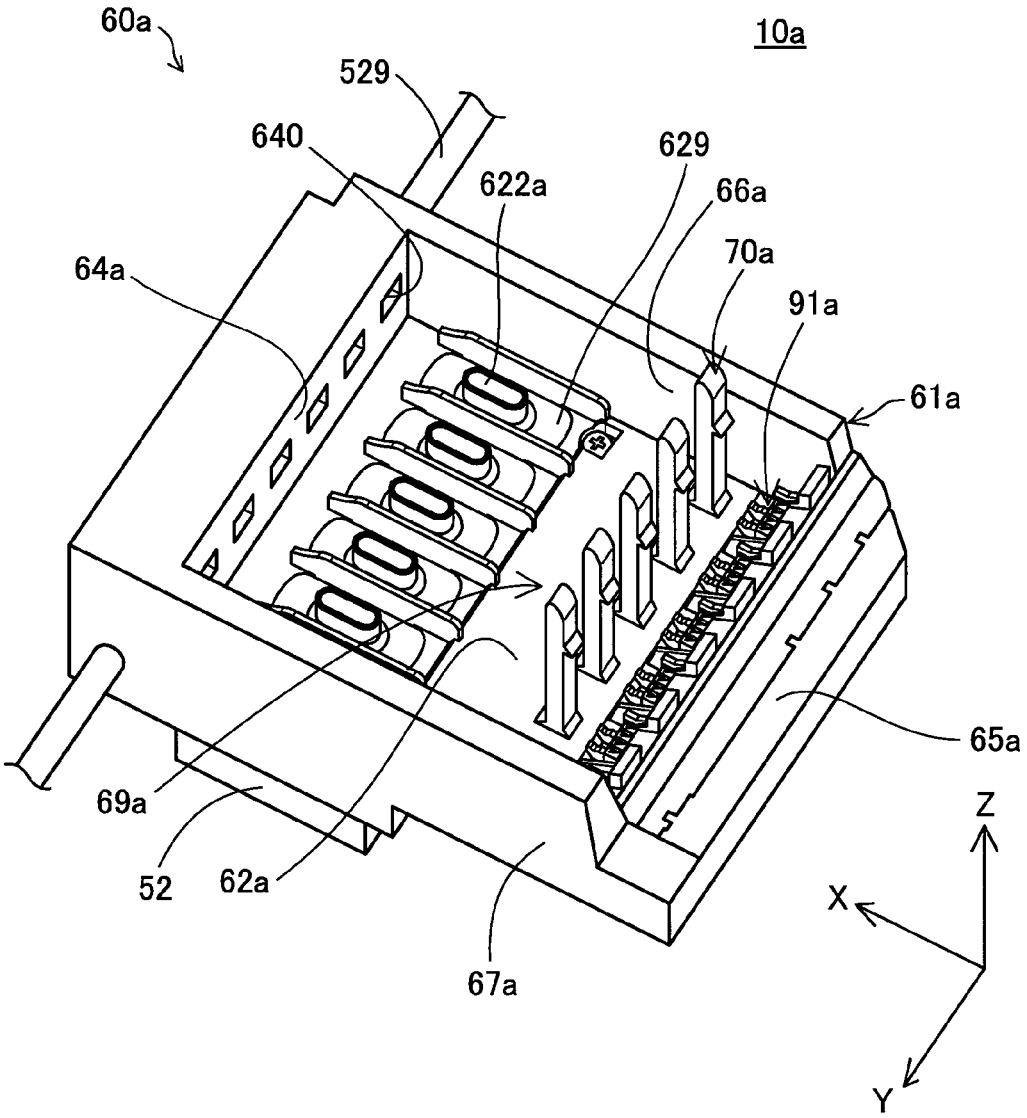
FIG. 18 is a diagram for explaining a liquid ejection system according to a second embodiment.
Figure 19:
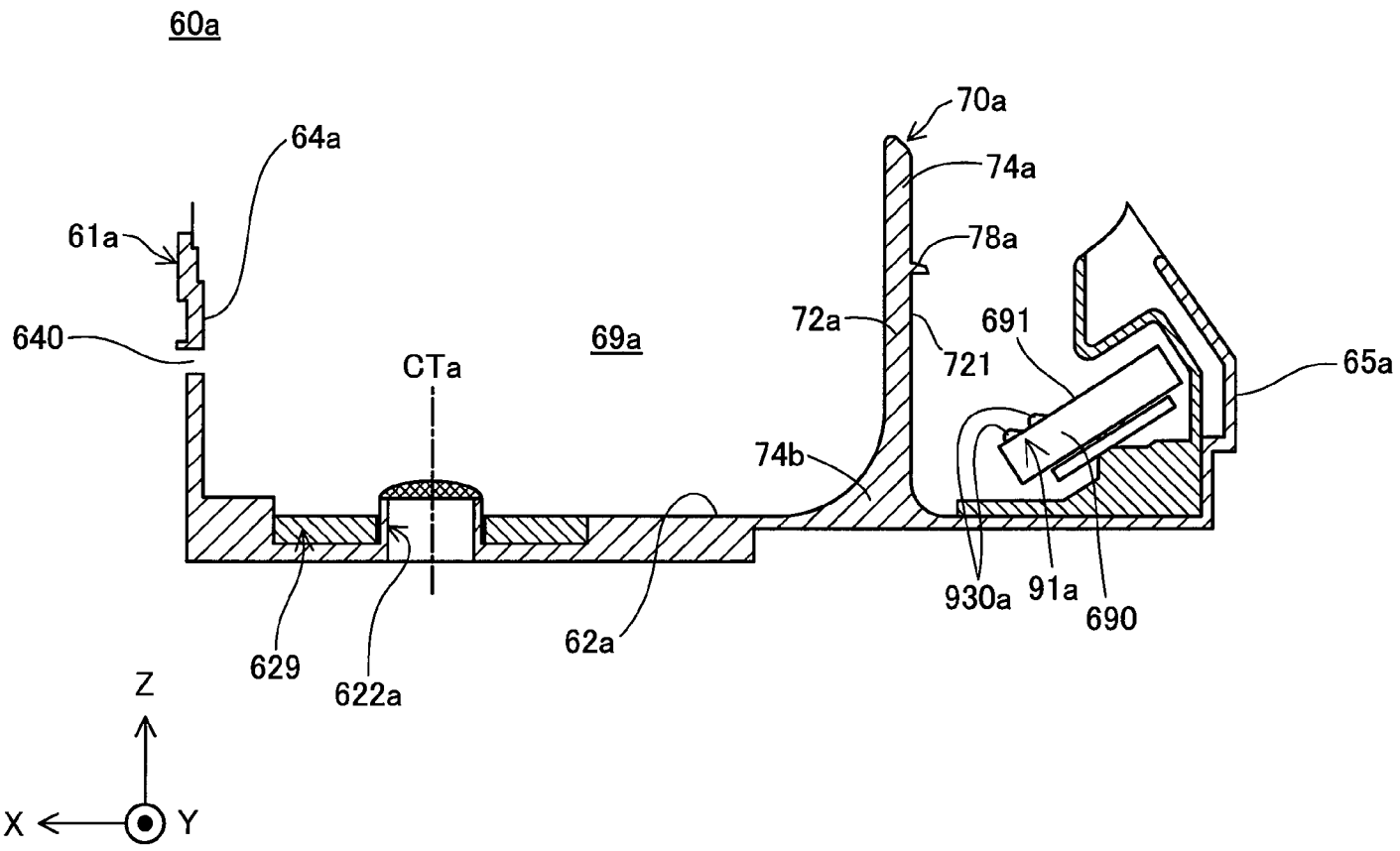
FIG. 19 is a cross-sectional view for illustrating a carriage unit.

FIG. 18 is a diagram for explaining a liquid ejection system 10*a* according to a second embodiment. FIG. 19 is a cross-sectional view for illustrating a carriage unit 60*a*. The liquid ejection system 10*a* and the liquid ejection system 10 (FIG. 1) differ from each other in terms of the configurations of a holder unit 61*a* and a cartridge to be described later. Other configurations are the same as those according to the first embodiment, and hence like components are denoted by the same reference symbols used in the first embodiment and a description thereof is appropriately omitted.

The carriage unit 60*a* includes a holder unit 61*a* and the head unit 52. The carriage unit 60*a* can be used in place of the carriage unit 60 of the printer 50 (FIG. 1).

The holder unit 61*a* includes five wall portions 62*a*, 64*a*, 65*a*, 66*a* and 67*a*. These five wall portions 62*a*, 64*a*, 65*a*, 66*a* and 67*a* correspond to the five wall portions 62, 64, 65, 66 and 67 of the holder unit according to the first embodiment, respectively. In other words, the wall portion 62*a* is located on a mounting direction (negative Z-axis direction) side and forms a bottom wall of the holder unit 61*a*. The four wall portions 64*a*, 65*a*, 66*a* and 67*a* extend from a peripheral edge position of the wall portion 62*a* in the positive Z-axis direction (demounting direction). The wall portion 62*a* is also referred to as "apparatus front wall portion 62*a*,"

the wall portion 64*a* is also referred to as "first side wall portion 64*a*," the wall portion 65*a* is also referred to as "second side wall portion 65*a*," the wall portion 66*a* is also referred to as "third side wall portion 66*a*," and the wall portion 67*a* is also referred to as "fourth side wall portion 67*a*." The five wall portions 62*a*, 64*a*, 65*a*, 66*a* and 67*a* are molded of, for example, a synthetic resin.

The five wall portions 62*a*, 64*a*, 65*a*, 66*a* and 67*a* form a concave cartridge storage chamber 69*a*. The cartridge storage chamber 69*a* is divided into a plurality of slots (mounting spaces) that can receive one cartridge each.

For every slot, the holder unit 61*a* includes a liquid introducing pipe 622*a* as a liquid introducing portion, a guide member 70*a*, an electrode unit 91*a*, and an apparatus-side restriction portion 640.

The liquid introducing pipe 622*a* is arranged on the apparatus front wall portion 62*a*. Similar to the liquid injecting needle 622 (FIG. 3) according to the first embodiment, the liquid introducing pipe 622*a* has a central axis CTa (FIG. 19) that extends along the negative Z-axis direction (mounting direction). The liquid introducing pipe 622*a* communicates with the head unit 52. An elastic member 629 is provided in the vicinity of the liquid introducing pipe 622*a*. The elastic member 629 seals the vicinity of a liquid supply port (described later) of the cartridge in the mounting state of the cartridge. With this configuration, ink is prevented from leaking from the liquid supply port to surrounding areas. In addition, in the mounting state of the cartridge, the elastic member 629 generates a force in a direction (demounting direction, positive Z direction) in which the cartridge is pushed back.

The guide member 70*a* protrudes outward from the apparatus front wall portion 62*a* toward the same side (positive Z-axis direction side) as that of the protruding direction of the liquid introducing pipe 622*a*. The direction in which the guide member 70*a* protrudes outward is the same direction as the protruding direction (positive Z-axis direction) of the liquid introducing pipe 622*a*. In this embodiment, the liquid introducing pipe 622*a* and the guide member 70*a* each extend from the apparatus front wall portion 62*a* in a gravity upward direction. The guide member 70*a* may be, for example, molded integrally with the apparatus front wall portion 62*a* of a synthetic resin or may be molded as a member separate to the apparatus front wall portion 62*a*.

The guide member 70*a* (FIG. 19) includes a body portion 72*a* and a first apparatus-side restriction portion 78*a*. Similar to the guide member 70 according to the first embodiment, the guide member 70*a* guides the cartridge 20*a* (to be described later) to the mounting position of the holder unit 61*a*. The body portion 72*a* is a columnar member connected to the apparatus front wall portion 62*a*. An end portion 74*a* on the demounting direction side of the body portion 72*a* functions as an operation unit. In the mounting state of the cartridge 20*a*, the end portion 74*a* protrudes further outward toward the demounting direction than the cartridge 20*a*. The first apparatus-side restriction portion 78*a* as an apparatus-side restriction portion is disposed on a side surface of the body portion 72*a*. The first apparatus-side restriction portion 78*a* is a protrusion that protrudes outward from a side surface 721 of the body portion 72*a* that faces the negative X-axis direction. The first apparatus-side restriction portion 78*a* engages with the cartridge 20*a* in the mounting state of the cartridge 20*a*. This engagement restricts the cartridge 20*a* from moving in the demounting direction. The body portion 72*a* can elastically deform about an end portion 74*b* on the mounting direction side such that the end portion 74*a* displaces toward a direction that includes an X-axis direction component. Through displacing the end portion 74*a* toward a positive X-axis direction, engagement between the cartridge 20*a* and the first apparatus-side restriction portion 78*a* can be released.

The length (dimensions in Z-axis direction) by which the guide member 70*a* protrudes outward from the apparatus front wall portion 62*a* is preferably larger than the dimensions of the liquid injecting needle 622*a* in the Z-axis direction, more preferably larger than the dimensions of the first to fourth side wall portions 64*a* to 67*a* in the Z-axis direction. With this configuration, the user can more easily visually recognize the guide member 70*a*, and hence more easily mount the cartridge 20*a* onto the holder unit 61*a* using the guide member 70*a* as a target.

The guide member 70*a* preferably has a portion that protrudes outward toward the demounting direction (positive Z-axis direction side) of the cartridge storage chamber 69*a*. With this configuration, when demounting one of a plurality of cartridges 20*a* arranged adjacent to each other to mount a new cartridge 20*a* onto the holder unit 61*a*, the user can easily visually confirm the guide member 70*a* that corresponds to the cartridge 20*a* to be mounted. As a result, the guide member 70*a* can be used as a target when mounting the cartridge 20*a*, and hence the user can more easily mount the cartridge 20*a* onto the holder unit 61*a*.

The electrode unit 91*a* (FIG. 19) is arranged at a corner portion formed between the apparatus front wall portion 62*a* and the second side wall portion 65*a*. The electrode unit 91*a* includes a plurality of apparatus-side terminals 930*a*. In this embodiment, nine apparatus-side terminals 930*a* are provided. The number of apparatus-side terminals 930*a* is not limited thereto and may be less than or more than nine.

The apparatus-side terminals 930*a* are held by a terminal holder 690. The apparatus-side terminals 930*a* generate a biasing force of pushing back the cartridge in a direction (direction including positive Z-axis direction and positive X-axis direction components) including a demounting direction component (positive Z-axis direction) of the cartridge in the mounting state of the cartridge. The direction of this biasing force is a direction substantially perpendicular to an inclined surface 691 of the terminal holder 690. In other words, when the apparatus-side terminal 930*a* that has one portion protruding from the inclined surface 691 is pushed by the cartridge into the inclined surface 691, a biasing force in an inclined direction is applied to the cartridge as reaction force of that action.

The second apparatus-side restriction portion 640 is a through hole that penetrates the first side wall portion 64*a* in the X-axis direction. The second apparatus-side restriction portion 640 may be a concave portion open toward the cartridge storage chamber 69*a*. In the mounting state of the cartridge, the second apparatus-side restriction portion 640 engages with a corresponding member of the cartridge, to thereby restrict the movement of the cartridge in the demounting direction.

The liquid injecting needle 622*a*, the guide member 70*a* and the electrode unit 91*a* have the following positional relationship. The liquid injecting needle 622*a* and the electrode unit 91*a* (more specifically, the apparatus-side terminal 930*a*) are arranged such as to sandwich the guide member 70*a* in a predetermined direction (X-axis direction).

The mounting direction of the cartridge is the negative Z-axis direction (in this embodiment, a vertically downward direction). Here, when the cartridge is actually inserted into the holder unit 61*a*, the state of the cartridge is not necessarily always constant. While trying to mount the cartridge onto the holder unit 61*a*, the cartridge may incline in the Z-axis direction. However, both immediately before mounting and in the mounting state, the liquid supply port of the cartridge accepts the liquid introducing pipe 622*a* having the central axis CTa parallel to the Z-axis direction. Therefore, the cartridge can be mounted onto the holder unit 61*a* in the negative Z-axis direction.

B-2. Configuration of Cartridge 20*a*

Figure 20:
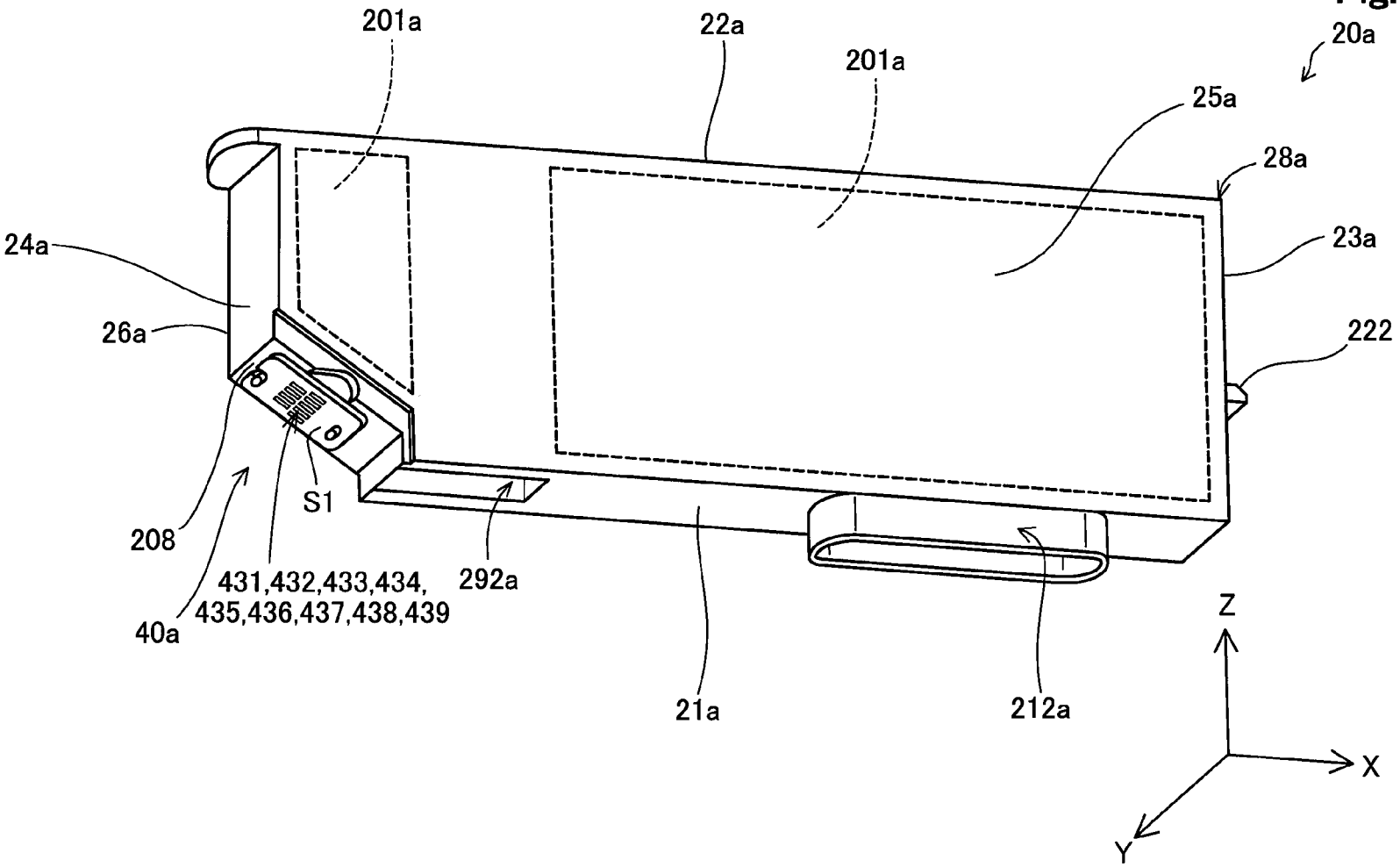
FIG. 20 is a perspective view for illustrating a cartridge according to the second embodiment.
Figure 21:
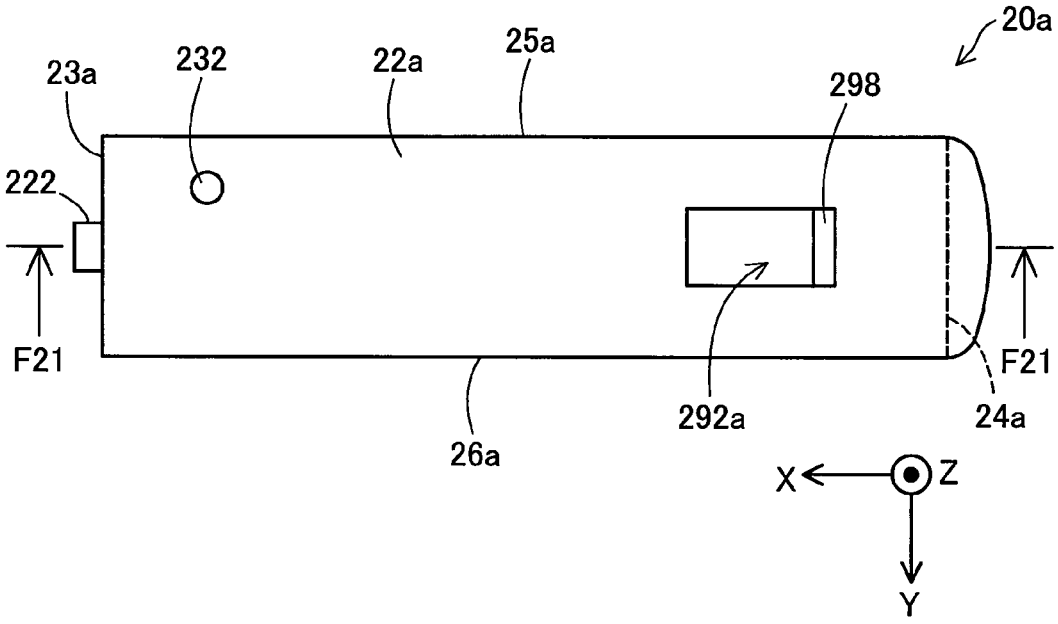
FIG. 21 is a top view for illustrating the cartridge.
Figure 22:
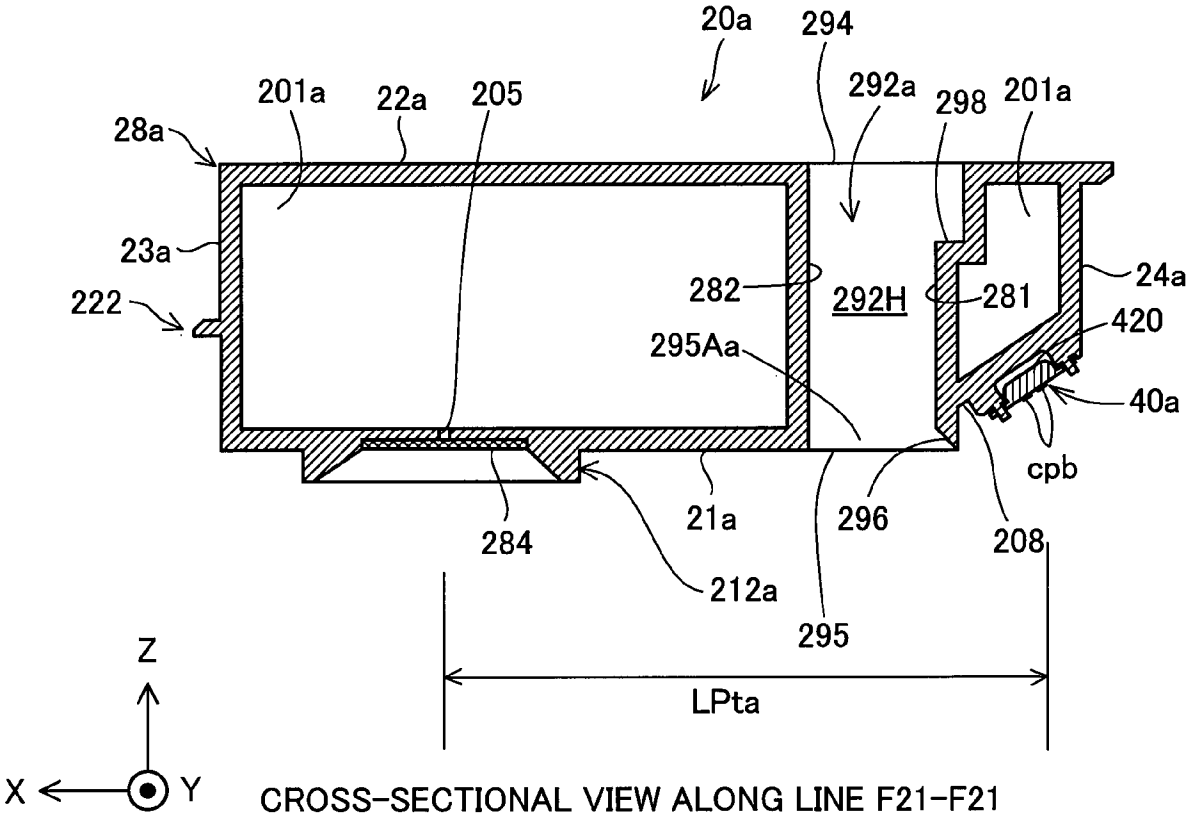
FIG. 22 is a cross-sectional view of the cartridge along the line F21-F21 in FIG. 21.

FIG. 20 is a perspective view for illustrating the cartridge 20*a* according to the second embodiment. FIG. 21 is a top view for illustrating the cartridge 20*a*. FIG. 22 a cross-sectional view of the cartridge 20*a* along the line F21-F21 in FIG. 21. The cartridge 20 (FIG. 7) according to the first embodiment and the cartridge 20*a* according to the second embodiment differ from each other in that an outer shell 28*a* newly includes a connecting wall portion 208, the cartridge 20*a* newly includes a second unit-side restriction portion 222, and that a liquid supply port 212*a* and a receiving portion 292*a* have different configurations. Other configurations are the same as the cartridge 20 according to the first embodiment, and hence like components are denoted by the same reference symbols used in the first embodiment and a description thereof is appropriately omitted.

The cartridge 20*a* (FIG. 20) includes the outer shell 28*a*, a liquid storage portion 201*a*, the liquid supply port 212*a*, the circuit substrate 40, the receiving portion 292*a* and the second unit-side restriction portion 222.

The outer shell 28*a* of the cartridge 20*a* forms an outer surface having a substantially quadrangular cylindrical shape or a substantially cuboid shape. The outer shell 28*a* includes the connecting wall portion 208 in addition to first to sixth wall portions 21*a* to 26*a*. The first to sixth wall portions 21*a* to 26*a* correspond to the first to sixth wall portions 21 to 26 (FIGS. 7,8) according to the cartridge 20 of the first embodiment, respectively. In other words, in the mounting state of the cartridge 20*a*, the first wall portion 21*a* faces the apparatus front wall portion 62*a*. The second wall portion 22*a* is located on the demounting direction side (positive Z-axis direction side) opposing the first wall portion 21*a*. The third wall portion 23*a* intersects with the first wall portion 21*a* and the second wall portion 22*a*. The third wall portion 23*a* forms a back wall in the mounting state of the cartridge 20*a*. The fourth wall portion 24*a* intersects with the first wall portion 21*a* and the second wall portion 22*a*. The fourth wall portion 24*a* also opposes the third wall portion 23*a*. The fourth wall portion 24*a* forms a front wall in the mounting state of the cartridge 20*a*. The fifth wall portion 25*a* forms a right-side wall in the mounting state. The sixth wall portion 26*a* forms a left side wall in the mounting state. The fifth wall portion 25*a* and the sixth wall portion 26*a* oppose each other. The fifth wall portion 25*a* and the sixth wall portion 26*a* each intersect with the first to fourth wall portions 21*a* to 24*a*.

The connecting wall portion 208 connects the first wall portion 21*a* and the fourth wall portion 24*a* to each other. The connecting wall portion 208 includes a surface (inclined surface) inclined toward a direction including a mounting direction (negative Z-axis direction) component and a negative X-axis direction component. The circuit board 40*a* is disposed on the inclined surface. The first wall surface S1 that faces the outside of the arrangement wall portion 49 is inclined in the mounting direction (negative Z-axis direction). More specifically, the first wall surface S1 which is a front surface is inclined in a direction that includes a mounting direction (negative Z-axis direction) component and a negative X-axis direction component. Nine of the unit-side terminals 431 to 439 are provided on the first wall surface S1. The storage device 420 (FIG. 22) is disposed on a second wall surface of the arrangement wall portion 49.

The liquid storage portion 201*a* stores ink to be supplied to the head unit 52. The liquid storage portion 201*a* is defined by the outer shell 28*a*. In other words, the liquid storage portion 201*a* is formed inside the outer shell 28*a*. Air is introduced to the liquid storage portion 201*a* via an air induction port 232 (FIG. 21) formed in the second wall portion 22*a* in accordance with consumption of the ink in the liquid storage portion 201*a*.

The liquid supply port 212*a* (FIG. 22) communicates with the liquid storage portion 201*a* via a communication hole 205 (FIG. 22) formed in the first wall portion 21*a*. The liquid supply port 212*a* can supply ink to the printer 50. The liquid supply port 212*a* is arranged on the first wall portion 21*a*. A foam resin 284 for holding the ink is provided in the liquid supply port 212*a*. The foam resin 284 makes contact with the communication hole 205. In the mounting state of the cartridge 20*a*, the foam resin 284 and a tip portion (positive Z-axis direction side end) of the liquid introducing pipe 622*a* make contact, to thereby achieve a state in which ink can be distributed from the foam resin 284 to the liquid introducing pipe 622*a*.

In the mounting state of the cartridge 20*a*, the receiving portion 292*a* (FIG. 22) extends in the protruding direction (positive Z-axis direction) in which the guide member 70*a* protrudes outward. The receiving portion 292*a* can receive (accept insertion of) the guide member 70. The receiving portion 292 (FIG. 7) according to the first embodiment and the receiving portion 292*a* according to the second embodiment differ from each other in that only one unit-side restriction portion 298 is provided in the second embodiment, and in terms of the configuration of an induction port 295Aa. Other configurations are the same as those according to the first embodiment, and hence like components are denoted by the same reference symbols used in the first embodiment and a description thereof is omitted.

The unit-side restriction portion 298 is a step surface formed on a side surface 281 on the positive X-axis direction side among the side surfaces that define the through hole 292H. The unit-side restriction portion 298 is a flat surface that faces the demounting direction (positive Z-axis direction). The induction port 295Aa has a shape that gradually decreases in opening area orthogonal to a direction (Z-axis direction) in which the receiving portion 292 extends as the induction port 295Aa becomes further away from the first open end 295. In this embodiment, a portion of the side surface 281 located on the first wall portion 21*a* side is inclined such as to be located further inside the receiving portion 292*a* at a distance further away from the first open end 295. This induction port 295Aa allows the guide member 70*a* to be smoothly inserted into the receiving portion 292*a* in the process of mounting the cartridge 20*a*.

The second unit-side restriction portion 222 is a protrusion provided on the third wall portion 23*a*. In the mounting state of the cartridge 20*a*, the second unit-side restriction portion 222 engages with the second apparatus-side restriction portion 640 to restrict the cartridge 20*a* from moving in the demounting direction (positive Z-axis direction).

As illustrated in FIG. 22, the liquid supply port 212*a*, the receiving portion 292*a* and the circuit board 40 have the following positional relationship. The liquid supply port 212 and the circuit board 40 (more specifically, the contact portion cpb) are arranged such as to sandwich the receiving portion 292 in a predetermined direction (X-axis direction). The predetermined direction is both a direction orthogonal to a direction in which the receiving portion 292 extends and a direction in which the third wall portion 23 and the fourth wall portion 24 oppose each other.

At least one part of the receiving portion 292*a* is located between the liquid supply port 212*a* and the circuit board 40 (more specifically, the contact portion cpb) in the predetermined direction (X-axis direction). In this embodiment, the receiving portion 292 is located between the liquid supply port 212*a* and the circuit board 40 in the predetermined direction. In other words, when the cartridge 20 is viewed in plan from the first wall portion 21*a*, a range from the center of the liquid supply port 212*a* to the circuit board 40 (more specifically, the contact portion cpb) in the predetermined direction (X-axis direction) is a range LPta. At this time, at least one part (for example, the unit-side restriction portion 298) of the receiving portion 292*a* is located within the range LPta.

B-3. Aspects of Mounting Cartridge 20*a* onto Holder Unit 61*a*

Figure 23:
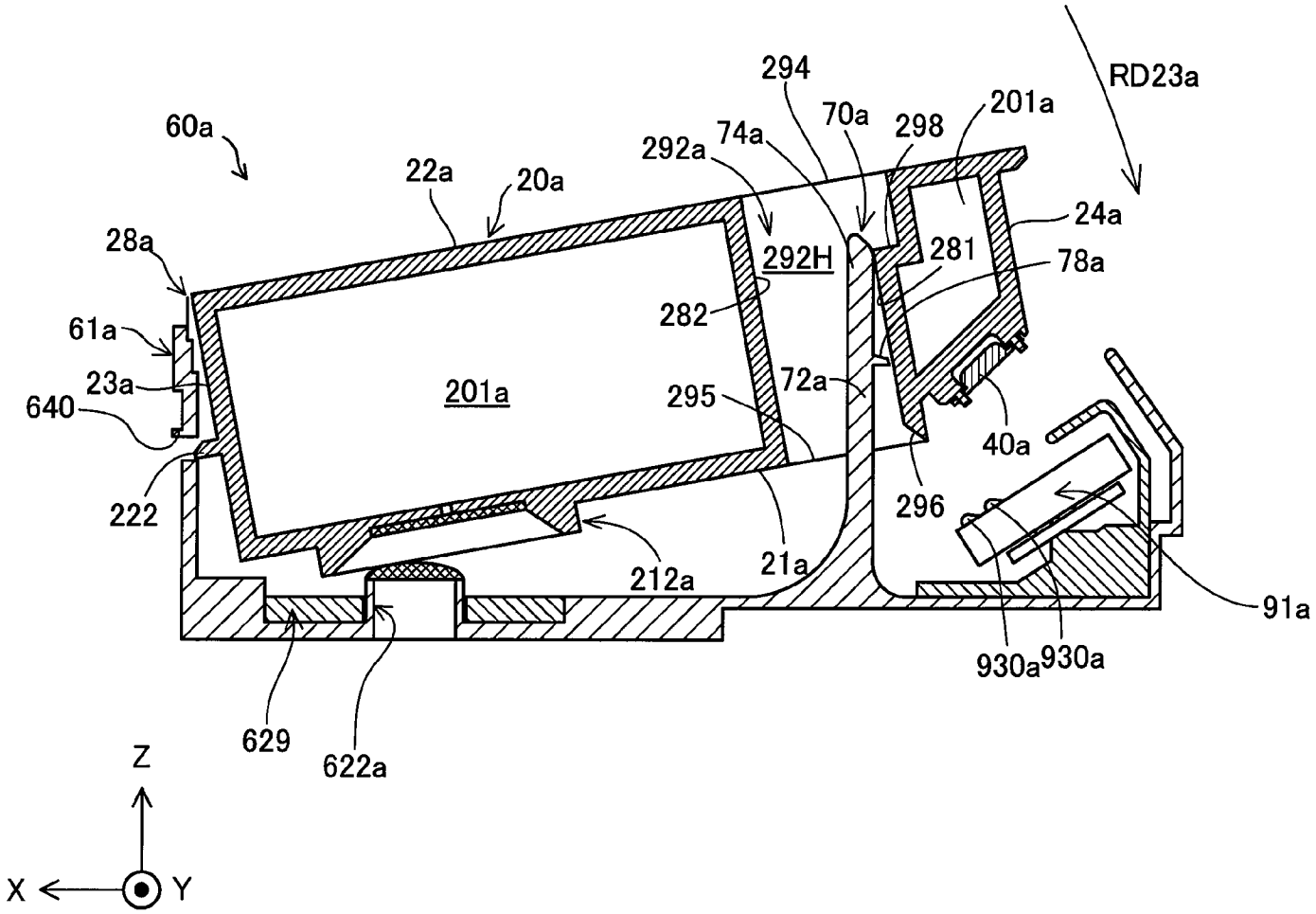
FIG. 23 is a diagram for illustrating a process of mounting the cartridge onto the holder unit.
Figure 24:
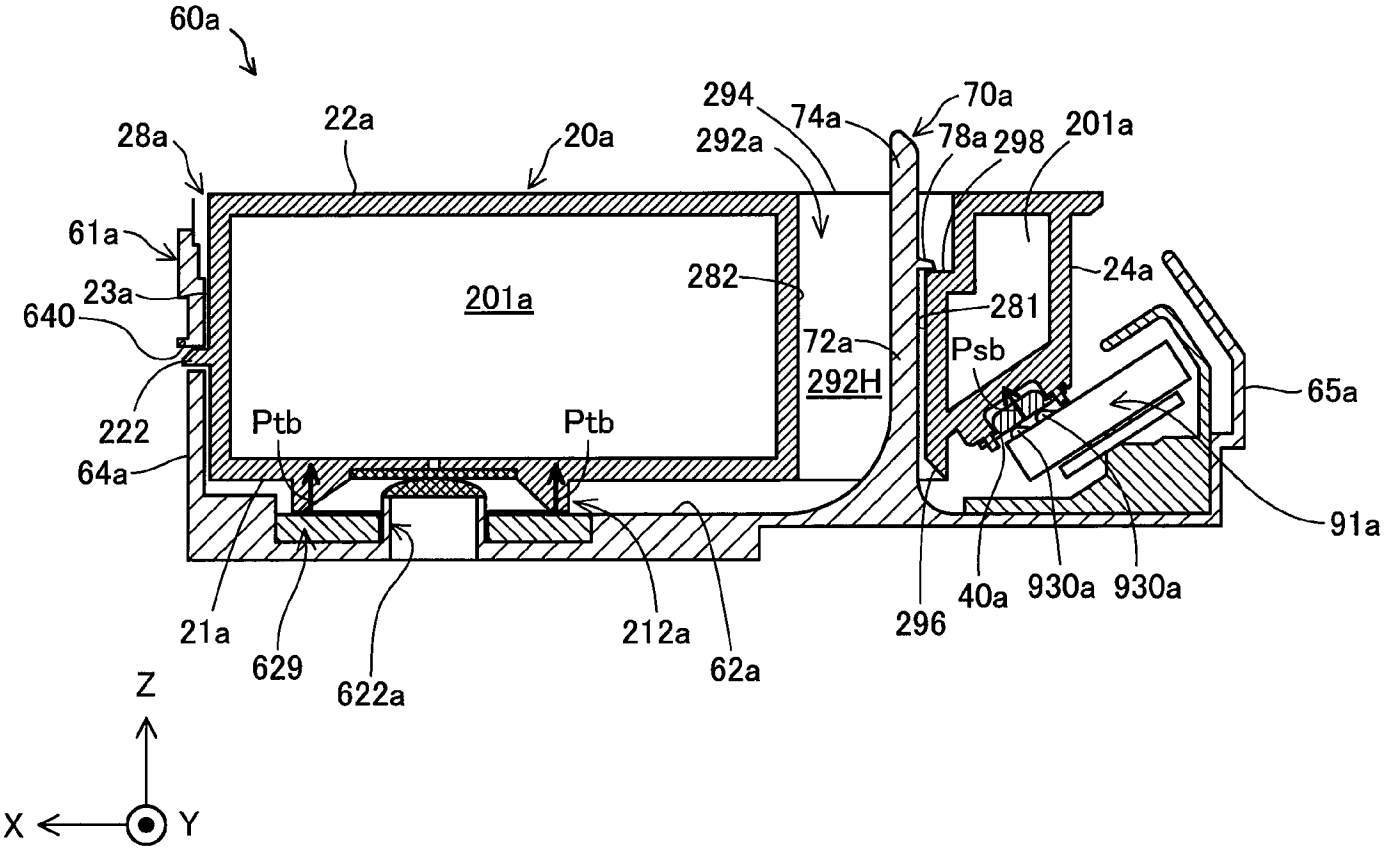
FIG. 24 is a diagram for illustrating a state in which the cartridge is mounted onto the holder unit.
Figure 25:
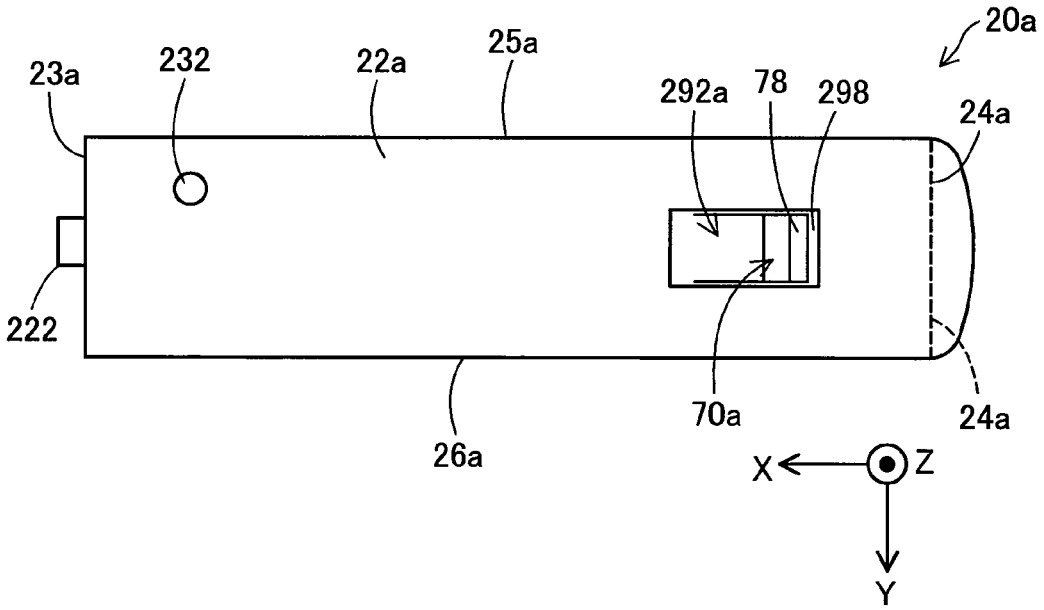
FIG. 25 is a schematic top view for illustrating the cartridge in a mounting state.

FIG. 23 is a diagram for illustrating a process of mounting the cartridge 20*a* onto the holder unit 61*a*. FIG. 24 is a diagram for illustrating a state in which the cartridge 20*a* is mounted onto the holder unit 61*a*. FIG. 25 is a schematic top view for illustrating the cartridge 20*a* in the mounting state.

As illustrated in FIG. 23, when mounting the cartridge 20*a* is to be mounted onto the holder unit 61*a*, the user first inserts the guide member 70*a* into the receiving portion 292*a*. Then, the user inclines the cartridge 20*a* such that the third wall portion 23*a* faces a direction including a mounting direction (negative Z-axis direction) component, and then inserts the second unit-side restriction portion 222 which is a protruded portion into the second apparatus-side restriction portion 640 which is a through hole. Then, the user moves the cartridge 20*a* in the direction indicated by the arrow RD23*a* about the second unit-side restriction portion 222. The cartridge 20*a* moves along the negative Z-axis direction immediately before being mounted.

By further inserting the cartridge 20*a*, the cartridge 20*a* is guided to the mounting position of the holder unit 61*a* while the guide member 70*a* comes into contact with the side surface 281 that defines the through hole 292H.

As illustrated in FIG. 24, in the mounting state of the cartridge 20*a*, the liquid introducing pipe 622*a* becomes completely inserted into the liquid supply port 212*a* and the ink can be distributed from the liquid supply port 212*a* to the liquid introducing pipe 622*a*. A state in which the liquid introducing pipe 622*a* makes contact with the foam resin 284 to allow the ink to be distributed from the liquid supply port 212*a* to the liquid introducing pipe 622*a* is also referred to as a connection state between the liquid supply port 212*a* and the liquid injecting pipe 622*a*. In the mounting state illustrated in FIG. 24, the apparatus-side terminal 931 to 939 and the corresponding first to ninth terminal 431 to 439 make contact with one another, to thereby enable signals to be sent/received between the circuit board 40 and the control unit 510. In the mounting state of the cartridge 20, the end portion 74*a* protrudes outward from the outer shell 28*a* toward the demounting direction (positive Z-axis direction).

In the mounting state of the cartridge 20*a*, the cartridge 20*a* is subjected to the forces Ptb and Psb from the holder unit 61*a*. The force Ptb is a force applied to the liquid supply port 212*a* of the cartridge 20*a* by the elastic member 629. The force Ptb is oriented in the demounting direction (positive Z-axis direction). The force Psb is a force applied to the contact portion cpb of the cartridge 20*a* by the apparatus-side terminal 930*a*. The force Psb is oriented in a direction including a positive X-axis direction component and a positive Z-axis direction component.

A component of the positive X-axis direction component of the force Psb causes the unit-side restriction portion 298 of the cartridge 20*a* to be pushed in a positive X-axis direction (locking direction) in which the unit-side restriction portion 298 engages with the first apparatus-side restriction portion 78*a* and the unit-side restriction portion 298 and the first apparatus-side restriction portion 78*a* to engage with each other. The engagement between the unit-side restriction portion 298 and the first apparatus-side restriction portion 78*a* restricts the fourth wall portion 24*a* side of the cartridge 20*a* from moving in the demounting direction. In addition, in the mounting state of the cartridge 20*a*, engagement between the second unit-side restriction portion 222 and the second apparatus-side restriction portion 640 restricts the third wall portion 23*a* side of the cartridge 20*a* from moving in the demounting direction.

When the cartridge 20*a* is to be demounted from the holder unit 61*a*, the user displaces the end portion 74*a* in a direction (positive X-axis direction) in which engagement between the unit-side restriction portion 298 and the first apparatus-side restriction portion 78*a* releases. With this configuration, the first apparatus-side restriction portion 78*a* moves in the release direction (positive X-axis direction) to release engagement between the unit-side restriction portion 298 and the first apparatus-side restriction portion 78*a*. When this engagement has released, the fourth wall portion 24*a* of the cartridge 20*a* displaces toward the demounting direction due to the forces Ptb and Psb, and the first apparatus-side restriction portion 78*a* becomes located below the unit-side restriction portion 298. In this state, the user moves the cartridge 20*a* in the demounting direction, to thereby demount the cartridge 20*a* from the holder unit 61*a*.

The second embodiment has a similar configuration to that of the first embodiment, and hence achieves a similar effect. For example, according to the second embodiment, the cartridge 20*a* includes the receiving portion 292*a* that can receive the guide member 70*a* between the liquid supply port 212*a* and the contact portion cpb, and hence the cartridge 20*a* can easily be moved to the mounting position of the printer 50. In addition, the receiving portion 292*a* is located between the liquid supply port 212*a* and the contact portion cpb in the predetermined direction, and hence the liquid supply port 212*a* can easily be moved toward the liquid introducing pipe 622*a* and the contact portion cpb can easily be moved toward the apparatus-side terminal 930. As described above, according to this aspect, the cartridge 20*a* can be mounted more reliably. In addition, for example, according to the second embodiment, the unit-side restriction portion 298 and the second unit-side restriction portion 222 can restrict the cartridge 20*a* from moving in the demounting direction in the mounting state of the cartridge 20*a*. With this configuration, the possibility of the cartridge 20*a* coming away from the holder unit 61*a* in the mounting state of the cartridge 20*a* can be reduced. In addition, the unit-side restriction portion 298 restricts the cartridge 20*a* from moving toward the demounting direction at a position between the liquid supply port 212*a* and the contact portion cpb in the predetermined direction (X-axis direction), and hence the possibility of the liquid supply port 212*a* coming away from the liquid introducing pipe 622*a* and the possibility of the contact portion cpb separating from the apparatus-side terminal 930 can be reduced.

C. Third Embodiment

C-1. Configuration of Liquid Ejection System

Figure 26:
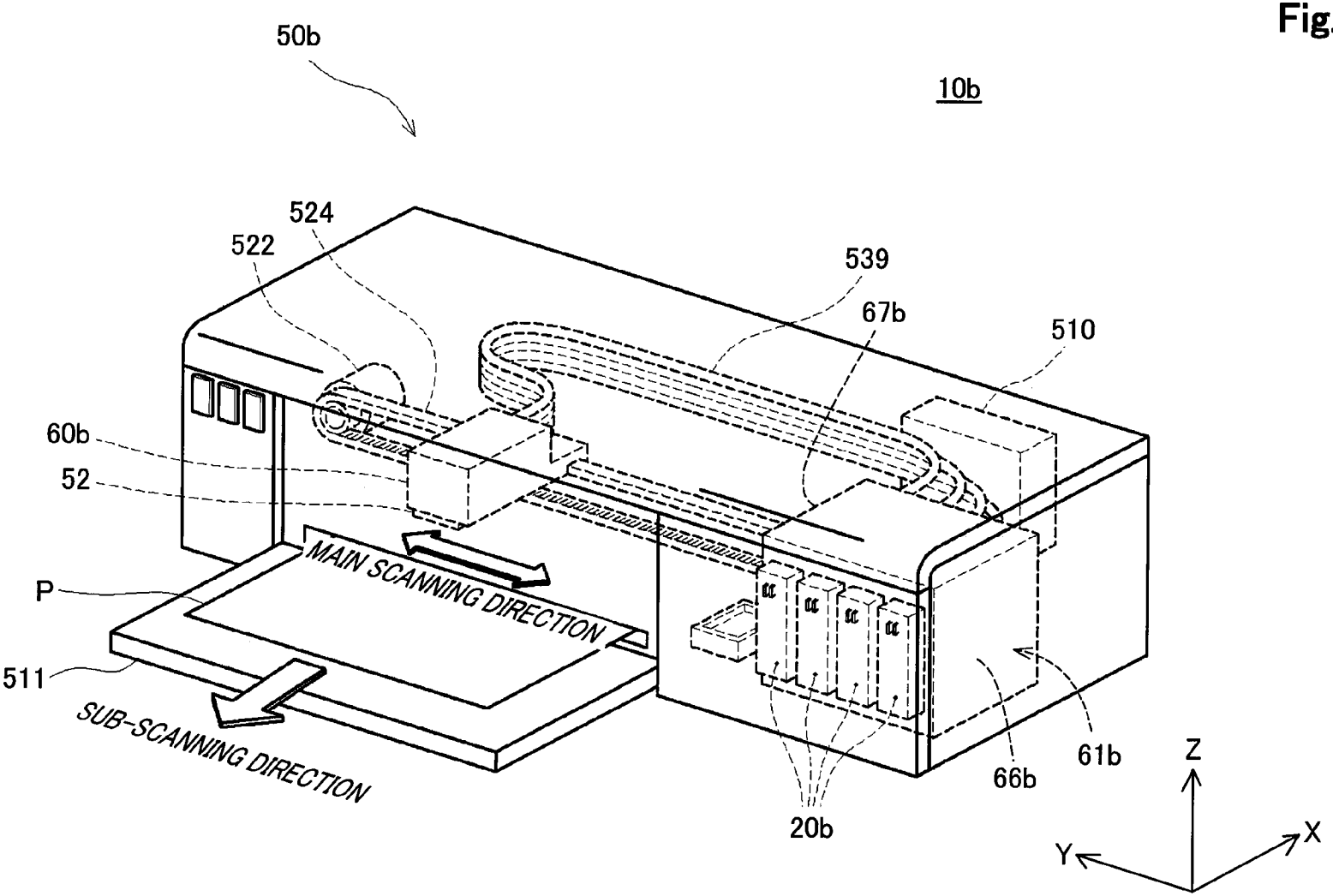
FIG. 26 is a perspective view for illustrating a configuration of a liquid ejection system as a third embodiment.

FIG. 26 is a perspective view for illustrating a configuration of a liquid ejection system 10*b* as a third embodiment of the present invention. A printer 50*b* according to the third embodiment is an off-carriage printer and differs from the liquid ejection system 10 according to the first embodiment in that the printer 50*b* includes a component for achieving an off-carriage structure, a detailed configuration of a cartridge 20*b* is different, the mounting direction and the demounting direction of the cartridge 20*b* are parallel directions, and there are four types of ejectable ink. Other configurations of the printer 50*b* are the same as those of the printer 50, and hence like components are denoted by the same reference symbols used in the first embodiment and a description thereof is omitted. In FIG. 26, some components such as the transfer rod 529 and the platen 534 illustrated in FIG. 1 are not shown.

As a component for achieving an off-carriage structure, the printer 50*b* includes a holder unit 61*b* in place of the holder unit 61. The printer 50*b* also includes a carriage unit 60*b* in place of the carriage unit 60. The carriage unit 60*b* differs from the carriage unit 60 according to the first embodiment in that the carriage unit 60*b* does not include the holder unit 61*b* and is connected to a tube 539 to be described later. In the third embodiment, the holder unit 61*b* is not mounted on top of the head unit 52 and is instead fixed to a casing of the printer 50*b*. The holder unit 61*b* and the carriage unit 60*b* are connected to one another by a plurality of the tubes 539. One tube is prepared for each color of ink. A pumping mechanism (not shown) of the printer 50*b* sucks in the ink inside the cartridge 20*b* and supplies that ink to the carriage unit 60*b*. The holder unit 61*b* is configured such that four cartridges 20*b* can be mounted thereto.

Figure 27:
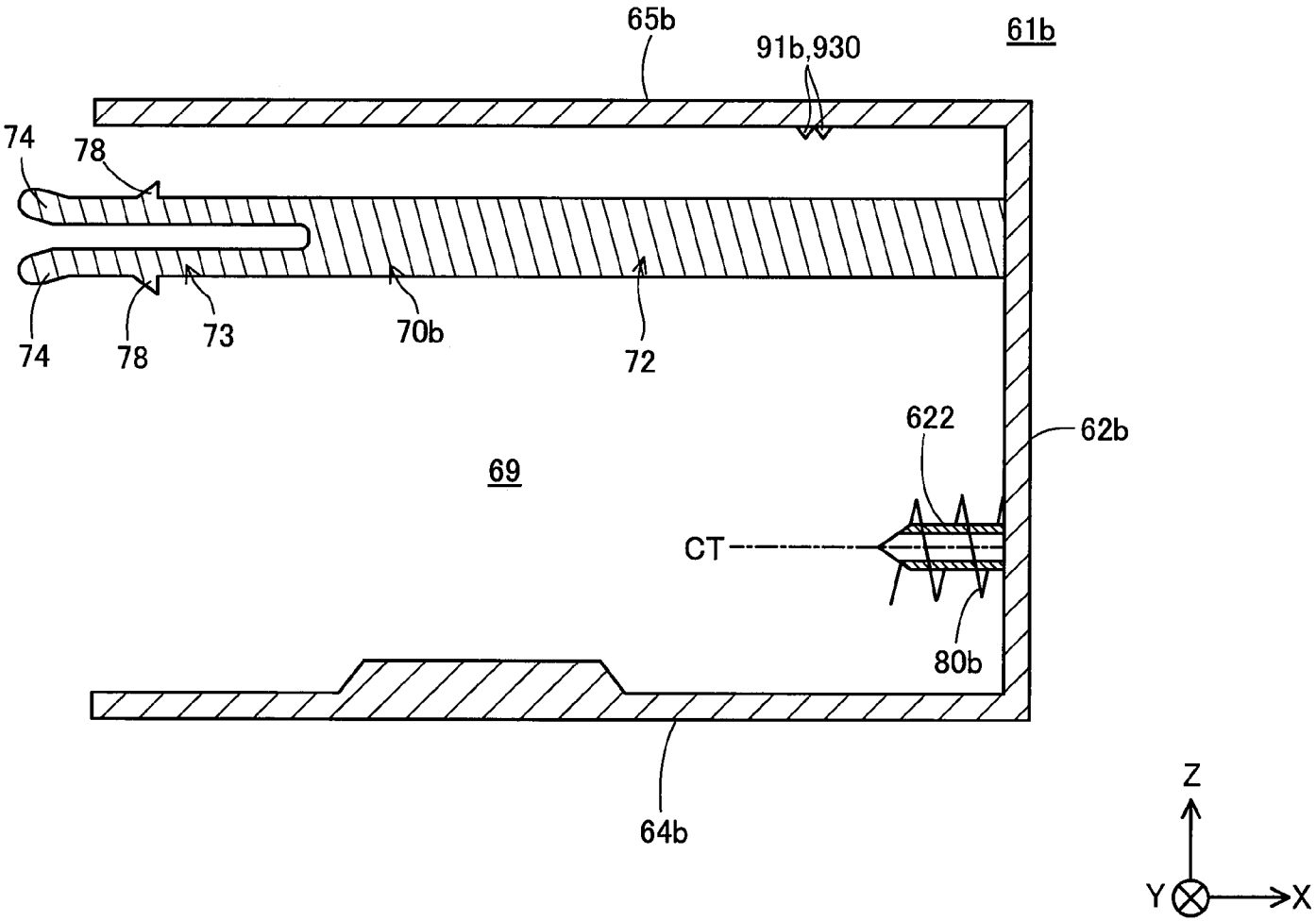
FIG. 27 is a diagram for explaining the holder unit.

FIG. 27 is a diagram for explaining the holder unit 61*b*. The holder unit 61*b* includes five wall portions 62*b*, 64*b*, 65*b*, 66*b*, 67*b* (FIGS. 26 and 27). These five wall portions 62*b*, 64*b*, 65*b*, 66*b*, 67*b* correspond to the five wall portions 62, 64, 65, 66, 67 according to the first embodiment. In other words, the wall portion 62*b* is located on the mounting direction (positive X-axis direction) side. In the third embodiment, the wall portion 64*b* forms a bottom wall of the holder unit 61*b*. The four wall portions 64*b*, 65*b*, 66*b*, 67*b* extend from a peripheral position of the wall portion 62*b* in the negative X-axis direction (demounting direction). The five wall portions 62*b*, 64*b*, 65*b*, 66*b*, 67*b* form the concave cartridge storage chamber 69. The cartridge storage chamber 69 is divided into a plurality of slots (mounting spaces) that can each receive one of the cartridges 20*b*.

The wall portion 62*b* is also referred to as "apparatus front wall portion 62*b*," the wall portion 64*b* is also referred to as "first side wall portion 64*b*," wall portion 65*b* is also referred to as "second side wall portion 65*b*," the wall portion 66*b* is also referred to as "third side wall portion 66*b*," and the wall portion 67*b* is also referred to as "fourth side wall portion 67*b*."

For each slot, the holder unit 61*b* includes the liquid injecting needle 622 as a liquid introducing portion, a guide member 70*b* and an electrode unit 91*b*. The liquid injecting needle 622 protrudes outward from the apparatus front wall portion 62*b*. The protruding direction of the liquid injecting needle 622 differs from the first embodiment and is a negative X-axis direction. In addition, a direction in which the central axis CT of the liquid injecting needle 622 extends is the X-axis direction. The electrode unit 91*b* is provided on a second side wall portion 65*b* that forms an upper wall. The electrode unit 91*b* includes a plurality of (in this embodiment, nine) apparatus-side terminals 930. The apparatus-side terminals 930 bias the cartridge 20*b* toward the negative Z-axis direction in the mounting state of the cartridge 20*b*.

The holder unit 61*b* is disposed in the vicinity of the liquid injecting needle 622 and includes a biasing member 80*b* (for example, a coil spring) for biasing the cartridge 20*b* in the demounting direction in the mounting state of the cartridge 20*b*.

The guide member 70*b* protrudes outward from the apparatus front wall portion 62*b* on the same side as the protruding direction of the liquid injecting needle 622. In this embodiment, the direction in which the guide member 70*b* protrudes outward is the same direction as the protruding direction (negative X-axis direction) of the liquid injecting needle 622. The guide member 70*b* has a configuration in which the guide member 70 (FIG. 3) according to the first embodiment has been rotated so as to extend in a horizontal direction. The guide member 70*b* includes the body portion 72, the elastically deforming portion 73 and the apparatus-side restriction portion 78, similar to the guide member 70 according to the first embodiment.

The liquid injecting needle 622, the guide member 70*b* and the electrode unit 91*b* have the following positional relationship. The liquid injecting needle 622 and the electrode unit 91*b* (more specifically, the apparatus-side terminal 930) are arranged so as to sandwich the guide member 70*b* in a predetermined direction (Z-axis direction).

C-2. Configuration of Cartridge 20*b*

Figure 28:
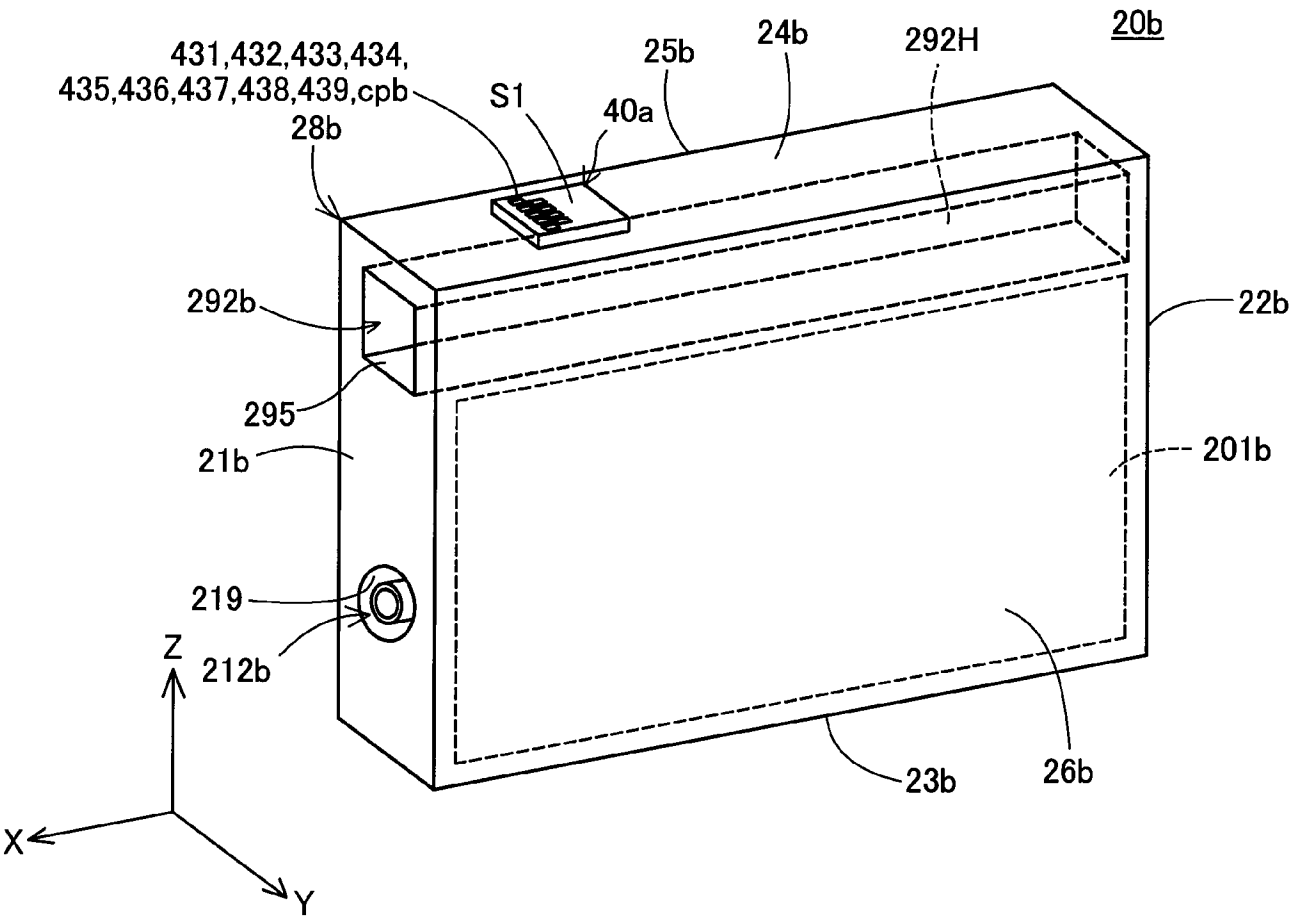
FIG. 28 is a perspective view for illustrating the cartridge.

FIG. 28 is a perspective view for illustrating the cartridge 20*b*. FIG. 28 is a schematic view for primarily explaining the internal configuration of the cartridge 20*b*. The cartridge 20*b* includes an outer shell 28*b*, a liquid storage portion 201*b*, a circuit board 40*a*, a liquid supply port 212*b* and a receiving portion 292*b*. The liquid storage portion 201*a* is a bag member stored in the outer shell 28*a*. The ink is filled into this bag member.

The outer shell 28*b* forms an outer surface having a substantially quadrangular cylindrical shape or a substantially cuboid shape. As in the first embodiment, the outer shell 28*b* includes first to sixth wall portions 21*b* to 26*b*. The first to sixth wall portions 21*b* to 26*b* correspond to the first to sixth wall portions 21 to 26 (FIGS. 7 and 8) according to the first embodiment, respectively. In other words, the first wall portion 21*b* faces the apparatus front wall portion 62*b* in the mounting state of the cartridge 20*b*. The second wall portion 22*b* opposes the first wall portion 21*b* and is located on the demounting direction (negative X-axis direction) side. The third wall portion 23*b* and the fourth wall portion 24*b* intersect with the first wall portion 21*b* and the second wall portion 22*b*. The third wall portion 23*b* forms a bottom surface in the mounting state of the cartridge 20*b*. The fourth wall portion 24*b* forms an upper surface in the mounting state of the cartridge 20*b*. The fourth wall portion 24*b* opposes the third wall portion 23*b* and the predetermined direction (Z-axis direction). The fifth wall portion 25*b* and the sixth wall portion 26*b* intersect with the first to fourth wall portions 21*b* to 24*b*. The fifth wall portion 25*b* and the sixth wall portion 26*b* oppose each other.

A supply unit arrangement port 219 used to arrange the liquid supply port 212*b* is formed in the first wall portion 21*b*.

The liquid supply port 212*b* can connect with the liquid injecting needle 622 (FIG. 27). The liquid supply port 212*b* communicates with the liquid storage portion 201*b*. The liquid supply port 212*b* is arranged in the supply unit arrangement port 219. As in the first embodiment, the valve mechanism 29 (FIG. 7) is provided inside the liquid supply port 212*b*. This valve mechanism 29 may be omitted.

The circuit board 40*a* is arranged on the fourth wall portion 24*b*. A normal vector of the first wall surface S1 of the circuit board 40*a* is the positive Z-axis direction. A plurality of the unit-side terminals 431 to 439 are provided on the first wall surface S1 of the circuit board 40*a*. The configuration of the circuit board 40*a* is the same as that of the circuit board 40*a* (FIG. 20) according to the second embodiment. In other words, the unit-side terminals 431 to 439 are disposed on the first wall surface S1 which is a front surface of the arrangement wall portion 49, and the storage device 420 is disposed on the second wall surface S2 which is a rear surface of the arrangement wall portion 49.

The receiving portion 292*b* extends in a direction (negative X-axis direction) in which the guide member 70*b* (FIG. 27) protrudes outward in the mounting state of the cartridge 20*b*. The receiving portion 292*b* can receive (accept insertion of) the guide member 70*b*. The receiving portion 292*b* has a configuration in which the receiving portion 292 (FIG. 7) according to the first embodiment has been rotated so as to extend in a horizontal direction (mounting direction). The receiving portion 292*b* forms a through hole 292H that extends across the second wall portion 22*b* from the first wall portion 21*b*. The receiving portion 292*b* has a unit-side restriction portion (not shown), similar to the first embodiment.

At least a part of the receiving portion 292 is located between the liquid supply port 212*b* and the circuit board 40 (more specifically, the contact portion cpb) in the predetermined direction (Z-axis direction). In this embodiment, the receiving portion 292 is located between the liquid supply port 212 and the circuit board 40 in the predetermined direction (Z-axis direction).

When the cartridge 20*b* is to be mounted onto the holder unit 61*b*, the user places the cartridge 20*b* at a position at which the end portion 74 of the guide member 70*b* can be inserted into the first open end 295 of the receiving portion 292*b*, using the guide member 70*b* as a target. The user then cartridge 20*b* moves the in the mounting direction (positive X-axis direction), to thereby insert the guide member 70*b* further into the receiving portion 292*b*. With this configuration, the cartridge 20*b* is guided to the mounting position.

Figure 29:
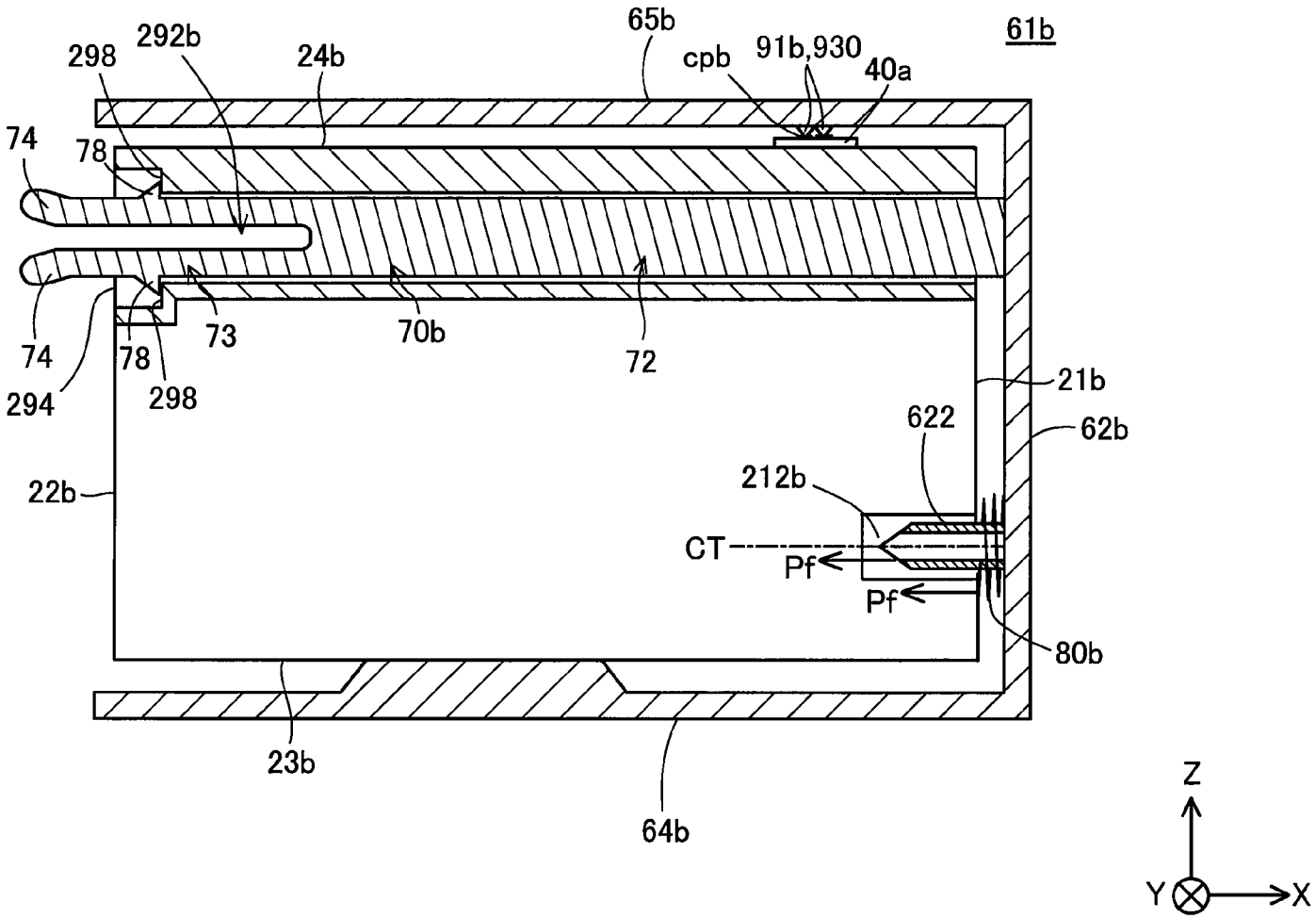
FIG. 29 is a schematic view for illustrating a mounting state of the cartridge.

FIG. 29 is a schematic view for illustrating a mounting state of the cartridge 20*b*. In the mounting state, the liquid injecting needle 622 becomes completely inserted into the liquid supply port 212*b* and the ink can be distributed from the liquid supply port 212*b* to the liquid injecting needle 622. In the mounting state illustrated in FIG. 29, the apparatus-side terminal 930 and the corresponding first to ninth terminals 431 to 439 make contact with one another, to thereby enable electronic signals to be sent/received between the circuit board 40 and the control unit 510. In the mounting state of the cartridge 20, a portion of the elastically deforming portion 73 that includes two end portions 74A and 74B protrudes outward from the outer shell 28*b* toward the demounting direction (negative X-axis direction).

In the mounting state of the cartridge 20*b*, the biasing member 29C (FIG. 7) and the biasing member 80*b* apply the force Pf in the demounting direction (negative X-axis direction) to the outer shell 28. Due to this force Pf, the cartridge 20*b* attempts to move in the demounting direction, but engagement between the unit-side restriction portion 298 and the apparatus-side restriction portion 78 restricts the cartridge 20 from moving in the demounting direction.

When the cartridge 20*b* is to be demounted from the holder unit 61*b*, similar to the first embodiment, the user operates the elastically deforming portion 73 to displace the apparatus-side restriction portion 78, to thereby release engagement between the apparatus-side restriction portion 78 and the unit-side restriction portion 298. When engagement between the apparatus-side restriction portion 78 and the unit-side restriction portion 298 is released, the force Pf facing the demounting direction applied to the outer shell 28*b* causes the outer shell 28 to displace toward the demounting direction to cause a state in which the unit-side restriction portion 298 is displaced from the position of engagement with the apparatus-side restriction portion 78. In this state, the user moves the cartridge 20*b*, to thereby demount the cartridge 20*b* from the holder unit 61*b*.

The third embodiment has a similar configuration to that of the first embodiment, and hence achieves a similar effect. For example, according to the third embodiment, the cartridge 20*b* includes the receiving portion 292*b* that can receive the guide member 70*b* between the liquid supply port 212*b* and the contact portion cpb, and hence the cartridge 20*b* can easily be moved to the mounting position of the printer 50*b*. In addition, because the receiving portion 292*b* is located between the liquid supply port 212*b* and the contact portion cpb in the predetermined direction, the liquid supply port 212*b* can easily be moved toward the liquid introducing needle 622, and the contact portion cpb can easily be moved toward the apparatus-side terminal 930. As described above, according to this aspect, the cartridge 20*b* can be mounted more reliably. For example, according to the third embodiment, the unit-side restriction portion 298 can restrict the cartridge 20*b* from moving in the demounting direction in the mounting state of the cartridge 20*b*. With this configuration, the possibility of the cartridge 20*b* demounting from the holder unit 61*b* in the mounting state of the cartridge 20*b* can be reduced. In addition, the unit-side restriction portion 298 restricts the movement of the cartridge 20*b* in the demounting direction at a position between the liquid supply port 212*b* and the contact portion cpb in the predetermined direction (Z-axis direction), and hence the possibility of the liquid supply port 212*b* coming away from the liquid introducing needle 622 and the possibility of the contact portion cpb separating from the apparatus-side terminal 930 can be reduced.

D. Modification Examples

The present invention is not limited to the above-described examples and embodiments and may be embodied in various forms without departing from the spirit and scope thereof. For example, the present invention can be modified in the following ways.

D-1. First Modification Example

In the above-described embodiments, the receiving portion 292, 292*a*, 292*b* is not limited to the above-described configuration provided that the receiving portion 292, 292*a*, 292*b* extends in the protruding direction in which the guide member 70, 70*a*, 70*b* protrudes outward and can accept the guide member 70, 70*a*, 70*b*. A modified example taking the cartridge according to the first embodiment as an example is described below.

Figure 30:
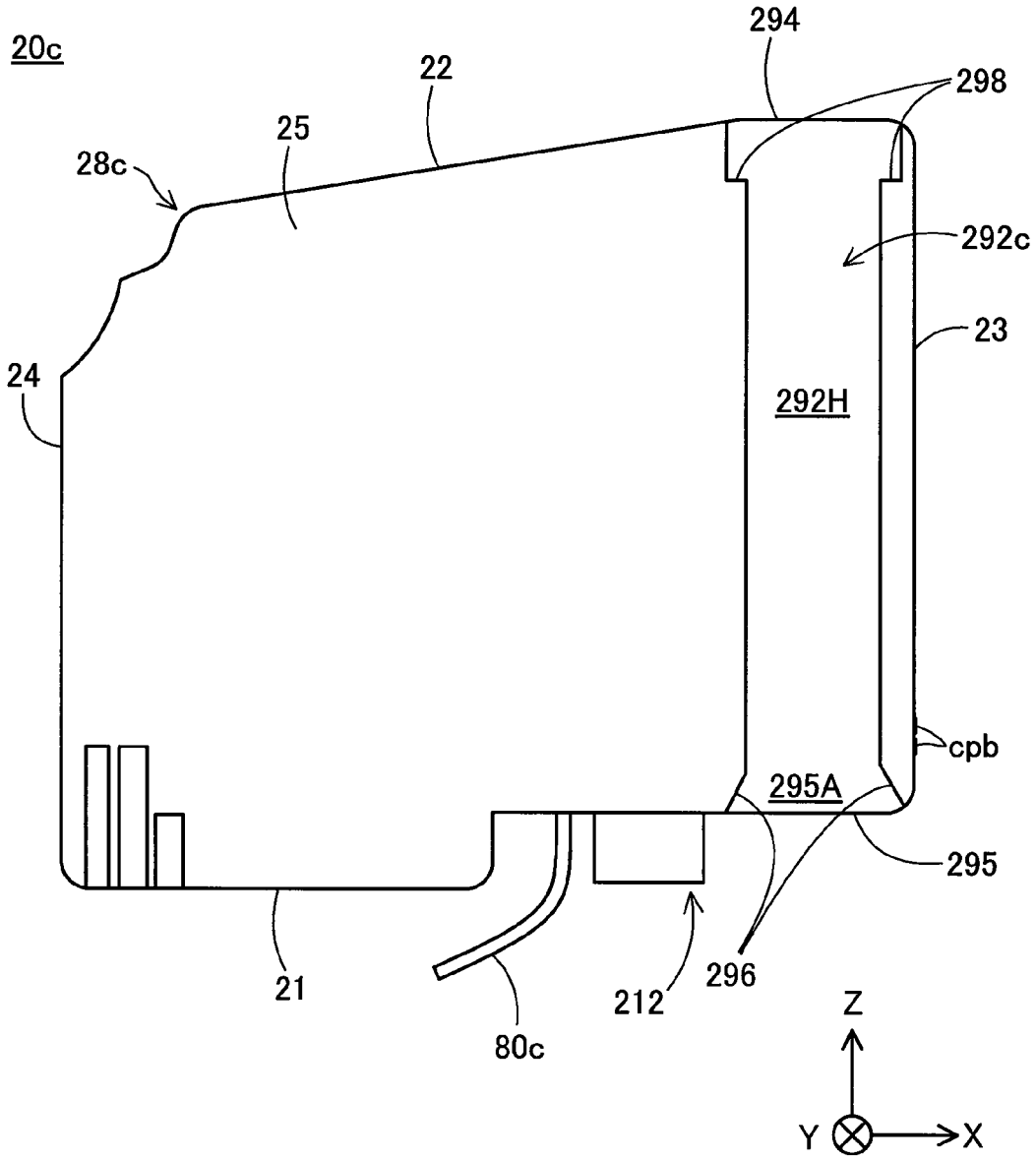
FIG. 30 is a right-side view for illustrating a cartridge according to a first modification example.
Figure 31:
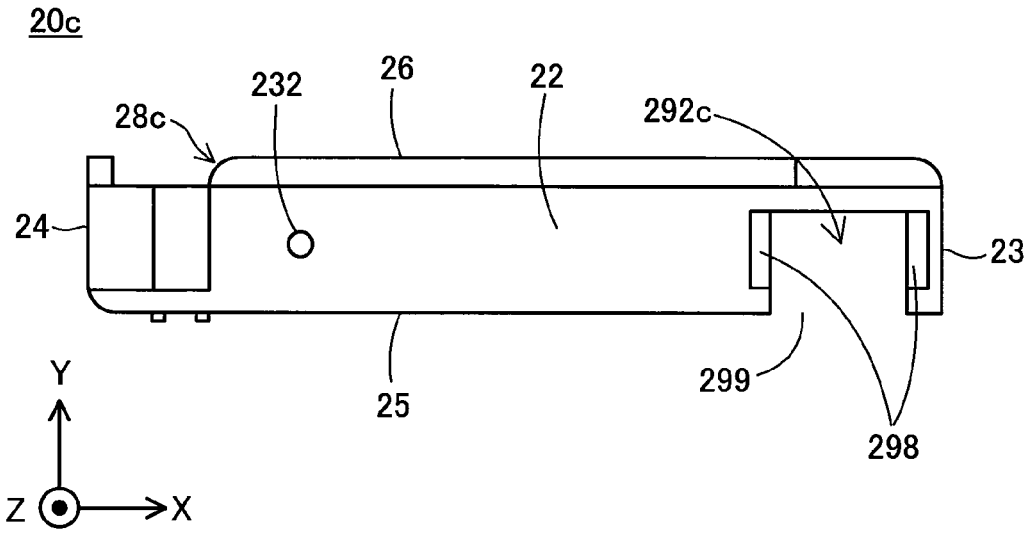
FIG. 31 is a top view for illustrating the cartridge according to the first modification example.
Figure 32:
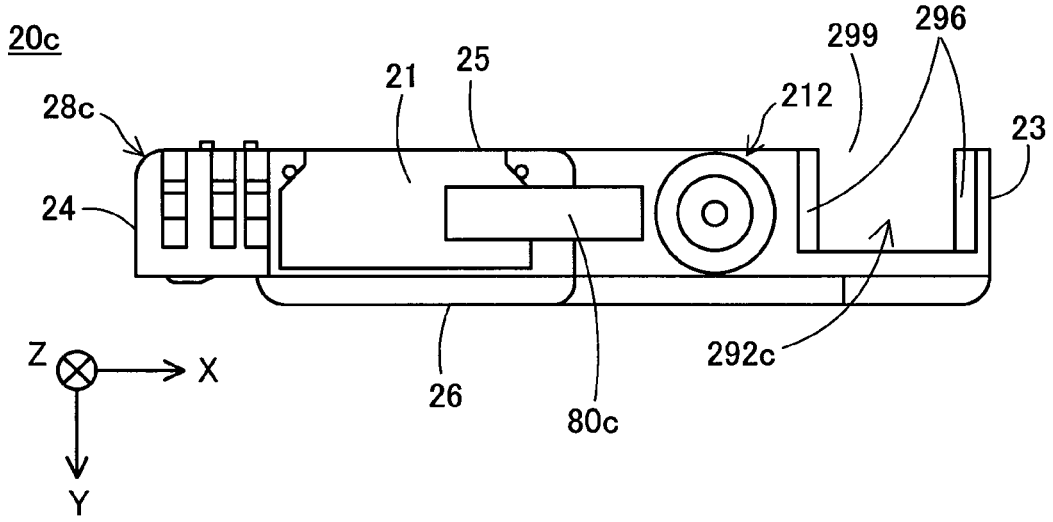
FIG. 32 is a bottom view for illustrating the cartridge according to the first modification example.
Figure 33:
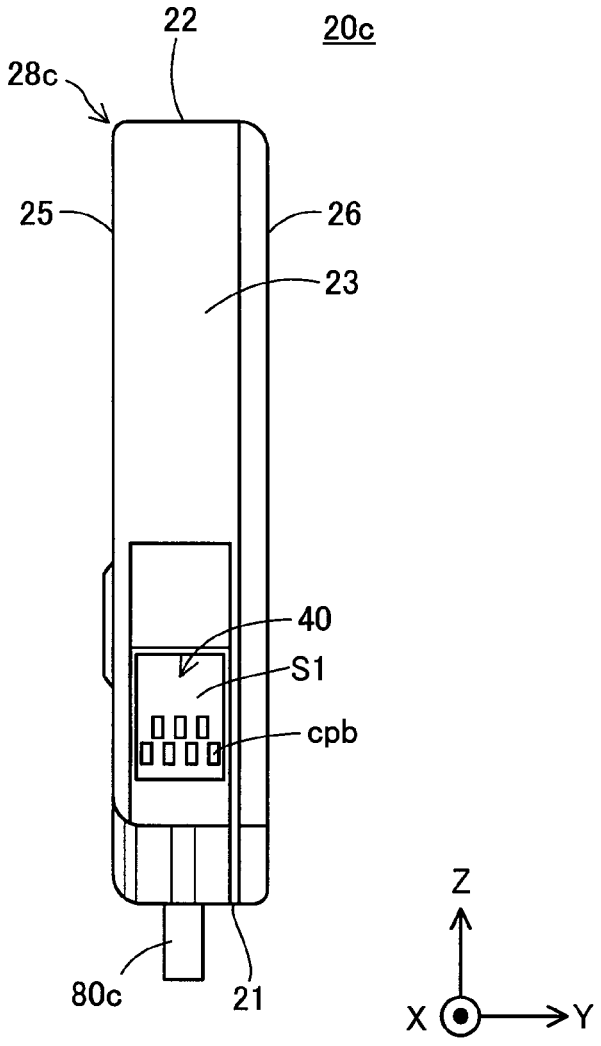
FIG. 33 is a rear view for illustrating the cartridge according to the first modification example.

FIG. 30 is a right-side view for illustrating a cartridge 20*c* according to a first modification example. FIG. 31 is a top view for illustrating the cartridge 20*c* according to the first modification example. FIG. 32 is a bottom view for illustrating the cartridge 20*c* according to the first modification example. FIG. 33 is a back view for illustrating the cartridge 20*c* according to the first modification example.

The cartridge 20*c* according to the first modification example and the cartridge 20 according to the first embodiment differ from each other in terms of the configuration of a receiving portion 292*c* and the configuration of a biasing member 80*c*. Other configurations are the same as those of the cartridge 20 according to the first embodiment, and hence like components are denoted by the same reference symbols used for the cartridge 20 according to the first embodiment and a description thereof is omitted.

The receiving portion 292*c* includes an opening portion 299 (FIG. 31) formed in the fifth wall portion 25. In other words, the receiving portion 292 has a groove shape that opens in three directions of the mounting direction side (negative Z axis direction side), the demounting direction side (positive Z axial direction side), and the direction side orthogonal to the mounting direction (negative Y axis direction side).

The biasing member 80*c* is a leaf spring. The biasing member 80*c* is disposed on the first wall portion 21. The biasing member 80*c* is located on a side opposite to the receiving portion 292*c* sandwiching the liquid supply port 212 in the predetermined direction (X-axis direction). Similar to the biasing member 80 according to the first embodiment, in the mounting state of the cartridge 20*c*, the biasing member 80*c* generates a force (biasing force) for moving the outer shell 28*c* in a direction (demounting direction) opposite to the mounting direction of mounting the cartridge 20*c* onto the printer 50.

The cartridge according to the first modification example also achieves a similar effect to that of the first embodiment. For example, the cartridge includes the receiving portion 292 that can receive the guide member 70 between the liquid supply port 212 and the contact portion cpb (FIG. 30). With this configuration, the cartridge 20*c* can easily be moved to the mounting position of the cartridge 20*c* in the printer 50.

Figure 34A:
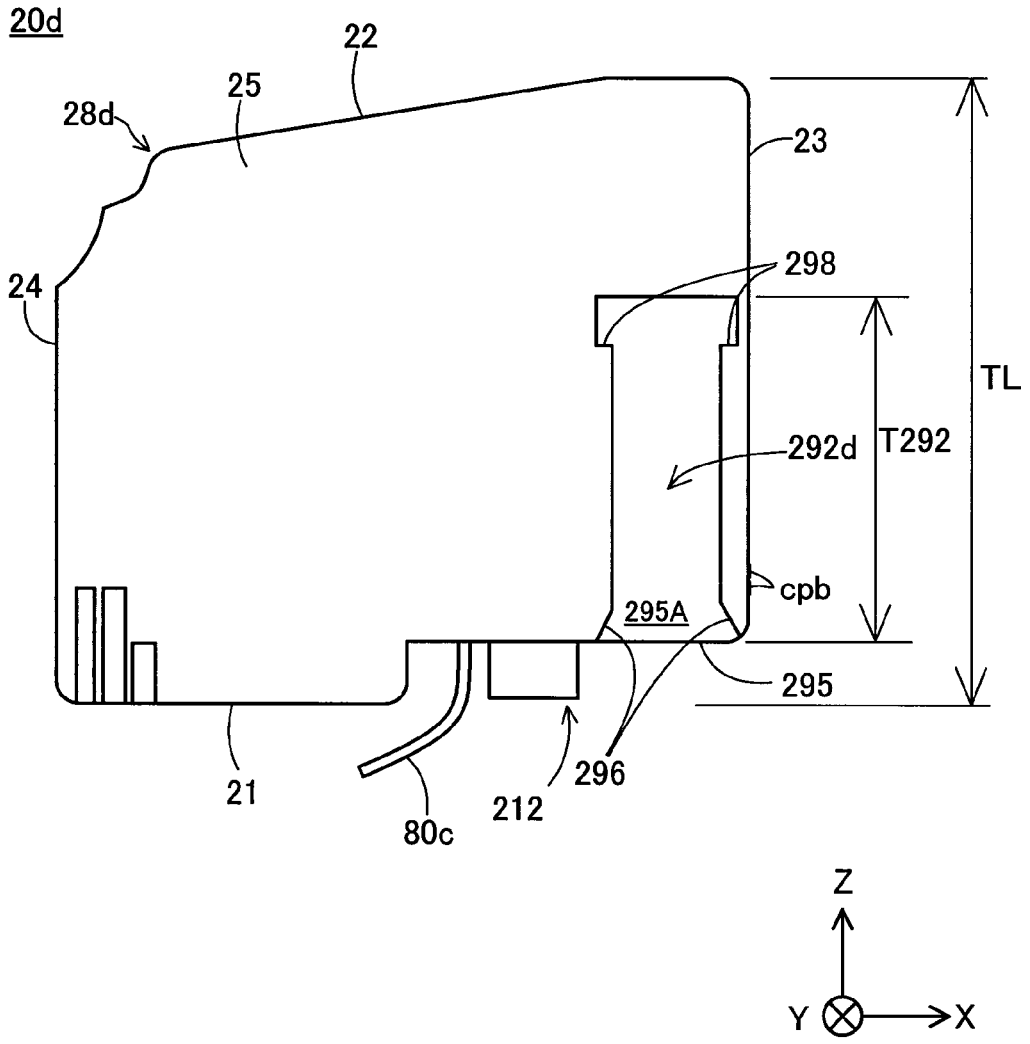
FIG. 34A is a diagram for explaining an example in which a receiving portion is a concave portion.

In the above-described embodiments, the receiving portions 292 to 292*c* do not need to have a shape that penetrates the outer shell 28 to 28*c* along the mounting direction and may be, for example, a concave portion that extends from the first open end 295 in the demounting direction. If the receiving portion 292 to 292*c* is a concave portion, the length of the receiving portion 292 to 292*c* in the mounting direction is preferably more than half, more preferably more than three-quarters of the total length of the cartridge 20 to 20*c* (for example, the outer shell 28 to 28*c*) in the mounting direction. In other words, the length of the receiving portion 292 to 292*c* in the mounting direction is preferably more than half, more preferably more than three-quarters of the length of the cartridge 20 to 20*c* (for example, outer shell 28 to 28*c*) in the mounting direction, particularly preferably the same length as the cartridge 20 to 20*c* in the mounting direction. Even if the receiving portion 292 to 292*c* does not penetrate the cartridge 20 to 20*c* in the mounting direction, at least half of the period from the start to the end of the mounting operation of the cartridge 20 to 20*c* can be guided by the guide member 70 to 70*b*, provided that the length of the receiving portion 292 to 292*c* is more than half the length of the cartridge in the mounting direction. Therefore, if the length of the receiving portion 292 to 292*c* is at least half the length of the cartridge in the mounting direction, the cartridge can be mounted more reliably. FIG. 34A is a diagram for explaining an example in which the receiving portion 292*d* is a concave portion. The cartridge 20*d* illustrated in FIG. 34A is an example in which the receiving portion 292*c*, which is a through hole of the cartridge 20*c* according to the first modification example has been modified as a concave portion as one example of the concave portion. As illustrated in FIG. 34A, in the mounting direction, a length T292 of a concave portion 292*d* of the cartridge 20*d* has a length that is at least half of a total length TL of the outer shell 28*d*.

The unit-side restriction portion 298 may be omitted. If the unit-side restriction portion 298 is omitted, the cartridge 20 to 20*c* preferably includes a cartridge-side restriction portion 298 at a portion different to the receiving portion 292*c*.

In the above-described embodiments, the through hole 292H has a cross-sectional shape parallel to the XY-plane, but this shape may a different shape such as circular or rectangular.

D-2. Second Modification Example

Figure 34B:
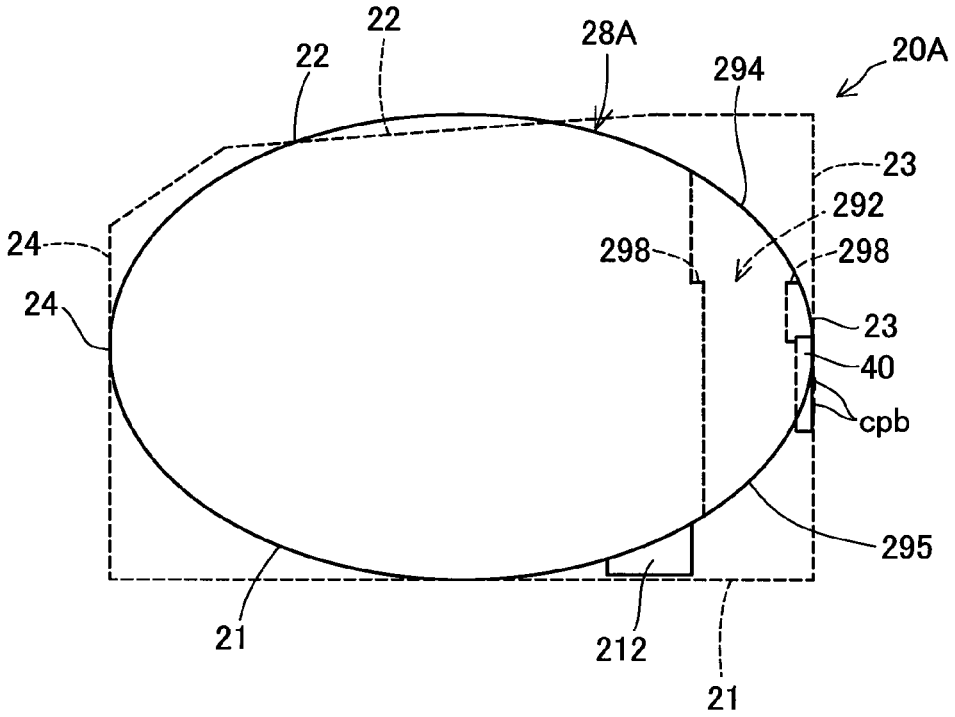
FIG. 34B is a conceptual diagram for illustrating a modification example of the shape of the cartridge.

FIG. 34B is a conceptual view for illustrating a modified example of the shape of the cartridge. FIG. 34B shows a modification example of the cartridge 20 (FIG. 7) according to the first embodiment as one example. In the first to third embodiments, the outer shell 28, 28*a*, 28*b* of the cartridge 20, 20*a*, 20*b* has a substantially cuboid shape (FIGS. 4, 20 and 29), but the shape of the outer shell 28, 28*a*, 20*b* is not limited thereto and may be another shape provided that the outer shell 28, 28*a*, 28*b* can be mounted onto the corresponding holder unit 61, 61*a*, 61*b*. In FIG. 34B, the outer shell according to the first embodiment is indicated by the broken line.

For example, as illustrated in FIG. 34B, an outer shell 28A has an elliptic or rectangular side surface and, when a cartridge 20A is viewed from the front (left side of FIG. 34B), has a constant width. The liquid supply port 212 is arranged on the first wall portion 21 of the outer shell 28A that faces the apparatus front wall portion 62. In the predetermined direction (X-axis direction), the receiving portion 292 is located between the liquid supply port 212 and the contact portion cpb.

As described above, the shape of the outer shell 28, 28*a*, 28*b* is not limited to that according to the above-described first to third embodiments, provided that compatibility with the cartridge 20, 20*a*, 20*b* can be guaranteed.

D-3. Third Modification Example

Figure 35:
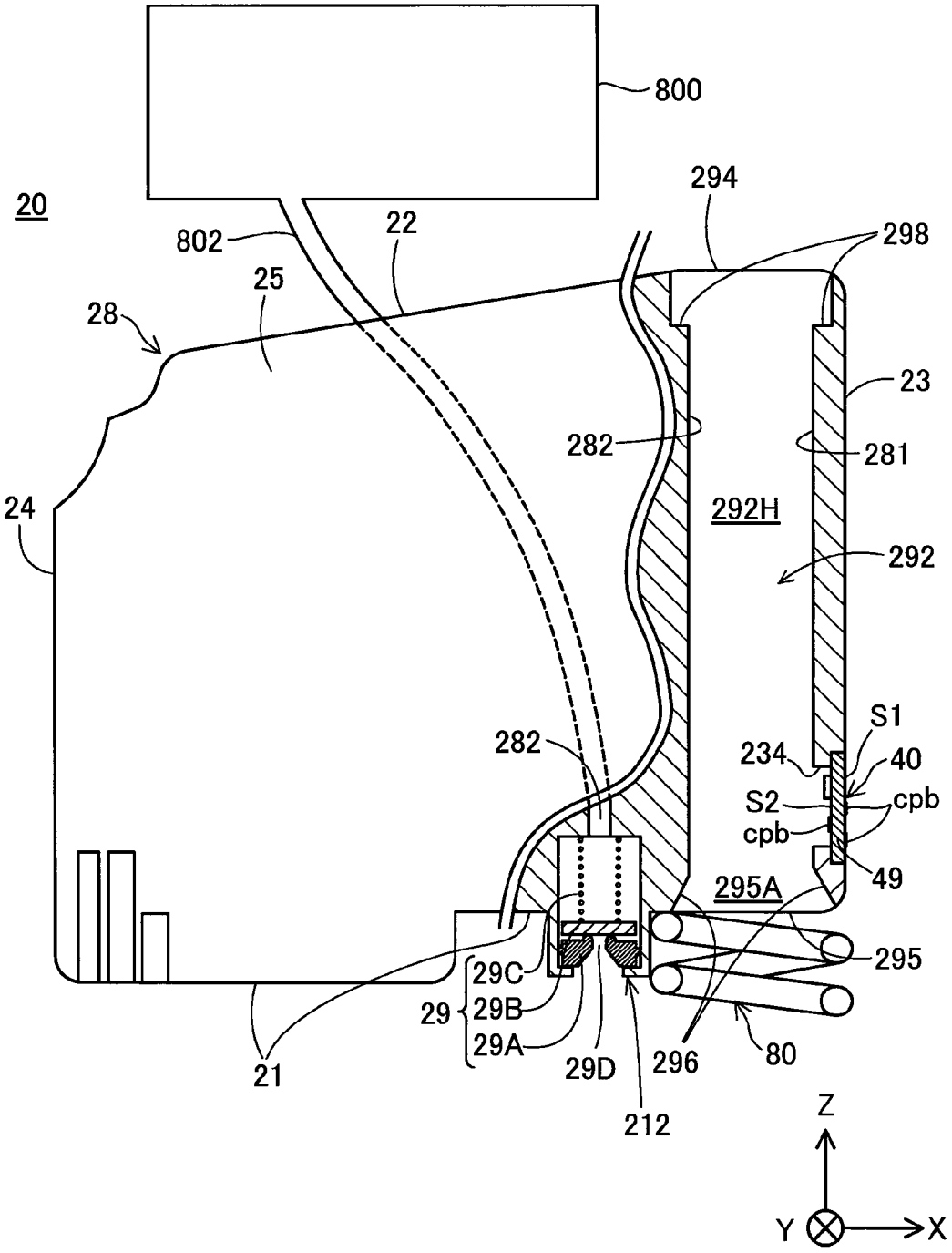
FIG. 35 is a diagram for explaining a third modification example.

In the above-described first to third embodiments, the cartridge 20, 20*a*, 20*b* includes the liquid storage portion 201, 201*a*, 201*b* inside the outer shell 28, 28*a*, 28*b*, but the position of the liquid storage portion 201, 201*a*, 201*b* is not limited thereto. A third modification example is described below taking the cartridge 20 according to the first embodiment as an example. FIG. 35 is a diagram for explaining the third modification example. As illustrated in FIG. 35, a tank 800 as a liquid storage unit may be disposed on an outer side of the outer shell 28. The tank 800 is connected to the liquid supply port 212 via a tube 802.

D-4. Fourth Modification Example

The present invention is not limited to an inkjet printer and a liquid supply unit for supplying ink to an inkjet printer, and can also be applied to any type of liquid ejection apparatus that ejects a liquid other than ink, and a liquid supply unit (cartridge) for storing such a liquid. For example, the present invention can be applied to the following types of liquid ejection apparatus and liquid supply units therefor.

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) fluid consuming device configured to eject a bioorganic material-containing fluid used for manufacturing biochips;

(5) sample ejection device used as a precision pipette;

(6) ejection device of lubricating oil;

(7) ejection device of a resin solution;

(8) fluid consuming device for pinpoint ejection of lubricating oil on precision machines such as watches or cameras;

(9) fluid consuming device configured to eject a transparent resin solution, such as an ultraviolet curable resin solution, onto a substrate in order to manufacture a hemispherical microlens (optical lens) used for, for example, optical communication elements;

(10) fluid consuming device configured to eject an acidic or alkaline etching solution in order to etch a substrate or the like; and

(11) fluid consuming device equipped with a fluid ejection head for ejecting a very small volume of droplets of any other fluid.

The "droplet" herein means the state of fluid ejected from the fluid consuming device and may be in a granular shape, a teardrop shape or a tapered threadlike shape. The "fluid" herein may be any material ejectable by the fluid consuming device. The "fluid" may be any material in the liquid phase. For example, liquid-state materials of high viscosity or low viscosity, sols, aqueous gels and other liquid-state materials having inorganic solvents, organic solvents, solutions, liquid resins and liquid metals (metal melts) are included in the "fluid". The "fluid" is not limited to the liquid state as one of the three states of matter but includes solutions, dispersions and mixtures of the functional solid material particles, such as pigment particles or metal particles, solved in, dispersed in or mixed with a solvent. Typical examples of the fluid include ink described in the above embodiment and liquid crystal. The ink herein includes general water-based inks and oil-based inks, as well as various fluid compositions, such as gel inks and hot-melt inks.

The invention is not limited to any of the embodiment, the examples and the modifications described herein but may be implemented by a diversity of other configurations without departing from the scope of the invention. For example, the technical features of the embodiment, examples and modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

REFERENCE SYMBOLS LIST

10, 10*a*, 10*b* . . . liquid ejection system, 18 . . . protruding portion, 20, 20*a*, 20*b*, 20*c*, 20*d*, 20A . . . cartridge, 21 . . . first wall portion, 21*a* . . . first wall portion, 21*b* . . . first wall portion, 22 . . . second wall portion, 22*a* . . . second wall portion, 22*b* . . . second wall portion, 23 . . . third wall portion, 23*a* . . . third wall portion, 23*b* . . . third wall portion, 24 . . . fourth wall portion, 24*a* . . . fourth wall portion, 24*b* . . . fourth wall portion, 25 . . . fifth wall portion, 25*a* . . . fifth wall portion, 25*b* . . . fifth wall portion, 26 . . . sixth wall portion, 26*a* . . . sixth wall portion, 26*b* . . . sixth wall portion, 28, 28A, 28*a*, 28*b*, 28*c*, 28*d* . . . outer shell, 29 . . . valve mechanism, 29A . . . valve seat, 29B . . . valve element, 29C . . . biasing member, 29D . . . valve hole, 40, 40*a* . . . circuit board, 41 . . . first terminal row, 42 . . . second terminal row, 43 . . . third terminal row, 49 . . . arrangement wall portion, 50 . . . printer, 50*b* . . . printer, 52 . . . head unit, 60 . . . carriage unit, 60*a* . . . carriage unit, 60*b* . . . carriage unit, 61 . . . holder unit, 61*a* . . . holder unit, 61*b* . . . holder unit, 62 . . . apparatus front wall portion, 62*a* . . . apparatus front wall portion, 62*b* . . . apparatus front wall portion, 64 . . . first side wall portion, 64*a* . . . first side wall portion, 64*b* . . . first side wall portion, 65 . . . second side wall portion, 65*a* . . . second side wall portion, 65*b* . . . second side wall portion, 66 . . . third side wall portion, 66*a* . . . third side wall portion, 66*b* . . . third side wall portion, 67 . . . fourth side wall portion, 67*a* . . . fourth side wall portion, 67*b* . . . fourth side wall portion, 69 . . . cartridge storage chamber, 69A to 69F . . . slot, 69*a* . . . cartridge storage chamber, 70 . . . guide member, 70*a* . . . guide member, 70*b* . . . guide member, 72 . . . body portion, 72*a* . . . body portion, 73 . . . elastically deforming portion, 74 . . . end portion, 74A . . . end portion, 74*a* . . . end portion, 78 . . . apparatus-side restriction portion, 78A . . . apparatus-side restriction portion, 78*a* . . . first apparatus-side restriction portion, 80 . . . biasing member, 80*b* . . . biasing member, 80*c* . . . biasing member, 91 . . . holder-side electrode portion, 91A . . . inner electrode unit, 91B . . . outer electrode unit, 91*a* . . . electrode unit, 91*b* . . . electrode unit, 92 . . . outer electrode holder, 94 . . . inner electrode holder, 201 . . . liquid storage portion, 201*a* . . . liquid storage portion, 201*b* . . . liquid storage portion, 205 . . . communication hole, 208 . . . connecting wall portion, 212 . . . liquid supply port, 212*a* . . . liquid supply port, 212*b* . . . liquid supply port, 219 . . . supply unit arrangement port, 222 . . . second unit-side restriction portion, 232 . . . air induction port, 234 . . . opening, 281 . . . side surface, 284 . . . foam resin, 292 . . . receiving portion, 292H . . . through hole, 292*a* . . . receiving portion, 292*b* . . . receiving portion, 292*c* . . . receiving portion, 294 . . . second open end, 295 . . . first open end, 295A . . . induction port, 295Aa . . . induction port, 296 . . . side surface, 298 . . . unit-side restriction portion, 299 . . . opening portion, 420 . . . storage device, 431 . . . first terminal, 432 . . . second terminal, 433 . . . third terminal, 434 . . . fourth terminal, 435 . . . fifth terminal, 436 . . . sixth terminal, 437 . . . seventh terminal, 438 . . . eighth terminal, 439 . . . ninth terminal, 510 . . . control unit, 517 . . . flexible cable, 522 . . . carriage motor, 524 . . . drive belt, 529 . . . transfer rod, 532 . . . transfer motor, 534 . . . platen, 539 . . . tube, 622 . . . liquid injecting needle, 622*a* . . . liquid introducing pipe, 622*s* . . . base portion, 622*t* . . . tip portion, 629 . . . elastic member, 640 . . . second apparatus-side restriction portion, 690 . . . terminal holder, 691 . . . inclined surface, 721 . . . side surface, 800 . . . tank, 802 . . . tube, 921 . . . slit, 922 . . . support stand, 930 . . . apparatus-side terminal, 930*a* . . . first apparatus-side terminal group, 930*b* . . . second apparatus-side terminal group, 930*c* . . . third apparatus-side terminal group, 931 to 939 . . . apparatus-side terminal, 941 . . . slit, 942 . . . support stand, CT . . . central axis, CTa . . . central axis, F1 . . . force, F2 . . . force, F3 . . . force, L28 . . . center, L41 . . . imaginary line, L42 . . . imaginary line, L43 . . . imaginary line, LPt . . . range, LPta . . . range, P . . . printing medium, Psb . . . force, Ptb . . . force, RP . . . bent portion, S1 . . . first wall surface, S2 . . . second wall surface, cpa . . . contact portion, cpb . . . contact portion, cpb1 . . . first contact portion, cpb2 . . . second contact portion, d1 . . . distance, d2 . . . distance, d3 . . . distance, TL . . . total length, T292 . . . length

What is claimed is:

1. A liquid supply unit configured to be mounted onto a liquid ejection apparatus including an apparatus-side terminal, a liquid introducing portion that protrudes outward from a mounting wall portion of the liquid ejection apparatus, and a guide member that protrudes outward from the mounting wall portion on the same side as a protruding direction of the liquid introducing portion, the liquid supply unit comprising:

an outer shell;

a contact portion disposed in the outer shell and configured to electronically connect to the apparatus-side terminal by making contact with the apparatus-side terminal;

a liquid supply port disposed on the outer shell and used for inserting the liquid introducing portion; and a hole that is configured to receive the guide member therein, and extends in a direction in which the guide member protrudes outward in a mounting state in which the liquid supply unit is mounted onto the liquid ejection apparatus, at least a part of the hole being located between the liquid supply port and the contact portion in a predetermined direction orthogonal to a direction in which the hole extends.

2. The liquid supply unit in accordance with claim 1, wherein the hole includes a unit-side restriction portion that engages with the guide member, to thereby restrict movement of the liquid supply unit toward a direction opposite to a mounting direction of mounting the liquid supply unit onto the liquid ejection apparatus.

3. The liquid supply unit in accordance with claim 1, further comprising:

an arrangement wall portion that is disposed in the outer shell and in which the contact portion is disposed, wherein:

the liquid ejection apparatus includes a plurality of the apparatus-side terminals;

the plurality of apparatus-side terminals is configured to make contact with the corresponding contact portions while pushing the corresponding contact portions;

the liquid supply unit comprises a plurality of the contact portions;

a first contact portion among the plurality of the contact portions is arranged on the first wall surface of the arrangement wall portion; and a second contact portion among the plurality of the contact portions is arranged on a second wall surface on a side opposite to the first wall surface.

4. The liquid supply unit in accordance with claim 3, further comprising:

a storage device disposed on the arrangement wall portion, wherein:

the first wall surface forms a front surface of the arrangement wall portion that makes contact with the outside;

the second wall surface forms a rear surface of the arrangement wall portion that makes contact with space inside the outer shell; and the second contact portion is used to supply power to the storage device.

5. The liquid supply unit in accordance with claim 1, further comprising:

a biasing member that generates a force for moving the outer shell in a direction opposite to a mounting direction of mounting the liquid supply unit onto the liquid ejection apparatus in the mounting state.

6. The liquid supply unit in accordance with claim 5, further comprising:

a valve mechanism that is disposed inside the liquid supply port and used for opening/closing an internal flow path formed inside the liquid supply port, the valve mechanism comprising:

a valve seat formed with a valve hole;

a valve element for opening/closing the valve hole; and the biasing member for biasing the valve element toward the valve seat.

7. The liquid supply unit in accordance with claim 1, wherein a length of the hole is at least half of a total length of the liquid supply unit in the mounting direction of mounting the liquid supply unit onto the liquid ejection apparatus.

8. The liquid supply unit in accordance with claim 1, wherein the outer shell includes a first wall portion on which the liquid supply port is disposed; a second wall portion that opposes the first wall portion; a third wall portion that intersects with the first wall portion and the second wall portion; and a fourth wall portion that intersects with the first wall portion and the second wall portion and opposes the third wall portion and the predetermined direction.

9. The liquid supply unit in accordance with claim 8, wherein the hole is a through hole that extends from the first wall portion across to the second wall portion.

* * * * *